US009868016B2

(12) United States Patent
Meredith et al.

(10) Patent No.: US 9,868,016 B2
(45) Date of Patent: Jan. 16, 2018

(54) EXERCISE MACHINE WITH A DETACHABLE STABILIZING SUPPORT ASSEMBLY HAVING ADJUSTABLE POSITIONS

(71) Applicant: Hoist Fitness Systems, Inc., Poway, CA (US)

(72) Inventors: Jeffrey O. Meredith, Del Mar, CA (US); Bruce Hockridge, San Diego, CA (US); Billy Y. Kim, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 0 days.

(21) Appl. No.: 14/961,136

(22) Filed: Dec. 7, 2015

(65) Prior Publication Data

US 2016/0199686 A1 Jul. 14, 2016

Related U.S. Application Data

(60) Provisional application No. 62/102,192, filed on Jan. 12, 2015.

(51) Int. Cl.
*A63B 21/00* (2006.01)
*A63B 21/068* (2006.01)
(Continued)

(52) U.S. Cl.
CPC ..... *A63B 21/4027* (2015.10); *A63B 21/068* (2013.01); *A63B 21/0628* (2015.10);
(Continued)

(58) Field of Classification Search
CPC ..... A63B 1/00; A63B 3/00; A63B 21/00047; A63B 21/00058; A63B 21/00069; A63B 21/00072; A63B 21/00076; A63B 21/00178; A63B 21/00181; A63B 21/00185; A63B 21/002; A63B 21/0023; A63B 21/0615; A63B 21/0616; A63B 21/0617; A63B 21/065; A63B 21/068; A63B 21/08; A63B 21/15; A63B 21/159; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/4001; A63B 21/4007; A63B 21/4009; A63B 21/4023; A63B 21/4027; A63B 21/4029; A63B 21/4033; A63B 21/4034; A63B 21/4035;
(Continued)

(56) References Cited

U.S. PATENT DOCUMENTS 3,593,708 A * 7/1971 Steele ..... A61H 1/0218 482/144
3,904,195 A * 9/1975 Chavanne ..... A61H 1/008 482/142

(Continued)

*Primary Examiner* — Loan H Thanh
*Assistant Examiner* — Gary D Urbiel Goldner
(74) *Attorney, Agent, or Firm* — Gordon Rees Scully Mansukhani LLP; David R. Heckadon

(57) ABSTRACT

A detachable stabilizing support system for use on an exercise machine, such as a functional trainer exercise machine, has adjustable support positions and is capable of being configured between an exercise position and a more compact storage position.

23 Claims, 45 Drawing Sheets

(51) Int. Cl.

| | |
|---|---|
| ***A63B 23/00*** | (2006.01) |
| ***A63B 23/035*** | (2006.01) |
| ***A63B 23/04*** | (2006.01) |
| ***A63B 23/12*** | (2006.01) |
| ***A63B 21/062*** | (2006.01) |
| *A63B 21/005* | (2006.01) |
| *A63B 21/008* | (2006.01) |
| *A63B 21/012* | (2006.01) |
| *A63B 21/02* | (2006.01) |
| *A63B 21/055* | (2006.01) |
| *A63B 71/00* | (2006.01) |

(52) U.S. Cl.

CPC ..... *A63B 21/4033* (2015.10); *A63B 23/0355* (2013.01); *A63B 23/03533* (2013.01); *A63B 23/1209* (2013.01); *A63B 23/1218* (2013.01); *A63B 23/1227* (2013.01); *A63B 21/005* (2013.01); *A63B 21/008* (2013.01); *A63B 21/00047* (2013.01); *A63B 21/00069* (2013.01); *A63B 21/00072* (2013.01); *A63B 21/0085* (2013.01); *A63B 21/00181* (2013.01); *A63B 21/00185* (2013.01); *A63B 21/012* (2013.01); *A63B 21/023* (2013.01); *A63B 21/026* (2013.01); *A63B 21/0552* (2013.01); *A63B 21/0557* (2013.01); *A63B 21/154* (2013.01); *A63B 21/156* (2013.01); *A63B 21/4029* (2015.10); *A63B 21/4035* (2015.10); *A63B 21/4047* (2015.10); *A63B 23/03525* (2013.01); *A63B 23/03541* (2013.01); *A63B 23/03558* (2013.01); *A63B 23/03575* (2013.01); *A63B 23/1245* (2013.01); *A63B 2023/006* (2013.01); *A63B 2023/0411* (2013.01); *A63B 2071/009* (2013.01); *A63B 2208/0204* (2013.01); *A63B 2208/029* (2013.01); *A63B 2208/0214* (2013.01); *A63B 2208/0228* (2013.01); *A63B 2209/02* (2013.01); *A63B 2210/00* (2013.01); *A63B 2210/50* (2013.01); *A63B 2225/09* (2013.01); *A63B 2225/093* (2013.01)

(58) Field of Classification Search

CPC ..... A63B 21/4039; A63B 21/4045; A63B 21/4047; A63B 21/4049; A63B 2023/003; A63B 2023/006; A63B 2023/0411; A63B 23/0211; A63B 23/0216; A63B 23/0222; A63B 23/0233; A63B 23/035; A63B 23/03508; A63B 23/03516; A63B 23/03525; A63B 23/03533; A63B 23/03541; A63B 23/0355; A63B 23/03558; A63B 23/03575; A63B 23/04; A63B 23/0405; A63B 23/0482; A63B 23/0488; A63B 23/0494; A63B 23/12; A63B 23/1209; A63B 23/1218; A63B 23/1227; A63B 23/1236; A63B 23/1245; A63B 23/1281; A63B 69/0057; A63B 69/0064; A63B 2208/0204; A63B 2208/0214; A63B 2208/0228; A63B 2208/0233; A63B 2210/00; A63B 2210/50; A63B 2225/09; A63B 2225/093

See application file for complete search history.

(56) References Cited

U.S. PATENT DOCUMENTS

| | | | | | |
|---|---|---|---|---|---|
| 4,582,320 | A * | 4/1986 | Shaw | A63B 21/00072 | 482/130 |
| 4,674,160 | A * | 6/1987 | Gibson | A63B 21/06 | 482/139 |
| 5,336,148 | A * | 8/1994 | Ish, III | A63B 21/0628 | 482/137 |
| 5,370,595 | A * | 12/1994 | Voris | A63B 21/0628 | 482/100 |
| 5,407,414 | A * | 4/1995 | Bass | A63B 21/00072 | 482/121 |
| 5,800,323 | A * | 9/1998 | Ansel | A63B 21/0552 | 482/129 |
| 5,813,951 | A * | 9/1998 | Einsig | A63B 21/06 | 482/1 |
| 6,077,203 | A * | 6/2000 | Lay | A63B 21/1609 | 482/79 |
| 6,190,293 | B1 * | 2/2001 | Schuyler | A63B 23/12 | 482/141 |
| 6,425,845 | B1 * | 7/2002 | Varner | A63B 23/0211 | 482/113 |
| 7,608,020 | B2 * | 10/2009 | Mason | A63B 21/0615 | 482/105 |
| 2009/0170668 | A1 * | 7/2009 | Giannelli | A63B 23/03533 | 482/94 |
| 2009/0192026 | A1 * | 7/2009 | Mason | A63B 21/0615 | 482/97 |
| 2010/0048368 | A1 * | 2/2010 | Donofrio | A63B 1/00 | 482/130 |
| 2010/0137105 | A1 * | 6/2010 | McLaughlin | A63B 23/0205 | 482/8 |
| 2014/0080685 | A1 * | 3/2014 | Butler | A63B 21/062 | 482/102 |

* cited by examiner

EXERCISE MACHINE WITH A DETACHABLE STABILIZING SUPPORT ASSEMBLY HAVING ADJUSTABLE POSITIONS

CROSS-REFERENCE TO RELATED APPLICATIONS

The application claims the benefit of provisional U.S. Patent Application Ser. No. 62/102,192, which was filed in the U.S. Patent and Trademark Office on Jan. 12, 2015. Application Ser. No. 62/102,192 is incorporated herein by reference.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

The present invention generally relates to fitness equipment. Specifically, the embodiments of the present invention are directed to an exercise machine with a detachable stabilizing support. The stabilizing support may be attached by engaging a flip and dip handle system that allows the dip handle assemblies to be rotated between an exercise position and a storage position. Further, the stabilizing support is pivotably adjustable to engage a user's body at various heights.

BACKGROUND OF THE INVENTION

An exercise machine may include multiple stations for performing different exercise routines in different positions. For example, an exercise machine may include a stabilizing support for supporting a user while performing an exercise routine in a standing position. Another station may allow the user to perform the same or similar exercise without the stabilizing support.

A functional trainer is a class of exercise machine that has become popular in recent years because of their versatility. Specifically, functional trainers include adjustable components that allow the user to perform a wide variety of exercises in a wide variety of positions. Thanks to their ability to transform themselves into different configurations, they can mimic most of the traditional multi-station machines and free weights with just a few adjustments. There are many types of functional trainers on the market today, and they use several different methods for adjusting their components. Most of them use adjustable arms, rotating columns, and/or sliding carriages with pulleys or multiple pulleys mounted at different locations on the machine. Some of them can be used with a stabilizing support. The number of exercises that can be performed on particular machine depends on how many different configurations it can be transformed into. More configurations provide more exercise options for the user. There is a large demand for functional trainers—both in commercial and home gyms—because they can be adapted for use in a wide variety of exercises while taking up relatively little space when compared to traditional exercise machines and free weights.

Accordingly, a need exists for a versatile exercise machine, such as a functional trainer, that includes a stabilizing support that the user may optionally attach to the exercise machine for use in the performance of an exercise. Further, a need exists for the optionally attachable stabilizing support to be adjustable so that it is capable of engaging a user's body at various heights. A further need exists for a stabilizing support system that can be placed into a compact configuration for easy storage. This stabilizing support system can be optionally stored on the exercise machine, without interfering with the use of the exercise machine. The embodiments of the present invention solve these problems by providing an exercise machine that includes a removable stabilizing support assembly that the user may optionally attach to (or detach from) the exercise machine. The stabilizing support is pivotably adjustable to engage a user's body at various heights. And the stabilizing support can be folded into a compact arrangement for easy storage when not in use. Other advantages of the present invention will become apparent to one skilled in the art.

SUMMARY OF THE INVENTION

An embodiment of the present invention is directed to a detachable stabilizing support system, the detachable stabilizing support system including a crossmember having an engagement channel attached to each end thereof; at least one pivot bracket mounted on the crossmember; a stabilizing support strut pivotally mounted to the crossmember; and a support pad mounted on an end of the stabilizing support strut.

Another embodiment of the present invention is directed to an exercise machine, the exercise machine including a dip handle system, wherein the dip handle system includes a first and second dip handle for performing dip exercises; the exercise machine further comprising a detachable stabilizing support system mounted on the dip handle system, wherein the detachable stabilizing support system includes a crossmember having first and second ends; a first engagement channel associated with the first end of the crossmember; a second engagement channel associated with the second end of the crossmember; at least one pivot bracket mounted on the crossmember; a stabilizing support strut pivotally mounted to the crossmember; and a support pad mounted on an end of the stabilizing support strut, and wherein the first engagement channel of the detachable stabilizing support system is engaged on the first dip handle and the second engagement channel of the detachable stabilizing support system is engaged on the second dip handle.

BRIEF DESCRIPTION OF THE DRAWINGS

Preferred features of the embodiments of the present invention are disclosed in the accompanying drawings, wherein similar reference characters denote similar elements throughout the several views, and wherein.

DETAILED DESCRIPTION

Figure 1:
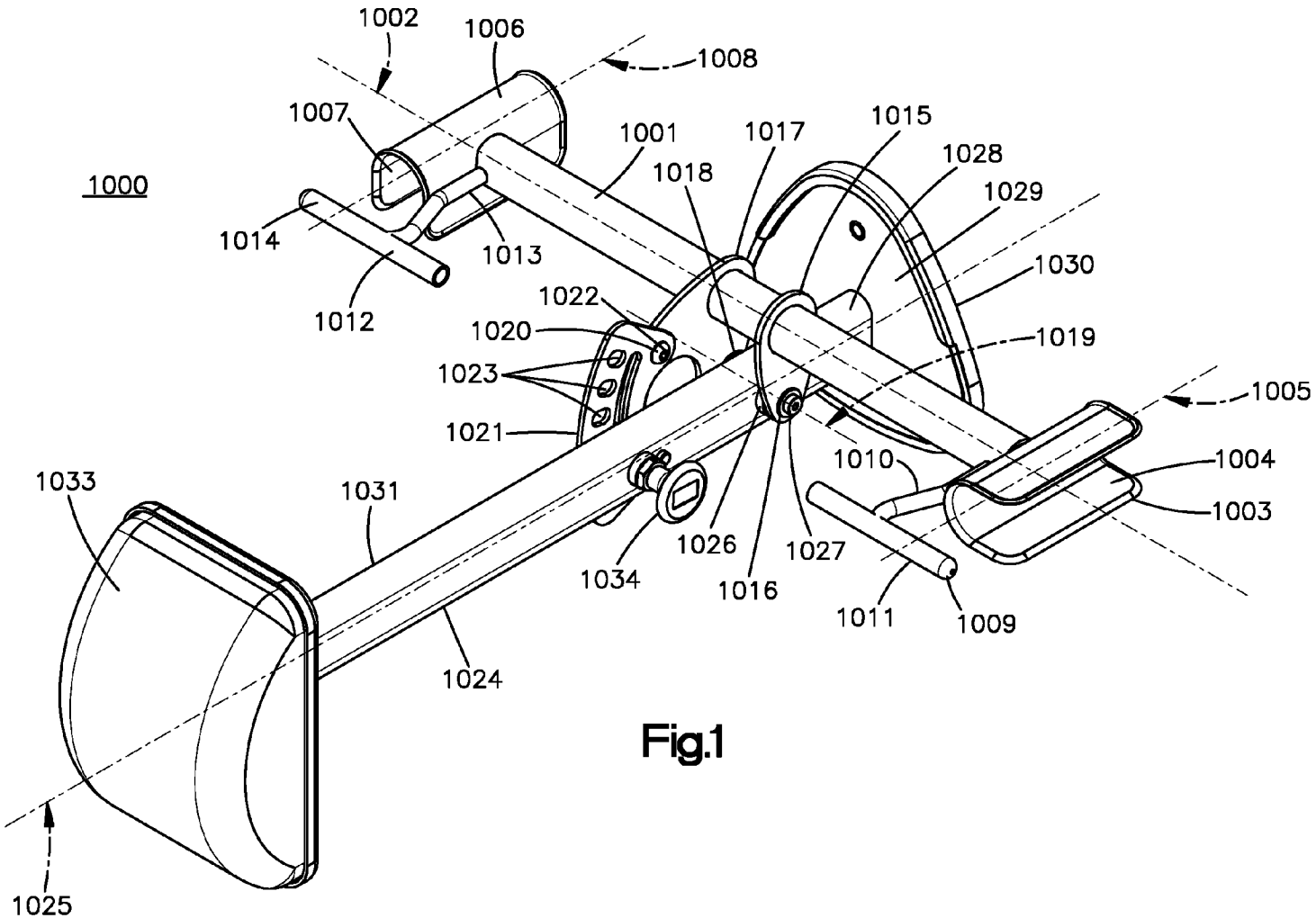
FIG. 1 is a top-right side isometric view of a detachable stabilizing support system.
Figure 2:
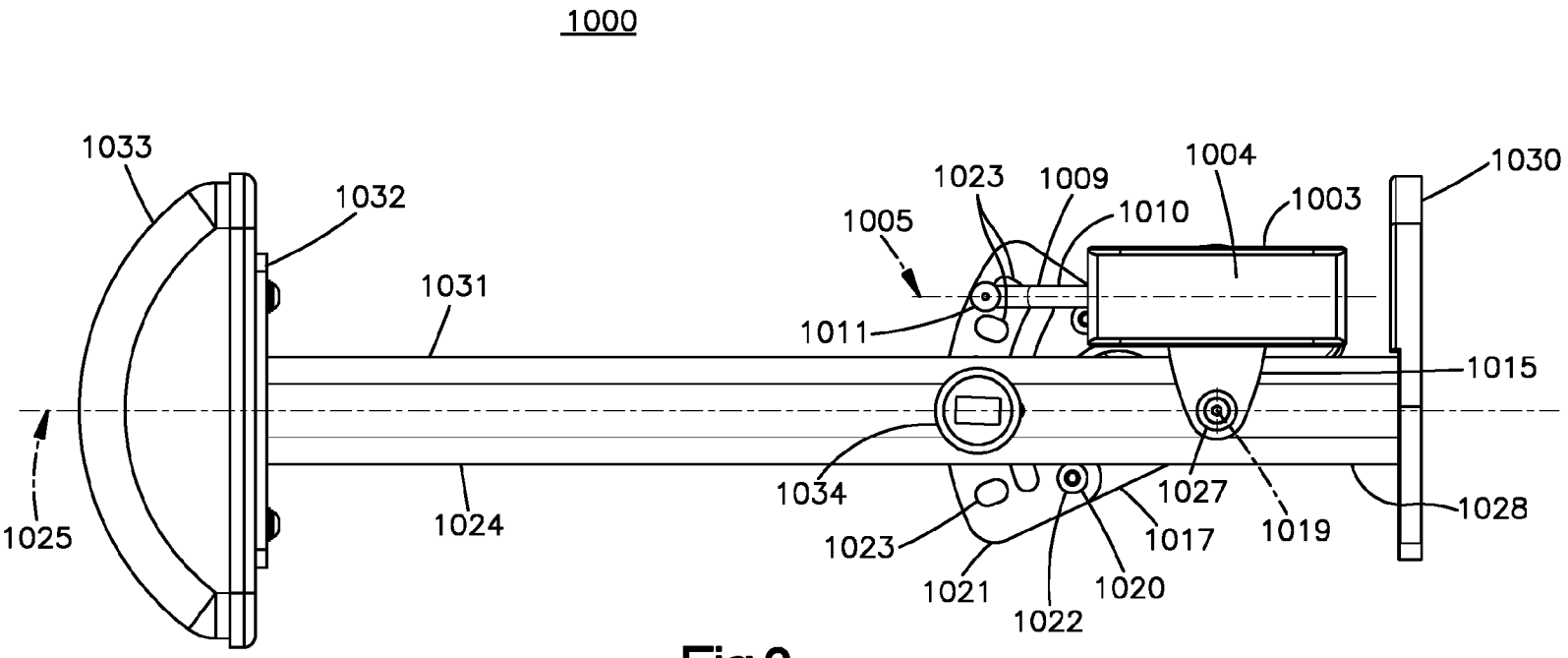
FIG. 2 is a right side view of the detachable stabilizing support system as depicted in FIG. 1.
Figure 3:
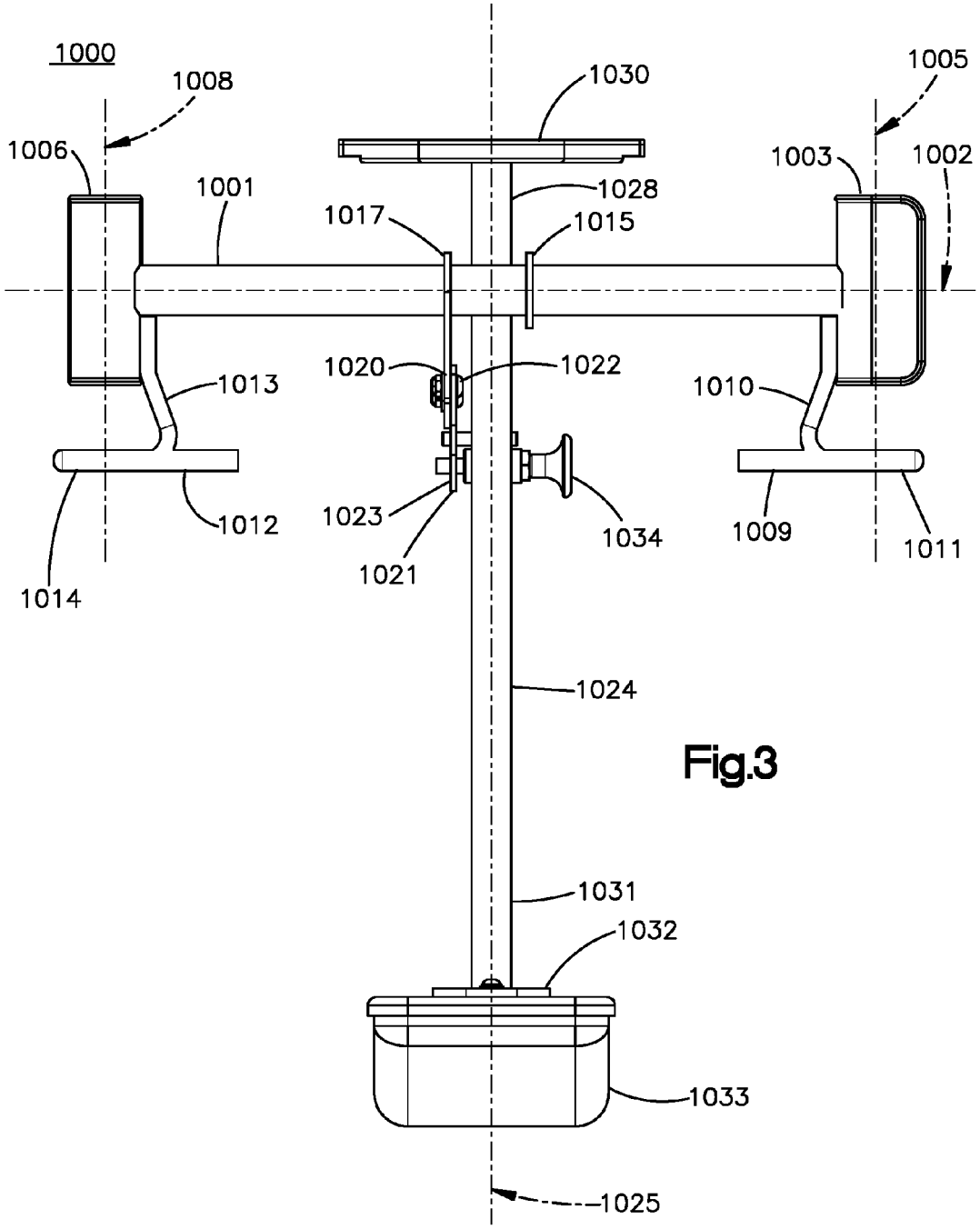
FIG. 3 is a top side view of the detachable stabilizing support system as depicted in FIG. 1.
Figure 4:
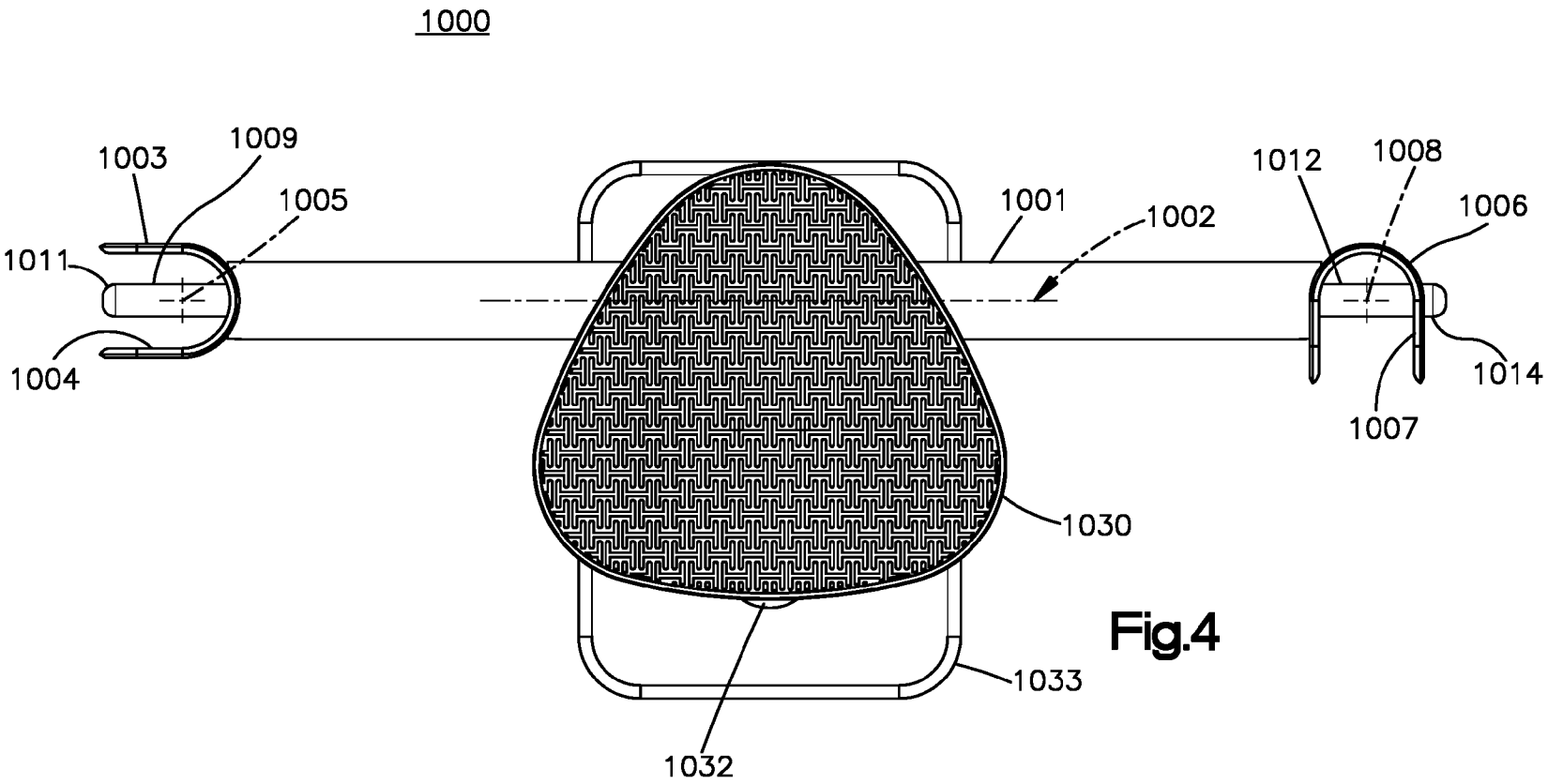
FIG. 4 is a rear side view of the detachable stabilizing support system as depicted in FIG. 1.
Figure 5:
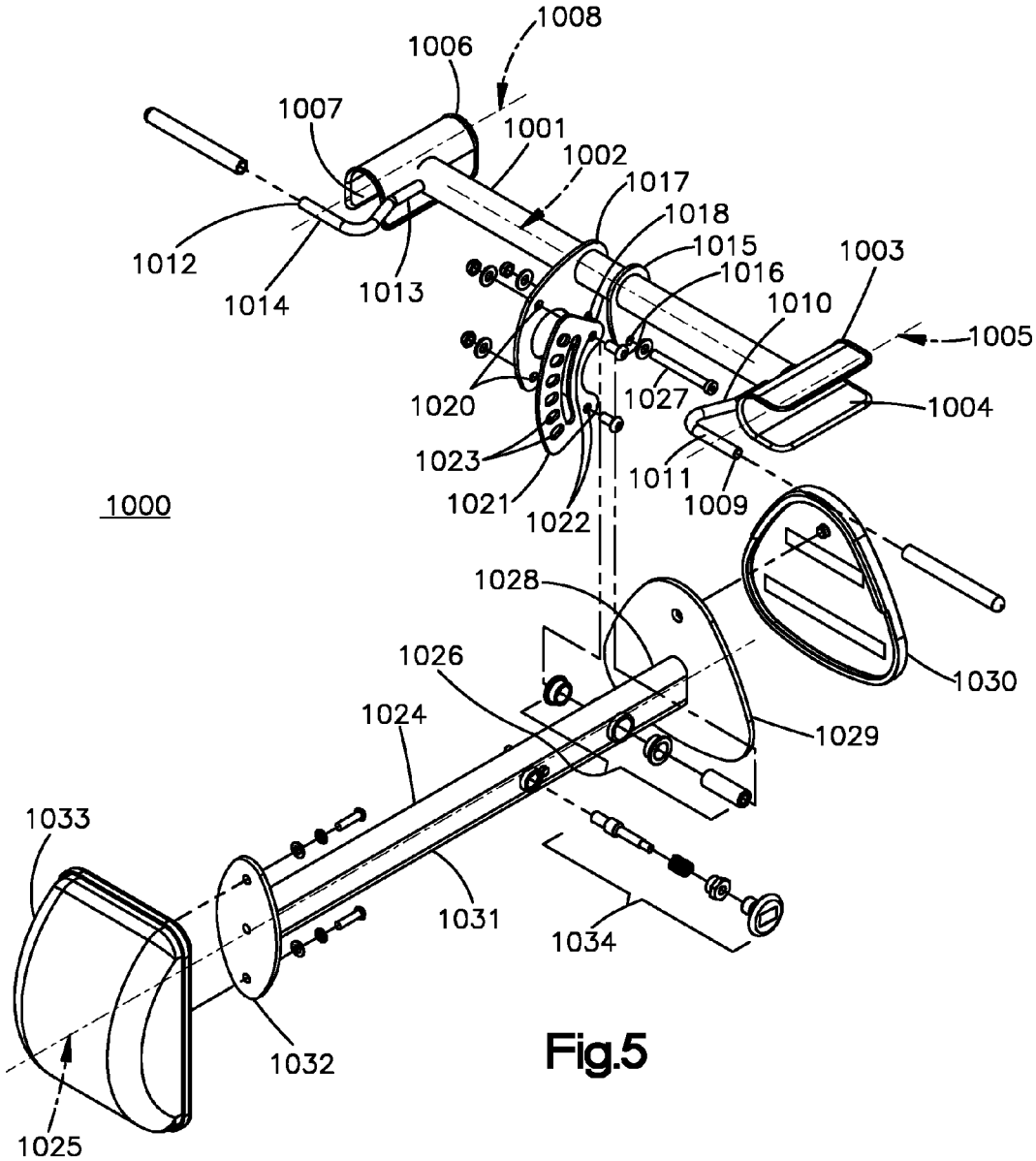
FIG. 5 is an exploded view of the detachable stabilizing support system as depicted in FIG. 1.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. It is to be understood that the phraseology and terminology used in the following description are used for the purpose of description and enablement, and should not be regarded as limiting. Additionally, in the following description, it is understood that terms such as "top," "bottom," "side," "front," "back," "inner," "outer," and the like, are words of convenience and are not to be construed as limiting terms.

A detachable stabilizing support system having adjustable positions is described herein. The embodiments of the present invention are designed to provide a stabilizing support system that is detachably mounted on an exercise machine. The stabilizing support system can be adjusted into a variety of configurations to engage a user's body at various heights, or to provide either horizontal or vertical support.

An embodiment of the present invention includes a detachable stabilizing support system 1000 as depicted in FIGS. 1-5. The stabilizing support system 1000 of FIGS. 1-5 may be detachably mounted on the grip portions 472, 372 of right and left dip handles 427, 327 of an exercise machine 100. (See FIGS. 14,15.) The exercise machine 100 is described in greater detail with respect to FIGS. 6-25 below. However, one of ordinary skill will appreciate that the stabilizing support system of the present invention may be adaptable to a number of different exercise machines. Further one of ordinary skill in the art will understand that the stabilizing support system of the present invention may be detachably mounted on many members of an exercise machine, including without limitation: dip handles, chin-up or pull-up handles, exercise arms, safety bars or arms, hooks or J-hooks, weight storage pins, or pegs for resistance bands. Thus, the present invention is not limited to any particular exercise machine or to the dip handle configuration described herein.

As best shown in FIGS. 1-5, the stabilizing support system 1000 of the present embodiment includes a crossmember 1001, having a central longitudinal axis 1002. At or near the right end of the crossmember 1001, a U-shaped right-hand engagement channel 1003 is attached. The right-hand engagement channel 1003 forms a right-facing (i.e., outward-facing) slot 1004, having a longitudinal axis 1005. At or near the left end of the crossmember 1001, a U-shaped left-hand engagement channel 1006 is attached. The left hand engagement channel 1006 forms a downward-facing slot 1007, having a longitudinal axis 1008. The longitudinal axes 1005, 1008 of the left and right engagement channels 1003, 1006 are substantially horizontal and substantially perpendicular to the central longitudinal axis 1002 of the crossmember 1001.

The stabilizing support system 1000 of the depicted embodiment includes a pair of grip end stops 1009, 1012. The grip end stops 1009, 1012 engage the ends of the right and left dip handles 427, 327 of exercise machine 100, in order to transmit horizontal forces from the stabilizing support system 1000 to the exercise machine 100. That is, when a user employs the stabilizing support system 1000 to provide horizontal stabilizing support, the grip end stops 1009, 1012 prevent the stabilizing support system 1000 from sliding rearwardly along the right and left dip handles 427, 327 of the exercise machine 100. The grip end stops 1009, 1012 as depicted in FIGS. 1-5 will now be described in greater detail.

Near the right end of the crossmember 1001, adjacent to the right-hand engagement channel 1003, a right-hand grip end stop 1009 is attached to the crossmember 1001. The right-hand grip end stop 1009 includes a first member 1010 extending forwardly from the crossmember 1001 and a second member 1011 extending in a direction toward the right-hand engagement channel 1003, or longitudinal axis 1005. The second member 1011 of the right-hand grip end stop 1009 may extend substantially in parallel with the crossmember 1001 and its central longitudinal axis 1002. Furthermore, the second member 1011 of the right-hand grip end stop 1009 preferably intersects and/or passes through the longitudinal axis 1005 of the right-hand engagement channel 1003.

Similarly, near the left end of the crossmember 1001, adjacent to the left-hand engagement channel 1006, a left-hand grip end stop 1012 is attached to the crossmember 1001. The left-hand grip end stop 1012 includes a first member 1013 extending forwardly from the crossmember 1001 and a second member 1014 extending in a direction toward the left-hand engagement channel 1006, or longitudinal axis 1008. The second member 1014 of the left-hand grip end stop 1012 may extend substantially in parallel with the crossmember 1001 and its central longitudinal axis 1002. Furthermore, the second member 1014 of the left-hand grip end stop 1012 preferably intersects and/or passes through the longitudinal axis 1008 of the left-hand engagement channel 1006.

One of ordinary skill in the art will readily appreciate that a variety of configurations for right and left grip end stops 1009, 1012 are available to accomplish the same means without departing from the scope or spirit of the invention. As just one example, the right and left grip end stops 1009, 1012 could each be made from just a single member that is configured to engage the ends of the right and left dip handles 427, 327 of exercise machine 100. As another example, the right and left grip end stops 1009, 1012 might optionally be attached to the respective right and left engagement channels 1003, 1006, rather than coupled to the crossmember 1001. In such a configuration, the right and left grip end stops 1009, 1012 could be end caps or surfaces that simply close the forward, open ends of the right and left engagement channels 1003, 1006.

Toward the center of the crossmember 1001, located between the right and left engagement channels 1003, 1006, a pivot bracket 1015 is coupled to the crossmember 1001. The pivot bracket 1015 includes a pivot hole 1016. Adjacent to the pivot bracket 1015, and also located between the right and left engagement channels 1003, 1006, a pivot and adjustment bracket 1017 is coupled to the crossmember 1001. The pivot and adjustment bracket 1017 includes a pivot hole 1018. The pivot holes 1016, 1018 preferably create a common pivot axis 1019.

Pivot and adjustment bracket 1017 also includes one or more adjustment plate mounting holes 1020. An adjustment plate 1021 includes an equal number of mounting holes 1022 and a plurality of locking pin holes 1023. The adjustment plate 1021 is mounted to the pivot and adjustment bracket 1017. Specifically, fasteners pass through the adjustment plate mounting holes 1020 in the pivot and adjustment bracket 1017 and the mounting holes 1022 in the adjustment plate 1021, in order to couple the adjustment plate 1021 to the pivot and adjustment bracket 1017. One of ordinary skill in the art will understand and appreciate that, the adjustment plate 1021 and pivot and adjustment bracket 1017 could be coupled together using other means, including by welding or adhering using glue. As yet another alternative, the adjustment plate 1021 and the pivot and adjustment bracket 1017 could be formed into a single bracket. That is, an alternative pivot and adjustment bracket 1017 could readily incorporate the locking pin holes 1023, such that a single bracket provides all of the features of both the pivot and adjustment bracket 1017 and the adjustment plate 1021.

The stabilizing support system 1000 of FIGS. 1-5 further includes a stabilizing strut 1024 having a longitudinal axis 1025. The stabilizing strut 1024 (and its longitudinal axis 1025) is oriented generally perpendicular to the crossmember 1001 (and its central longitudinal axis 1002). The stabilizing strut 1024 includes a pivot sleeve 1026 near its rearward end 1028. A pivot pin 1027 passes through: (1) the pivot hole 1018 in the pivot and adjustment bracket 1017, (2) the pivot sleeve 1026 of the stabilizing strut 1024, and (3) the pivot hole 1016 in the pivot bracket 1015. This provides a pivotal connection that allows the stabilizing strut 1024 to adjustably rotate about pivot axis 1019.

The stabilizing strut 1024 further includes a pull pin 1034 that can selectively engage into one of the locking pin holes 1023 in the adjustment plate 1021. Thus, the rotational orientation of the stabilizing strut 1024 about pivot axis 1019 can be selected by rotating the stabilizing strut 1024 into the desired position, and then locking the pull pin 1034 into a corresponding locking pin hole 1023. The pull pin 1034 may optionally be spring-loaded, so that it is biased toward the locking pin holes 1023.

The rearward end 1028 of the stabilizing strut 1024 includes a vertical support plate 1029. A protective rubber foot 1030 may be installed over the vertical support plate 1029. A forward end 1031 of the of the stabilizing strut 1024 includes a pad-mounting plate 1032. A support pad 1033 is mounted to the pad-mounting plate 1032.

Figure 6:
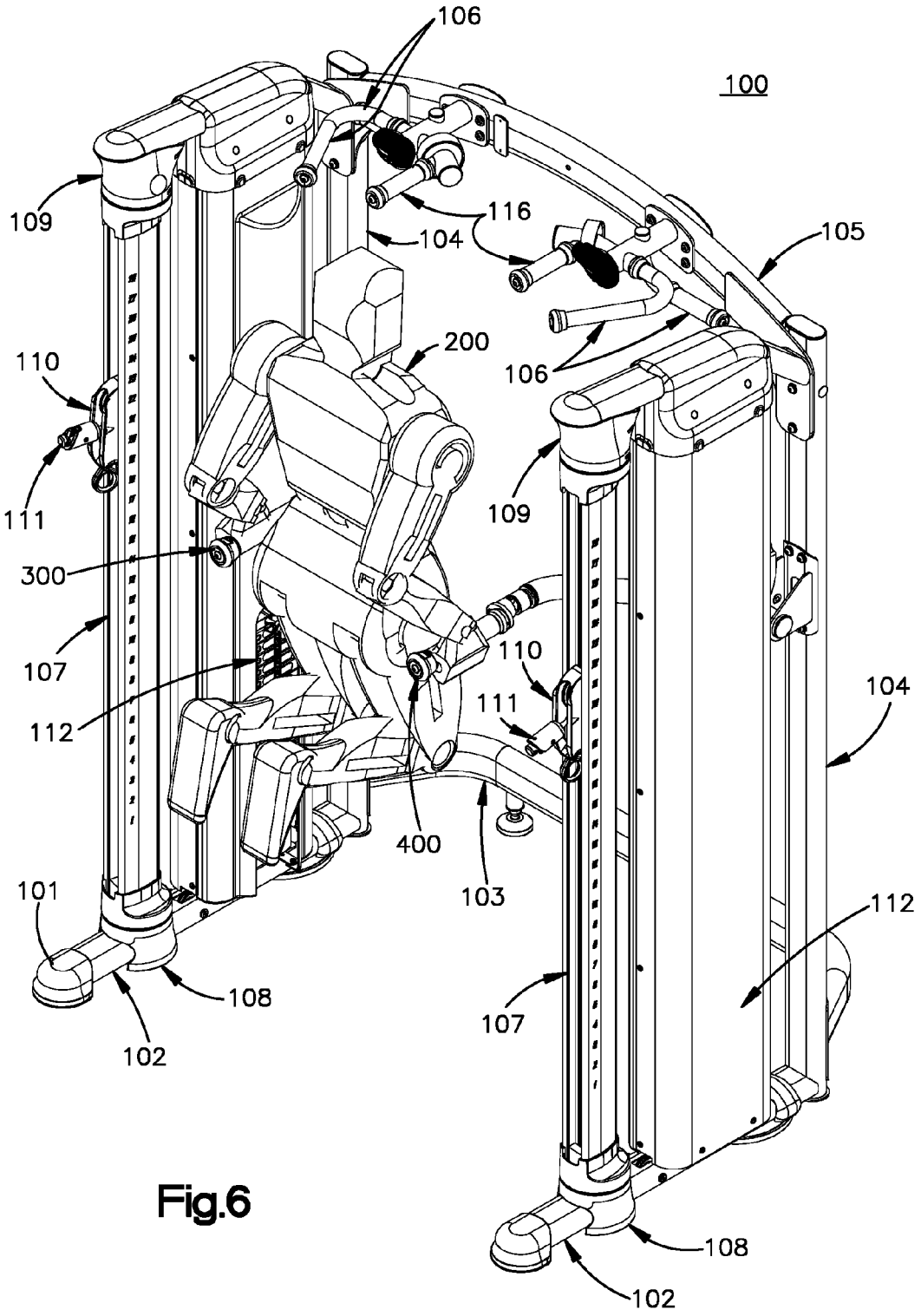
FIG. 6 is a front-right side isometric view of an exercise machine for use with the detachable stabilizing support system depicted in FIGS. 1-5.
Figure 7:
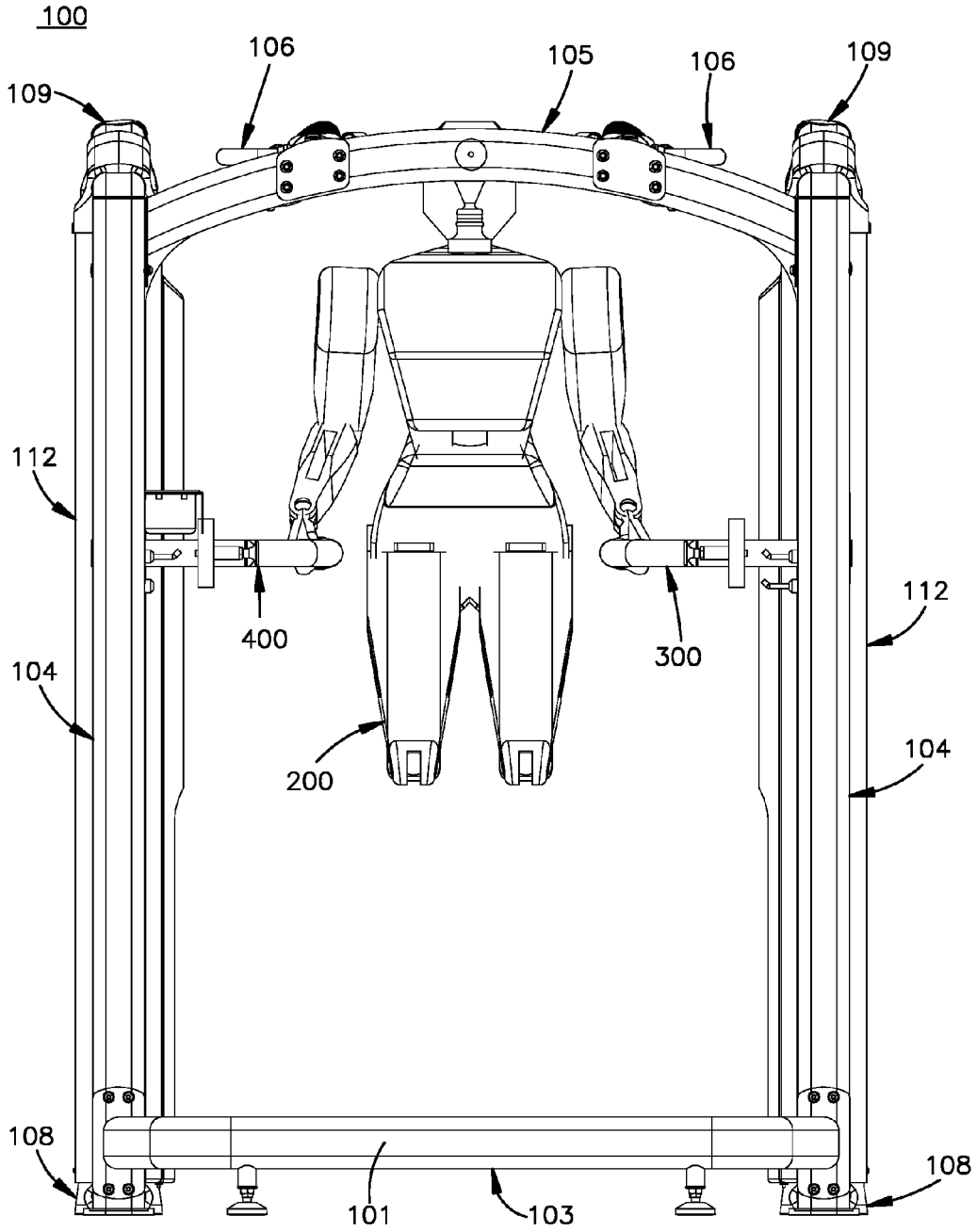
FIG. 7 is a rear side view of the exercise machine as depicted in FIG. 6.
Figure 8:
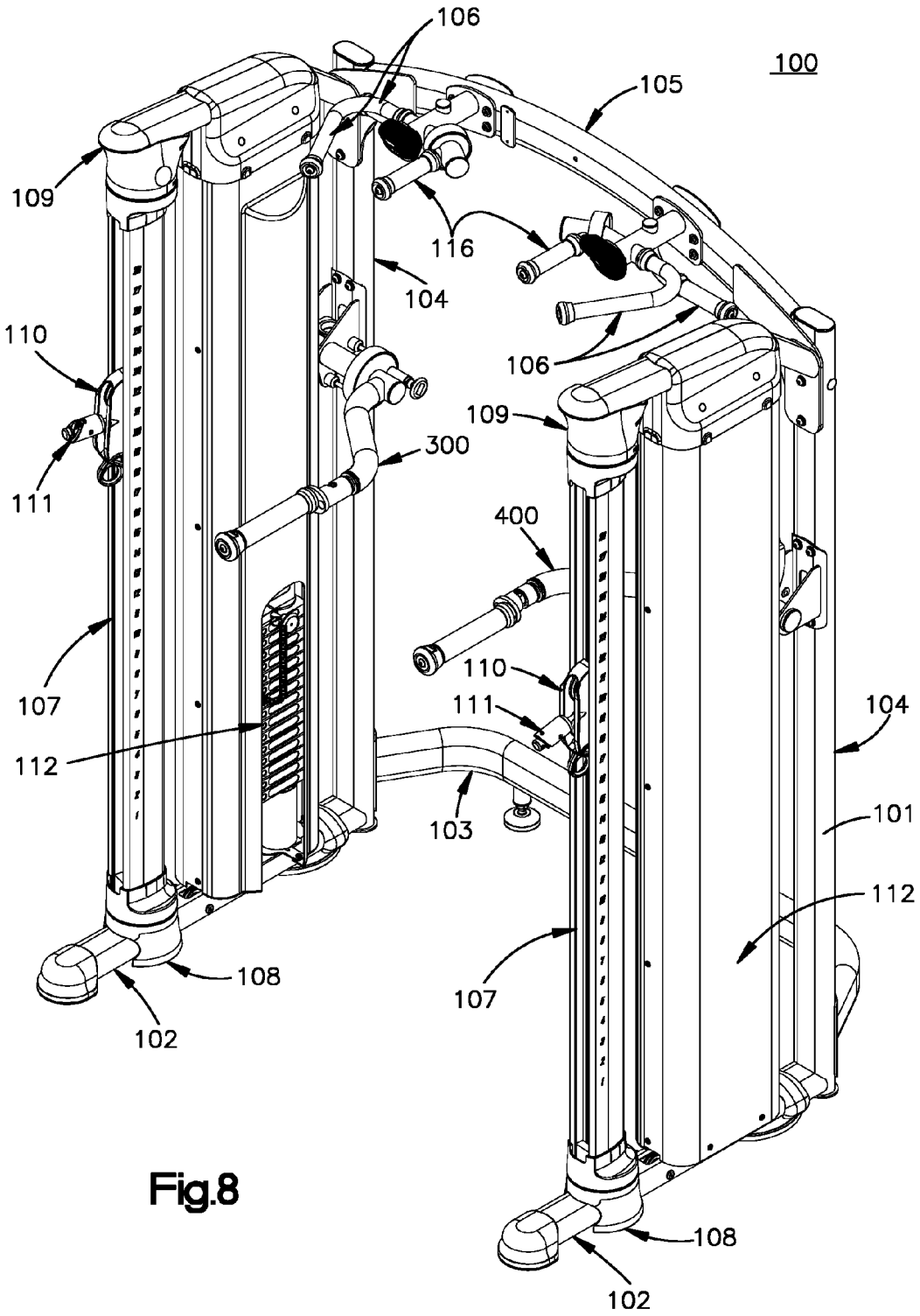
FIG. 8 is a front-right side isometric view of the exercise machine as depicted in FIG. 6, but with the exerciser omitted.
Figure 9:
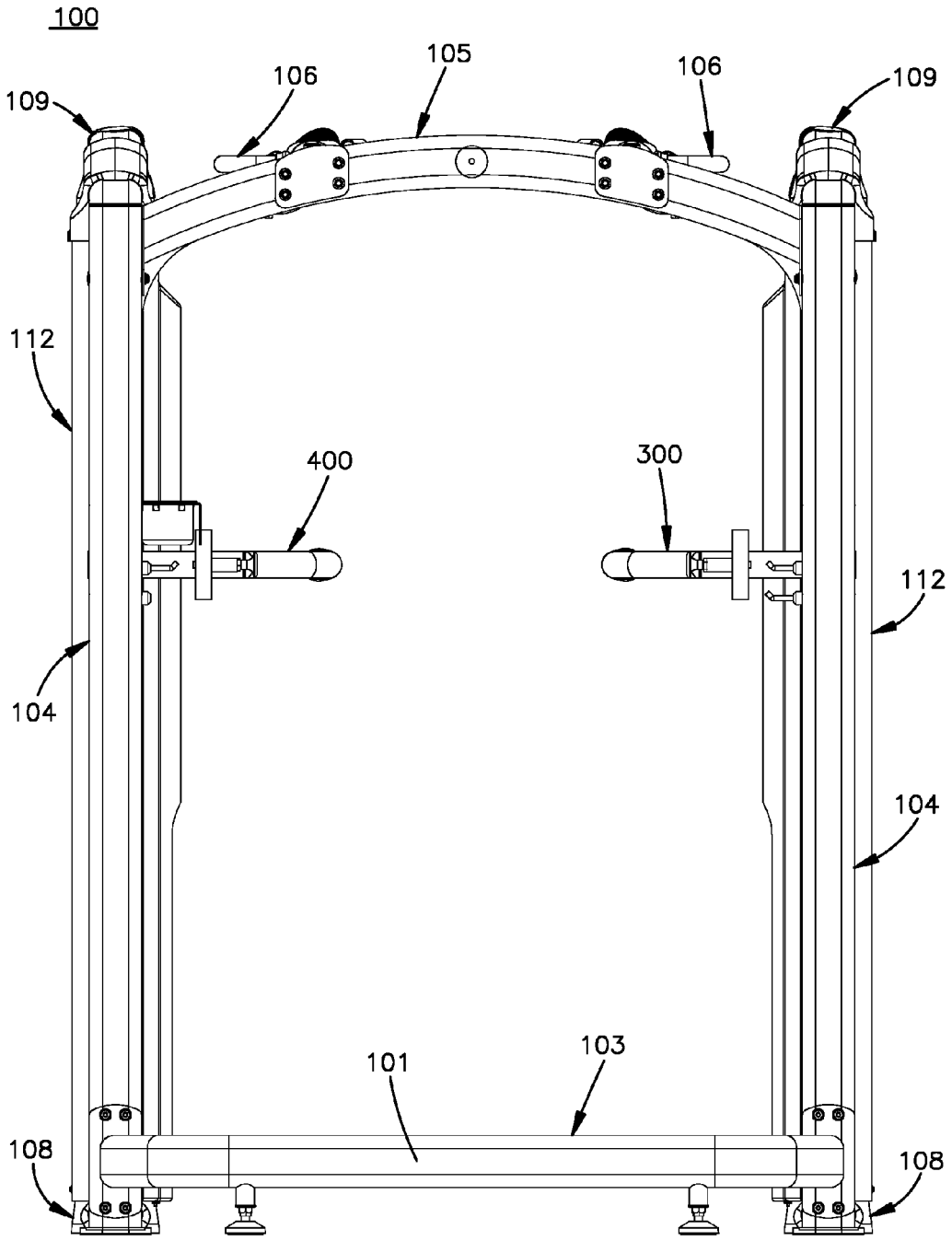
FIG. 9 is a rear side view of the exercise machine as depicted in FIG. 8.
Figure 10:
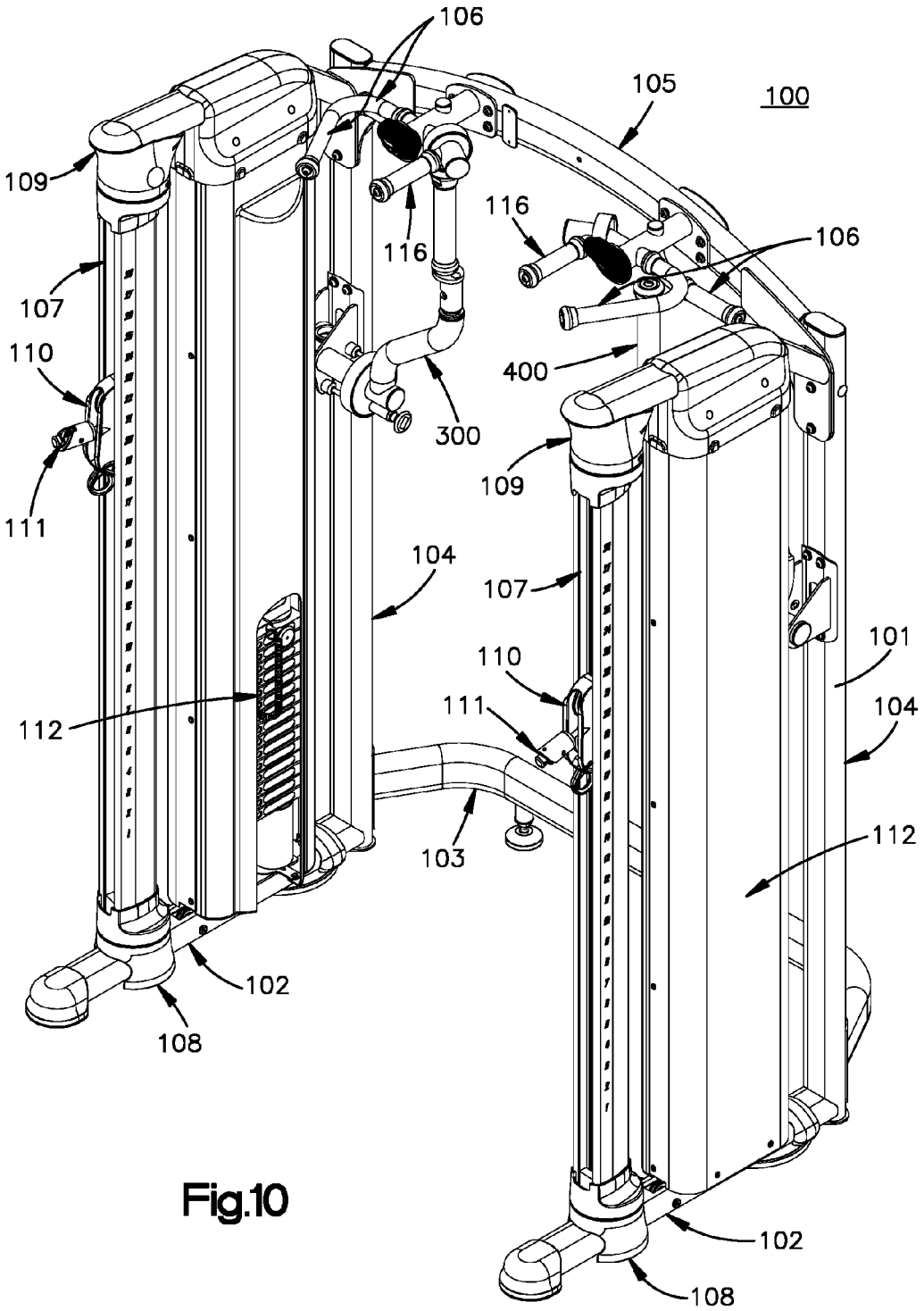
FIG. 10 is a front-right side isometric view of exercise machine as depicted in FIG. 8, but with the dip handle assemblies in the storage position.
Figure 11:
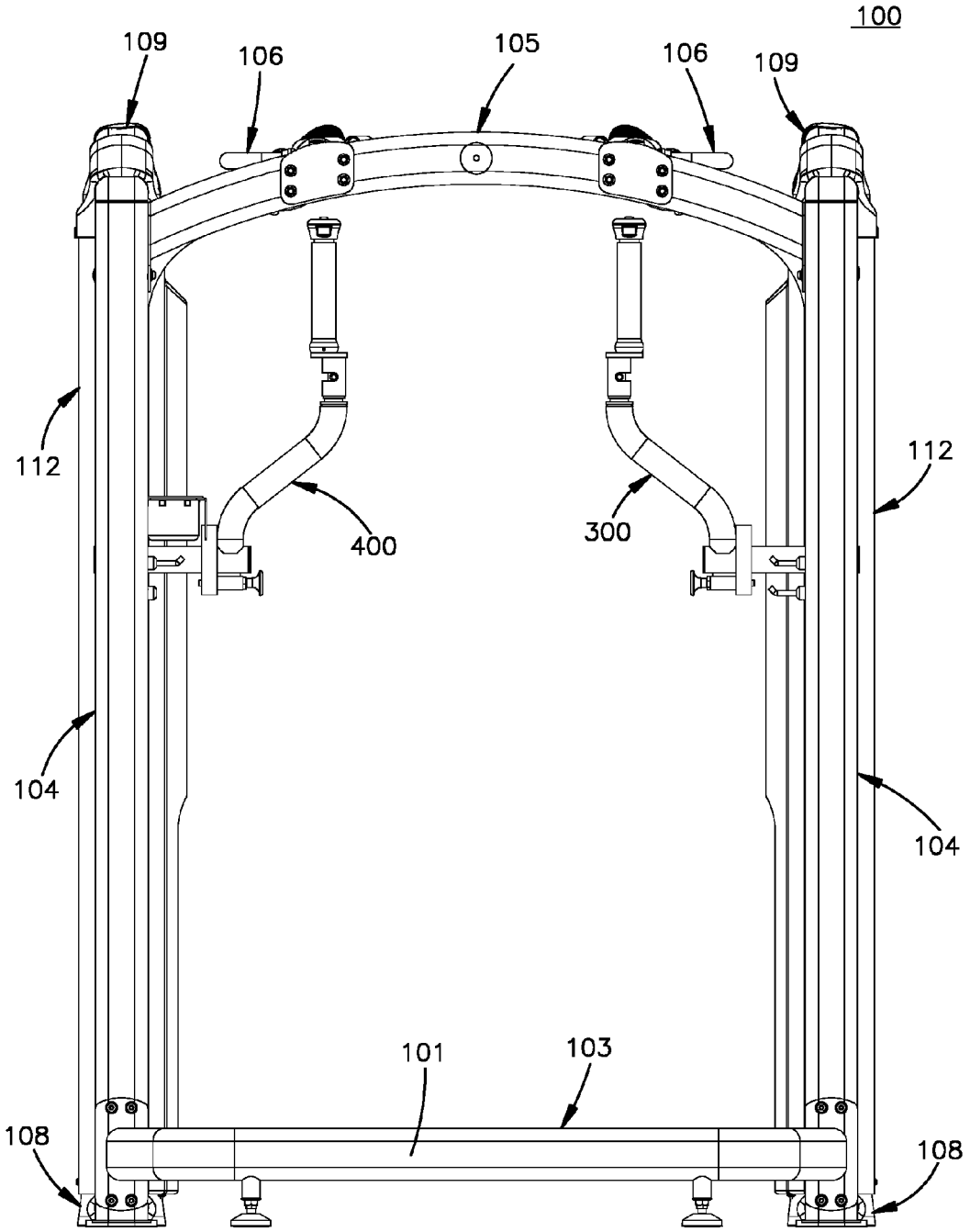
FIG. 11 is a rear side view of the exercise machine as depicted in FIG. 10.

The stabilizing support system 1000 depicted in FIGS. 1-5 can be used in connection with an exercise machine 100, an embodiment of which is shown in FIGS. 6-25. The exercise machine 100 of FIGS. 6-13 is a dual hi-lo pulley functional trainer unit. However, one of ordinary skill will appreciate that the handle system of the present invention may be adaptable to a number of different exercise machines known in the art. Thus, the present invention is not limited to the dual hi-lo pulley functional trainer unit as depicted in FIGS. 6-13. FIGS. 6 and 7 depict an exerciser 200 in position to perform a dip exercise.

As best shown in FIGS. 6-11, the exercise machine 100 of the present embodiment includes a stationary main frame 101. The main frame 101 is a fixed frame structure and includes horizontal side struts 102; a horizontal cross strut 103 connecting the horizontal side struts 102 at their front ends; support uprights 104; and a horizontal connecting strut 105 connecting the support uprights 104 at their top ends. The exercise machine 100 further includes multiple pull-up grips 106, 116 associated with the horizontal connecting strut 105 for performing pull-up or chin-up exercises. At least one pair of the pull-up grips are adjustable pull-up grips 116 that may be selectively rotated between a fore-aft orientation, wherein each adjustable pull-up grip 116 is substantially horizontal and points toward the back of the exercise machine 100 (FIGS. 1, 3, 5), and a side-to-side orientation, wherein each adjustable pull-up grip 116 is substantially horizontal and points inwardly toward the center of the exercise machine 100. The adjustable pull-up grips 116 are rotatably adjustable, similar to the adjustable hand grips 40 described in U.S. Patent Application Publication No. 2012-0329626 A1, which is herein incorporated by reference. The fore-aft orientation of the adjustable pull-up grips 116, is illustrated and described in U.S. Patent Application Publication No. 2012-0329626 A1 as position 40B. And the side-to-side orientation of the adjustable pull-up grips 116, is illustrated and described in U.S. Patent Application Publication No. 2012-0329626 A1 as position 40A.

The exercise machine 100, as depicted in FIGS. 6-11, further includes a pair of vertical columns 107. Each of the vertical columns 107 are rotatably mounted between an upper pivot mount 109 and a lower pivot mount 108 that is connected to the horizontal side strut 102. Thus, each of the vertical columns 107 is rotatable about its longitudinal axis. A pulley carriage 110 is mounted on each of the vertical columns 107 and may be vertically adjusted up and down, along the length of the respective vertical column 107.

The exercise machine 100 further includes a source of resistance, which in the case of the embodiment depicted in FIGS. 6-11 is a pair of selectorized weight stacks 112. One of ordinary skill in the art will appreciate, however, that the source of resistance may include, without limitation, a weight stack, weight plates mounted on pegs, or other types of resistance such as hydraulic, pneumatic, electromagnetic, friction, springs, elastically bending rods, elastic bands, or the like. A cable and pulley system (not shown) includes a cable attached at one end to the selectorized weight stack 112 and an opposite pull end 111. The pull end 111 of the cable passes through the pulley carriage 110, such that when the pulley carriage 110 is adjusted up or down, the pull end 111 of the cable also moves up or down. The pull ends 111, of exercise machine 100, may be connected to various exercise attachments for performing exercises.

An exerciser may perform an exercise by pulling or pushing one or both pull ends 111 away from the respective pulley carriage 110. Because the vertical columns 107 are rotatable, and the pulley carriage 110 is vertically adjustable, the path of exercise motion and direction of exercise resistance is highly adjustable. When the exerciser performs an exercise by pulling or pushing a pull end 111 away from its respective pulley carriage 110, the cable travels through the cable and pulley system and lifts the amount of weight selected within the selectorized weight stack 112.

Figure 12:
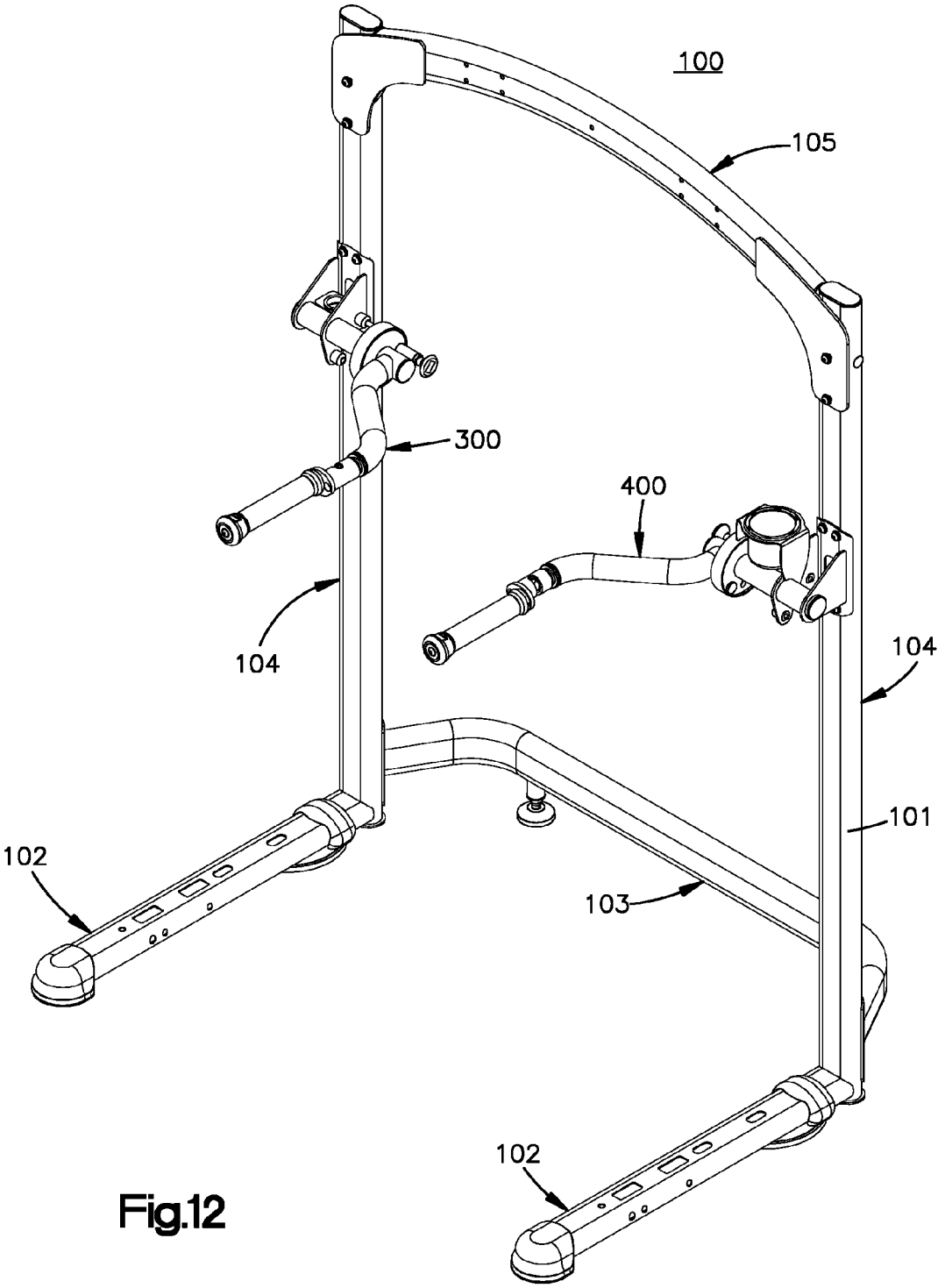
FIG. 12 is a front-right side isometric view of the exercise machine as depicted in FIG. 8, but with many parts of the exercise machine omitted to more clearly show the flip and dip handle system.
Figure 13:
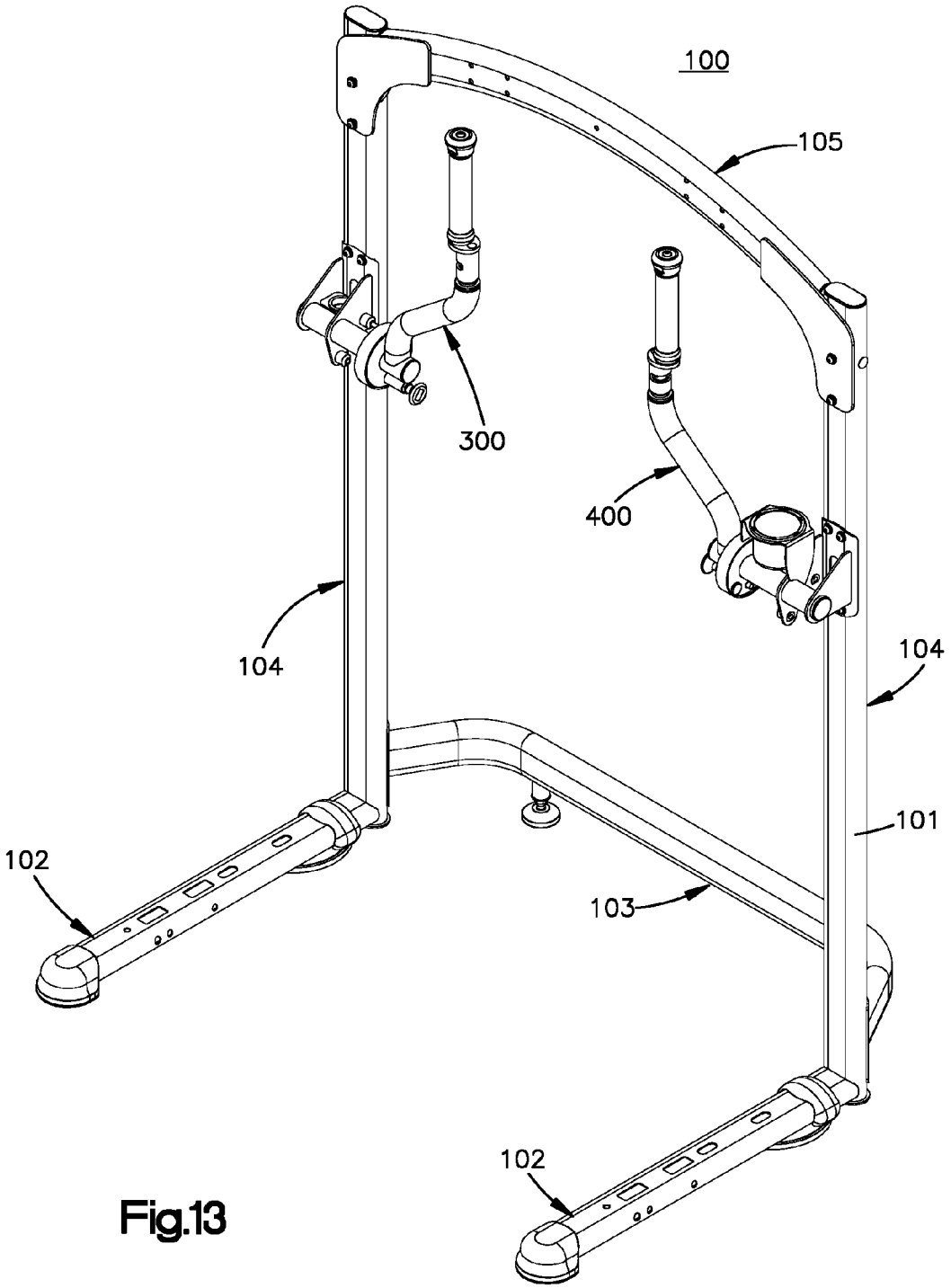
FIG. 13 is a front-right side isometric view of the exercise machine as depicted in FIG. 10, but with many parts of the exercise machine omitted to more clearly show the flip and dip handle system.

As best illustrated in FIGS. 12 and 13, the exercise machine 100 of the illustrated embodiment further includes a left dip handle assembly 300 and a right dip handle assembly 400, each mounted on a support upright 104 of the main frame 101. The left dip handle assembly 300, including all of its components, is shown with more detail in FIG. 14. The left dip handle assembly 300 includes a mounting bracket 301 that attaches the left dip handle assembly 300 to the left support upright 104. According to the depicted embodiment, fasteners 302, such as bolts, screws, nuts, washers, and/or rivets attach the mounting bracket 301 to the left support upright 104. However, one of ordinary skill in the art will appreciate that the mounting bracket 301 may be attached through other means known in the art, including without limitation, through welding, adhesives, pins, hooks, or other mechanical interfaces and attaching methods known in the art. The method of attaching may allow the mounting bracket 301 to be adjusted vertically along support upright 104, or mounted on support upright 104 at a selected height, so that the height of the left dip handle assembly 300 can be selectively adjusted.

Figure 14:
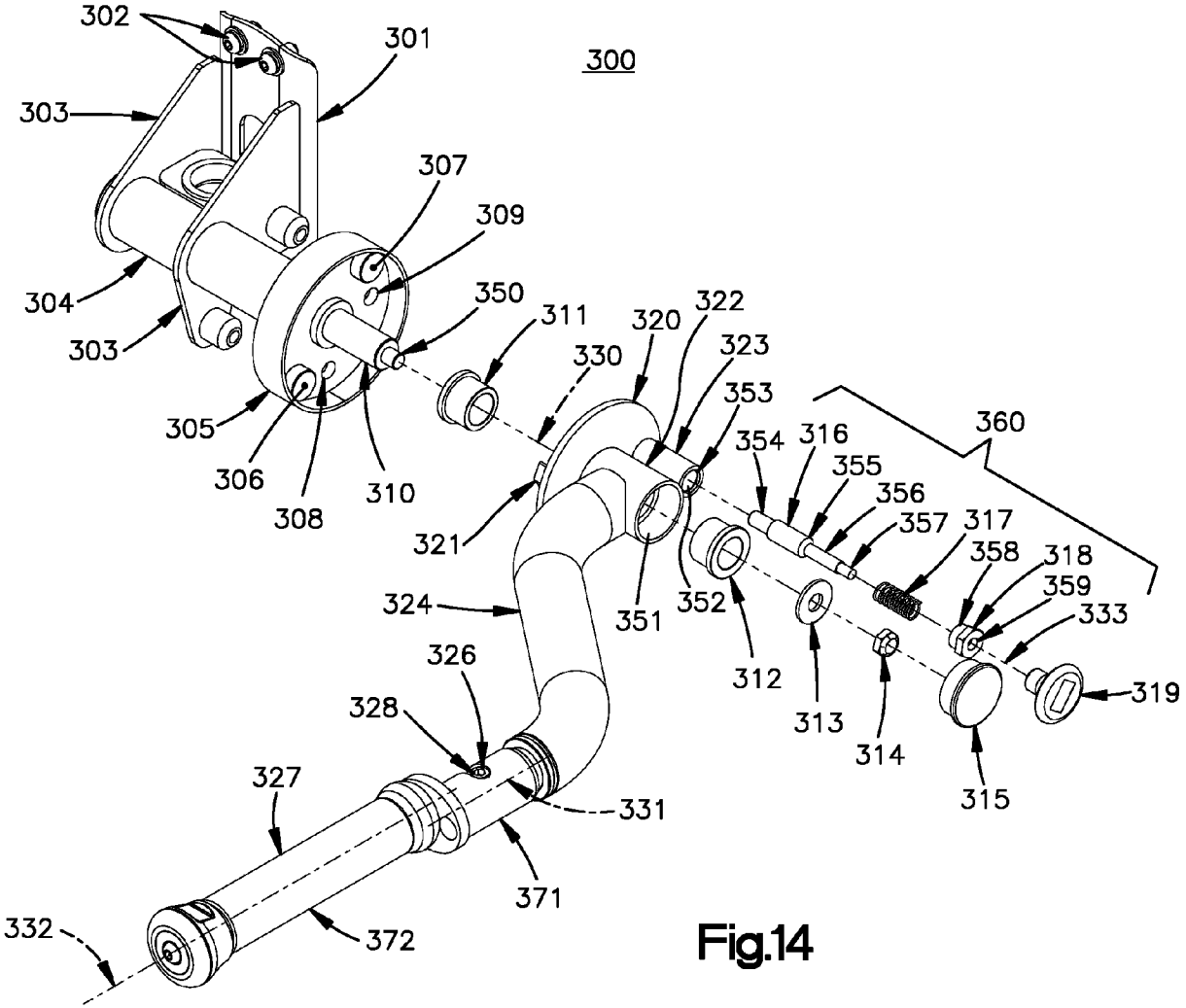
FIG. 14 is an exploded view of a left dip handle assembly of a flip and dip handle system.

Referring still to FIG. 14, the left dip handle assembly 300 further includes a pair of reinforcing ribs 303 connected to the mounting bracket 301 and a support rod 304 connected to the reinforcing ribs 303. The support rod 304 is connected to and supports an arm mount hub 305. The arm mount hub 305, according to the depicted embodiment, is a round housing that includes an exercise position stop lug 306 and a storage position stop lug 307. The arm mount hub 305 further includes an exercise position lock hole 309 and a storage position lock hole 308. A pivot shaft 310 extends from the center of the arm mount hub 305. The pivot shaft 310 of the depicted embodiment is 1 inch in diameter and includes a threaded end 350 for retaining a bearing housing 322 on the pivot shaft 310. The threaded end 350 includes ½-13 UNC male threads. However, one of ordinary skill in the art will appreciate that the bearing housing 322 may be retained on the pivot shaft 310 through other means known in the art, including without limitation, cotter pins, e-clips or c-clips, pressed retainers or fittings, male or female threads, and other methods known in the art.

The bearing housing 322 is rotatably mounted on the pivot shaft 310 for rotation about pivot axis 330. The pivot shaft 310 is inserted through an inner bearing 311, a bearing bore 351 in the bearing housing 322, and an outer bearing 312. Thus, the bearing housing 322 rides on the inner and outer bearings 311, 312. The inner and outer bearings 311, 312 are preferably made from a low-friction material that will not increase the rotating friction between the bearing housing 322 and the pivot shaft 310, allowing the bearing housing 322 to freely rotate about pivot axis 330. The inner and outer bearings 311, 312 are also preferably made from a material that is softer than that of the pivot shaft 310 and the bearing housing 322, such that any wear resulting from rotation of the bearing housing 322 occurs on the inner and outer bearings 311, 312, which are easier and less expensive to replace as wear or maintenance items. As non-limiting examples, the inner and outer bearings 311, 312 may be made from aluminum, brass or bronze, thermoplastics such as nylon, or they may include a Teflon coating.

According to the embodiment of FIG. 14, a washer 313 and a locknut 314 threaded onto the threaded end 350 of the pivot shaft 310 retain the bearing housing 322 on the pivot shaft 310. The washer 313 is a ½" USS flat washer, while the locknut 314 is a ½-13 UNC locknut. As discussed above, however, the bearing housing 322 may be retained on the pivot shaft 310 through other means known in the art. An end cap 315 is inserted into the bearing bore 351 of bearing housing 322.

As further illustrated in FIG. 14, the bearing housing 322 is connected to a stop plate 320, which includes a stop feature 321. The stop feature 321 engages the respective exercise position stop lug 306 and storage position stop lug 307, when the bearing housing 322 rotates about pivot axis 330 between the exercise position and the storage position, as described in more detail below.

A pull-pin barrel 323 is connected to stop plate 320 and the bearing housing 322. The pull-pin barrel 323 includes a pull-pin bore 352 with a female-threaded opening 353. A spring-loaded pull pin 360 is assembled into the pull-pin bore 352 of the pull-pin barrel 323. The spring-loaded pull pin 360 includes a pull-pin plunger 316 that has a first end 354 for selectively engaging the respective exercise position lock hole 309 or the storage position lock hole 308, to lock the left dip handle assembly 300 into either the exercise position or storage position, as described in more detail below. The pull-pin plunger 316 also includes a first intermediate section 355, which provides a clearance fit with the pull-pin bore 352 of the pull-pin barrel 323 and allows the spring-loaded pull pin 360 to slide along axis 333 within the pull-pin bore 352. The pull-pin plunger 316 further includes a second intermediate section 356, smaller in diameter than the first intermediate section 355, on which a spring 317 is mounted. And the pull-pin plunger 316 includes a threaded end 357 with male threads.

As illustrated in FIG. 14, the pull-pin plunger 316 of the spring-loaded pull pin 360 is inserted into the pull-pin bore 352 of the pull-pin barrel 323, with the spring 317 mounted onto the second intermediate section 356. A barrel cap 318 retains the pull-pin plunger 316 and spring 317 within the pull-pin bore 352 of the pull-pin barrel 323. The barrel cap 318 includes male threads 358 that engage the female-threaded opening 353 of the pull-pin barrel 323. Thus, the barrel cap 318 screws into the pull-pin bore 352 of the pull-pin barrel 323, retaining the pull-pin plunger 316 and spring 317 within the pull-pin bore 352. The barrel cap 318 includes a hole 359 through which the second intermediate section 356 of the pull-pin plunger 316 is inserted. The second intermediate section 356 of the pull-pin plunger 316 has a clearance fit with the hole 359, which allows the pull-pin plunger 316 to slide along axis 333. A threaded knob 319 is threaded onto the threaded end 357 of the pull-pin plunger 316.

As mentioned above, the spring 317 is mounted on the second intermediate section 356 of the pull-pin plunger 316. After the barrel cap 318 is screwed into the female-threaded opening 353, the spring 317 is compressed between the larger diameter first intermediate section 355 and the barrel cap 318. Because the barrel cap 318 is fixed to the pull-pin barrel 323, while the pull-pin plunger 316 is slidable along axis 333, the spring 317 biases the pull-pin plunger 316 toward the arm mount hub 305. Accordingly, the spring 317 biases the first end 354 of the pull-pin plunger 316 into the exercise position lock hole 309 when the left dip handle assembly 300 is in the exercise position, or into the storage position lock hole 308 when the left dip handle assembly 300 is in the storage position.

As further shown in FIG. 14, an exercise arm 324 extends from the bearing housing 322. The end of the exercise arm 324 opposite the bearing housing 322 has a longitudinal axis 331 and a stop feature 326. An adjustable dip handle 327 is mounted on the exercise arm 324. The adjustable dip handle 327 includes a mounting portion 371 and a grip portion 372. The mounting portion 371 is rotatably mounted on the exercise arm 324 such that it its longitudinal axis is coincident with the longitudinal axis 331 of the end of the exercise arm 324, and such that the adjustable dip handle 327 may rotate about longitudinal axis 331. The mounting portion 371 includes a slot 328 that extends at least approximately 180° around the circumference of the mounting portion 371. The stop feature 326 of the exercise arm 324 is located within the slot 328, and is configured to limit the adjustable dip handle's 327 rotation about longitudinal axis 331 by engaging the ends of the slot 328 to provide wide (FIGS. 6, 8, 12, 14) and narrow grip positions for the adjustable dip handle 327.

The grip portion 372 of the adjustable dip handle 327 has a second longitudinal axis 332 that is not coincident with longitudinal axis 331. Thus, the adjustable handle 327 can be rotated at least approximately 180° about longitudinal axis 331, in which case the grip portion 372 rotates in an arcuate path about longitudinal axis 331 between the wide and narrow grip positions. The adjustable dip handle 327 is similar to the dip bar handles 60 described in U.S. Patent Application Publication No. 2012-0329626 A1, which is herein incorporated by reference.

As best illustrated in FIGS. 12 and 13, the exercise machine 100 of the illustrated embodiment further includes a similar right dip handle assembly 400 mounted on a support upright 104 of the main frame 101. The right dip handle assembly 400, including all of its components, is shown with more detail in FIG. 15. The right dip handle assembly 400 includes a mounting bracket 401 that attaches the right dip handle assembly 400 to the right support upright 104. According to the depicted embodiment, fasteners 402, such as bolts, screws, nuts, washers, and/or rivets attach the mounting bracket 401 to the support upright 104. However, as discussed above with respect to the fasteners 302, one of ordinary skill in the art will appreciate that the mounting bracket 401 may be attached through other means known in the art. The method of attaching may allow the mounting bracket 401 to be adjusted vertically along support upright 104, or mounted on support upright 104 at a selected height, so that the height of the right dip handle assembly 400 can be selectively adjusted.

Figure 15:
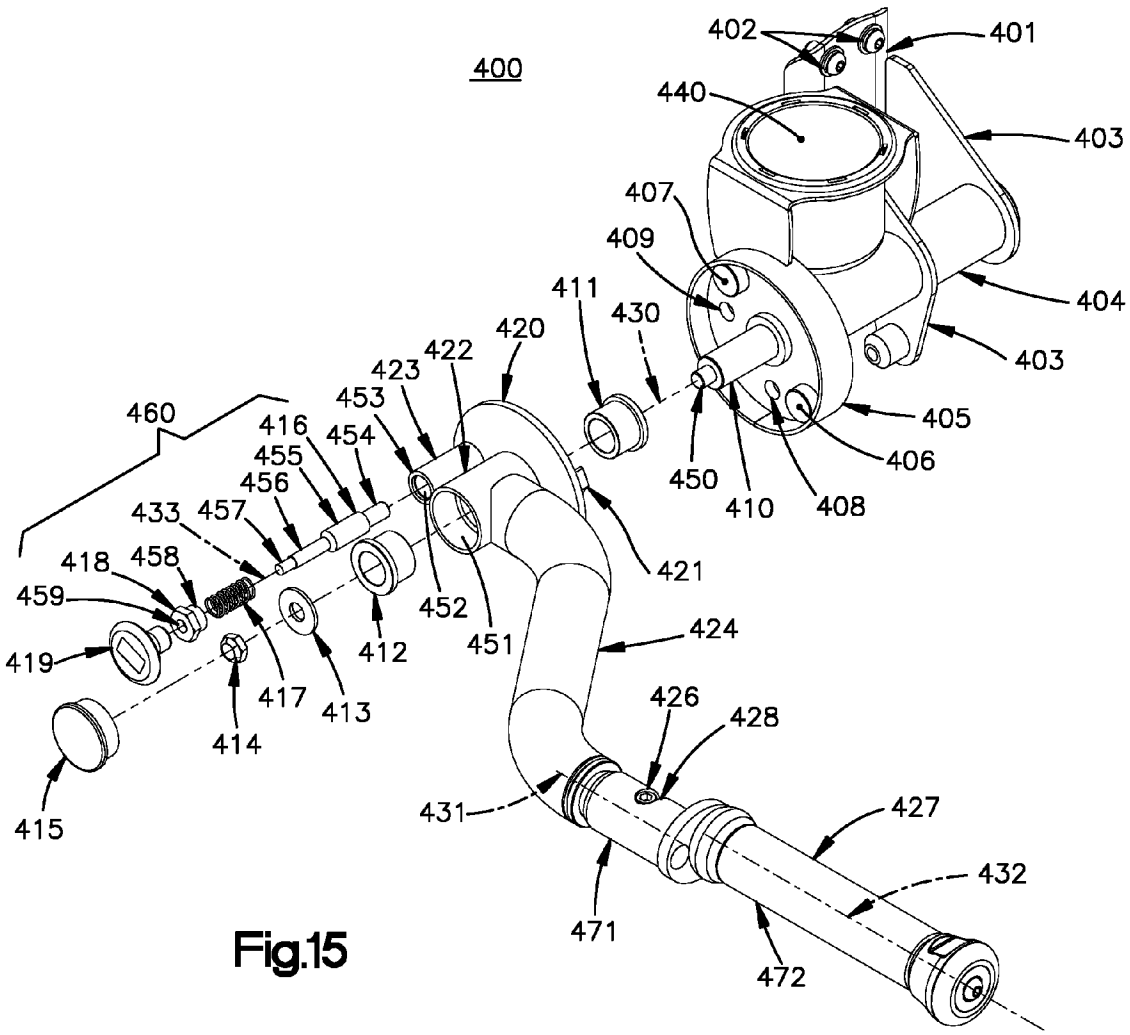
FIG. 15 is an exploded view of a right dip handle assembly of a flip and dip handle system.

Referring still to FIG. 15, the right dip handle assembly 400 further includes a pair of reinforcing ribs 403 connected to the mounting bracket 401 and a support rod 404 connected to the reinforcing ribs 403. The support rod 404 is connected to and supports an arm mount hub 405. The right dip handle assembly 400 depicted in FIG. 15 further includes a drink holder 440 mounted to one or more of the mounting bracket 401, reinforcing ribs 403, support rod 404, and arm mount hub 405. One skilled in the art will appreciate that the drink holder 440 may optionally be included on the left dip handle assembly 300, if preferred.

The arm mount hub 405, according to the depicted embodiment, is a round housing that includes an exercise position stop lug 406 and a storage position stop lug 407. The arm mount hub 405 further includes an exercise position lock hole 409 and a storage position lock hole 408. A pivot shaft 410 extends from the center of the arm mount hub 405. The pivot shaft 410 of the depicted embodiment is 1 inch in diameter and includes a threaded end 450 for retaining a bearing housing 422 on the pivot shaft 410. The threaded end 450 includes ½-13 UNC male threads. However, as discussed above with respect to the left dip handle assembly's 300 bearing housing 322, one of ordinary skill in the art will appreciate that the bearing housing 422 may be retained on the pivot shaft 410 through other means known in the art.

The bearing housing 422 is rotatably mounted on the pivot shaft 410 for rotation about pivot axis 430. The pivot shaft 410 is inserted through an inner bearing 411, a bearing bore 451 in the bearing housing 422, and an outer bearing 412. Thus, the bearing housing 422 rides on the inner and outer bearings 411, 412. The inner and outer bearings 411, 412 (like inner and outer bearings 311, 312) are preferably made from a low-friction material that will not increase the rotating friction between the bearing housing 422 and the pivot shaft 410, allowing the bearing housing 422 to freely rotate about pivot axis 430. The inner and outer bearings 411, 412 are also preferably made from a material that is softer than that of the pivot shaft 410 and the bearing housing 422, such that any wear resulting from rotation of the bearing housing 422 occurs on the inner and outer bearings 411, 412, which are easier and less expensive to replace as wear or maintenance items. As non-limiting examples, the inner and outer bearings 411, 412 may be made from aluminum, brass or bronze, thermoplastics such as nylon, or they may include a Teflon coating.

According to the embodiment of FIG. 15, a washer 413 and a locknut 414 threaded onto the threaded end 450 of the pivot shaft 410 retain the bearing housing 422 on the pivot shaft 410. The washer 413 is a ½" USS flat washer, while the locknut 414 is a ½-13 UNC locknut. As discussed above, however, the bearing housing 422 may be retained on the pivot shaft 410 through other means known in the art. An end cap 415 is inserted into the bearing bore 451 of bearing housing 422.

As further illustrated in FIG. 15, the bearing housing 422 is connected to a stop plate 420, which includes a stop feature 421. The stop feature 421 engages the respective exercise position stop lug 406 and storage position stop lug 407, when the bearing housing 422 rotates about pivot axis 430 between the exercise position and the storage position, as described in more detail below.

A pull-pin barrel 423 is connected to stop plate 420 and the bearing housing 422. The pull-pin barrel 423 includes a pull-pin bore 452 with a female-threaded opening 453. A spring-loaded pull pin 460 is assembled into the pull-pin bore 452 of the pull-pin barrel 423. The spring-loaded pull pin 460 includes a pull-pin plunger 416 that has a first end 454 for selectively engaging the respective exercise position lock hole 409 or the storage position lock hole 408, to lock the right dip handle assembly 400 into either the exercise position or storage position, as described in more detail below. The pull-pin plunger 416 also includes a first intermediate section 455, which provides a clearance fit with the pull-pin bore 452 of the pull-pin barrel 423 and allows the spring-loaded pull pin 460 to slide along axis 433 within the pull-pin bore 452. The pull-pin plunger 416 further includes a second intermediate section 456, smaller in diameter than the first intermediate section 455, on which a spring 417 is mounted. And the pull-pin plunger 416 includes a threaded end 457 with male threads.

As illustrated in FIG. 15, the pull-pin plunger 416 of the spring-loaded pull pin 460 is inserted into the pull-pin bore 452 of the pull-pin barrel 423, with the spring 417 mounted onto the second intermediate section 456. A barrel cap 418 retains the pull-pin plunger 416 and spring 417 within the pull-pin bore 452 of the pull-pin barrel 423. The barrel cap 418 includes male threads 458 that engage the female-threaded opening 453 of the pull-pin barrel 423. Thus, the barrel cap 418 screws into the pull-pin bore 452 of the pull-pin barrel 423, retaining the pull-pin plunger 416 and spring 417 within the pull-pin bore 452. The barrel cap 418 includes a hole 459 through which the second intermediate section 456 of the pull-pin plunger 416 is inserted. The second intermediate section 456 of the pull-pin plunger 416 has a clearance fit with the hole 459, which allows the pull-pin plunger 416 to slide along axis 433. A threaded knob 419 is threaded onto the threaded end 457 of the pull-pin plunger 416.

As mentioned above, the spring 417 is mounted on the second intermediate section 456 of the pull-pin plunger 416. After the barrel cap 418 is screwed into the female-threaded opening 453, the spring 417 is compressed between the larger diameter first intermediate section 455 and the barrel cap 418. Because the barrel cap 418 is fixed to the pull-pin barrel 423, while the pull-pin plunger 416 is slidable along axis 433, the spring 417 biases the pull-pin plunger 416 toward the arm mount hub 405. Accordingly, the spring 417 biases the first end 454 of the pull-pin plunger 416 into the exercise position lock hole 409 when the right dip handle assembly 400 is in the exercise position, or into the storage position lock hole 408 when the right dip handle assembly 400 is in the storage position.

As further shown in FIG. 15, an exercise arm 424 extends from the bearing housing 422. The end of the exercise arm 424 opposite the bearing housing 422 has a longitudinal axis 431 and a stop feature 426. An adjustable dip handle 427 is mounted on the exercise arm 424. The adjustable dip handle 427 includes a mounting portion 471 and a grip portion 472. The mounting portion 471 is rotatably mounted on the exercise arm 424 such that it its longitudinal axis is coincident with the longitudinal axis 431 of the end of the exercise arm 424, and such that the adjustable dip handle 427 may rotate about longitudinal axis 431. The mounting portion 471 includes a slot 428 that extends at least approximately 180° around the circumference of the mounting portion 471. The stop feature 426 of the exercise arm 424 is located within the slot 428, and is configured to limit the adjustable dip handle's 427 rotation about longitudinal axis 431 by engaging the ends of the slot 428 to provide wide (FIGS. 6, 8, 12, 15) and narrow grip positions for the adjustable dip handle 427.

The grip portion 472 of the adjustable dip handle 427 has a second longitudinal axis 432 that is not coincident with longitudinal axis 431. Thus, the adjustable handle 427 can be rotated at least approximately 180° about longitudinal axis 431, in which case the grip portion 472 rotates in an arcuate path about longitudinal axis 431 between the wide and narrow grip positions. The adjustable dip handle 427 is similar to the dip bar handles 60 described in U.S. Patent Application Publication No. 2012-0329626 A1, which is herein incorporated by reference.

The operation and use of the right dip handle assembly 400 will now be described with reference to FIGS. 16-25. It is to be understood that the operation and use of the left dip handle assembly 300 is an identical mirror image of that of the right dip handle assembly 400.

Figure 18:
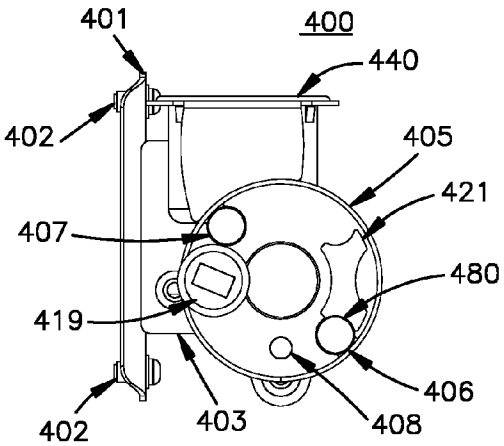
FIG. 18 is a left side view of the right dip handle assembly as depicted in FIG. 17, but with some parts omitted to more clearly show the engagement of the stop feature with the exercise position stop lug when the dip handle assembly is in the exercise position.
Figure 16:
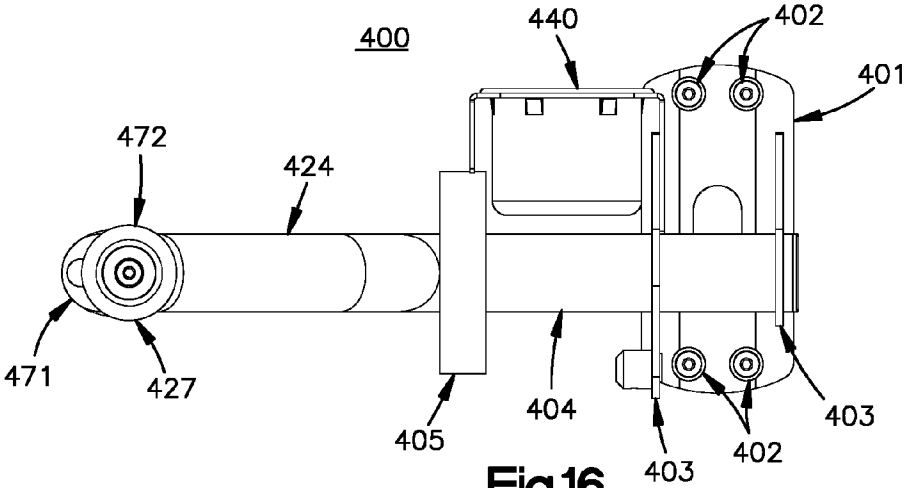
FIG. 16 is a front side view of the right dip handle assembly as depicted in FIG. 15, with the dip handle assembly in the exercise position.
Figure 17:
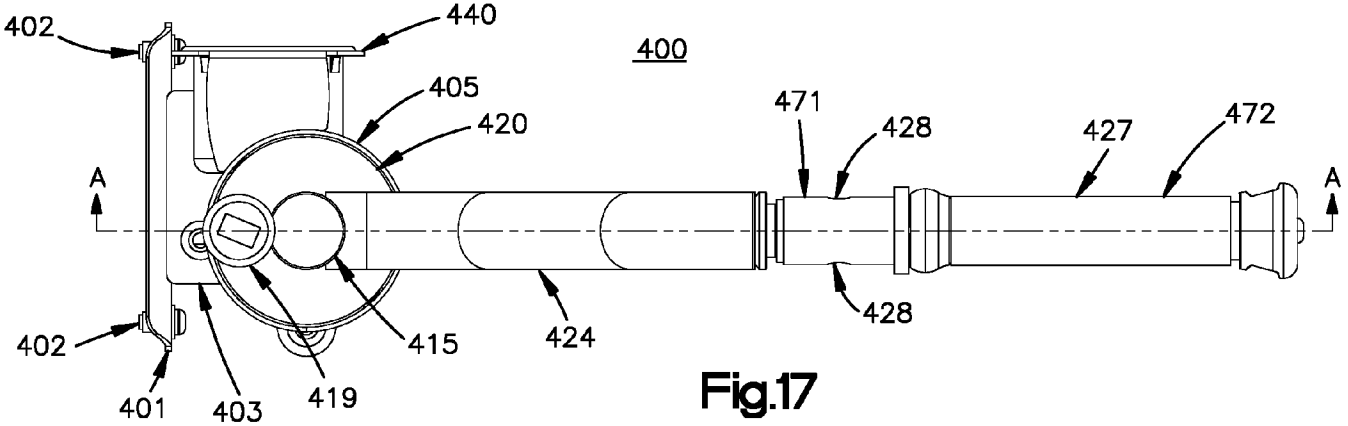
FIG. 17 is a left side view of the right dip handle assembly as depicted in FIG. 16.

FIGS. 16-20 depict the right dip handle assembly 400 in an exercise position. That is, the exercise arm 424 and adjustable dip handle 427 are rotated about pivot axis 430 so that they lie in a substantially horizontal plane. (See also FIGS. 6-10 and 12.) When the exercise arm 424 and adjustable dip handle 427 are rotated toward the exercise position, the bearing housing 422 rotates about pivot axis 430 on the pivot shaft 410. Along with the bearing housing 422, the stop plate 420 rotates about pivot axis 430 with respect to the arm mount hub 405. Accordingly, the stop feature 421 rotates about pivot axis 430 until it contacts the exercise position stop lug 406. FIG. 18 depicts the right dip handle assembly 400 in the exercise position with components omitted to illustrate the contact point 480 between the stop feature 421 and the exercise position stop lug 406.

Figure 19:
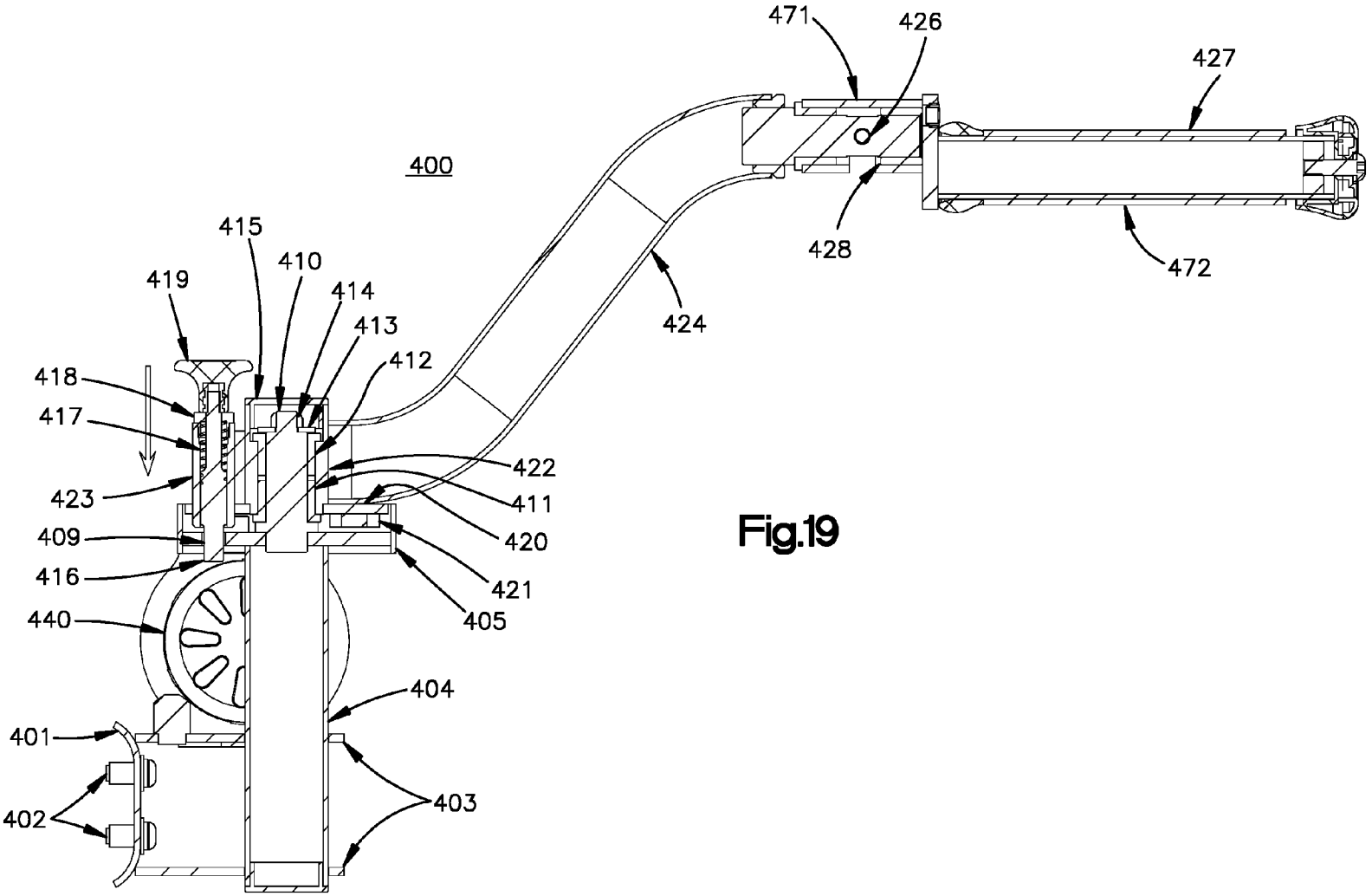
FIG. 19 is a cross-sectional view of the right dip handle assembly according to cross-section A-A depicted in FIG. 17, with the pull pin engaged to lock the dip handle assembly in the exercise position.
Figure 20:
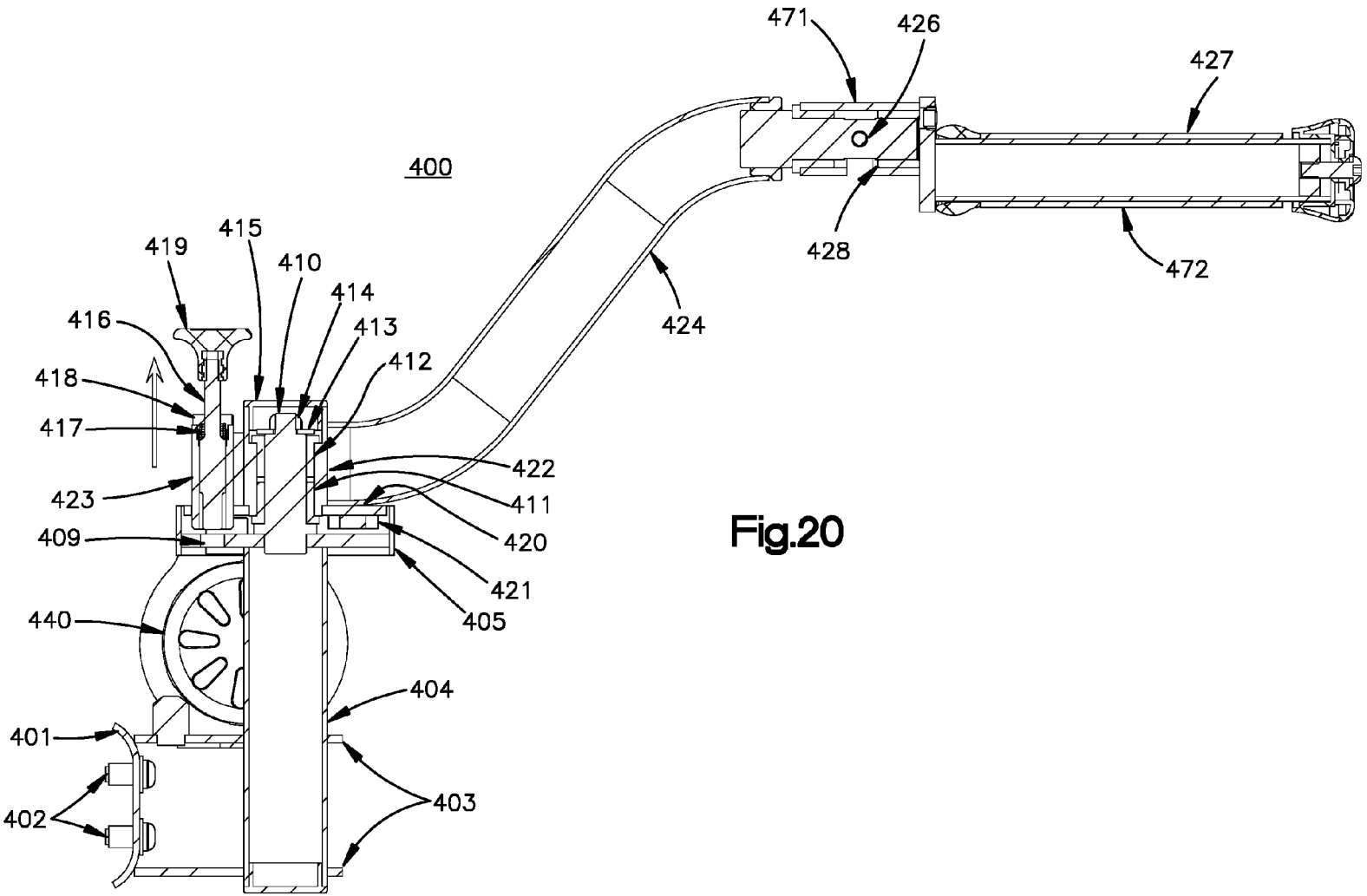
FIG. 20 is a cross-sectional view of the right dip handle assembly according to cross-section A-A depicted in FIG. 17, with the pull pin disengaged so that the dip handle assembly may be rotated away from the exercise position.

Similarly, as the bearing housing 422 rotates about pivot axis 430 toward the exercise position, the pull-pin barrel 423 and spring-loaded pull pin 460 rotate about pivot axis 430 with respect to the arm mount hub 405. Thus, the spring-loaded pull pin 460 rotates about pivot axis 430 until the first end 454 of the pull-pin plunger 416 aligns with the exercise position lock hole 409. As discussed above, the spring 417 biases the pull-pin plunger 416 toward the arm mount hub 405, which means that the pull-pin plunger 416 is biased into the exercise position lock hole 409 when the right dip handle assembly 400 is in the exercise position. FIG. 19 depicts the right dip handle assembly 400 in the exercise position with pull-pin plunger 416 inserted into the exercise position lock hole 409. The user may pull on the threaded knob 419 to overcome the biasing force of the spring 417 and withdraw the pull-pin plunger 416 from the exercise position lock hole 409, in order to rotate the right dip handle assembly 400 away from the exercise position. FIG. 20 depicts the right dip handle assembly 400 in the exercise position with the pull-pin plunger 416 withdrawn from the exercise position lock hole 409.

The right dip handle assembly 400 thus utilizes two methods of locating and positioning the right dip handle assembly 400 in the exercise position. First, the stop feature 421 contacts the exercise position stop lug 406 to locate and position the right dip handle assembly 400 in the exercise position. And second, the pull-pin plunger 416 is biased into the exercise position lock hole 409 to further locate and position the right dip handle assembly 400 in the exercise position, and to more affirmatively lock the right dip handle assembly 400 in the exercise position.

Figure 23:
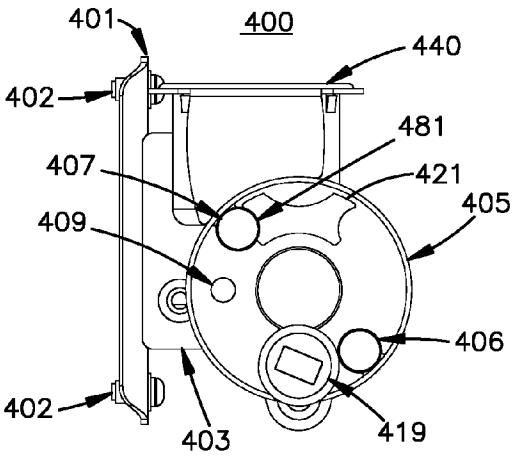
FIG. 23 is a left side view of the right dip handle assembly as depicted in FIG. 22, but with some parts omitted to more clearly show the engagement of the stop feature with the storage position stop lug when the dip handle assembly is in the storage position.
Figure 21:
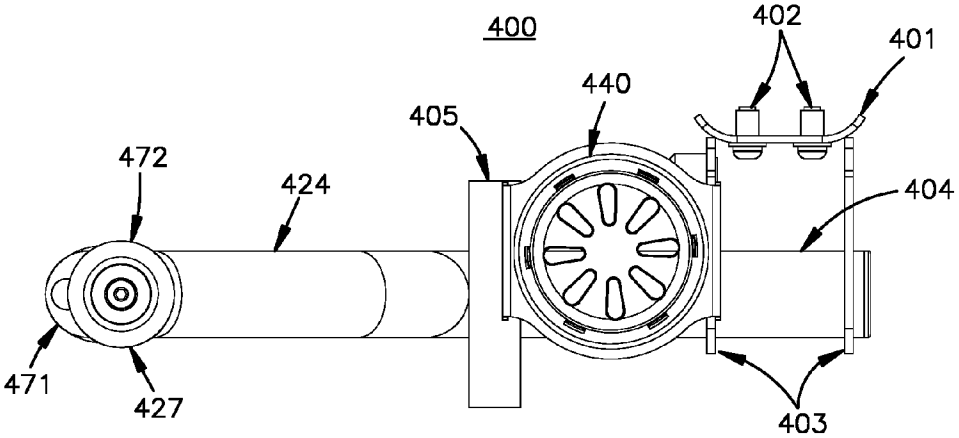
FIG. 21 is a top side view of the right dip handle assembly as depicted in FIG. 15, with the dip handle assembly in the storage position.
Figure 22:
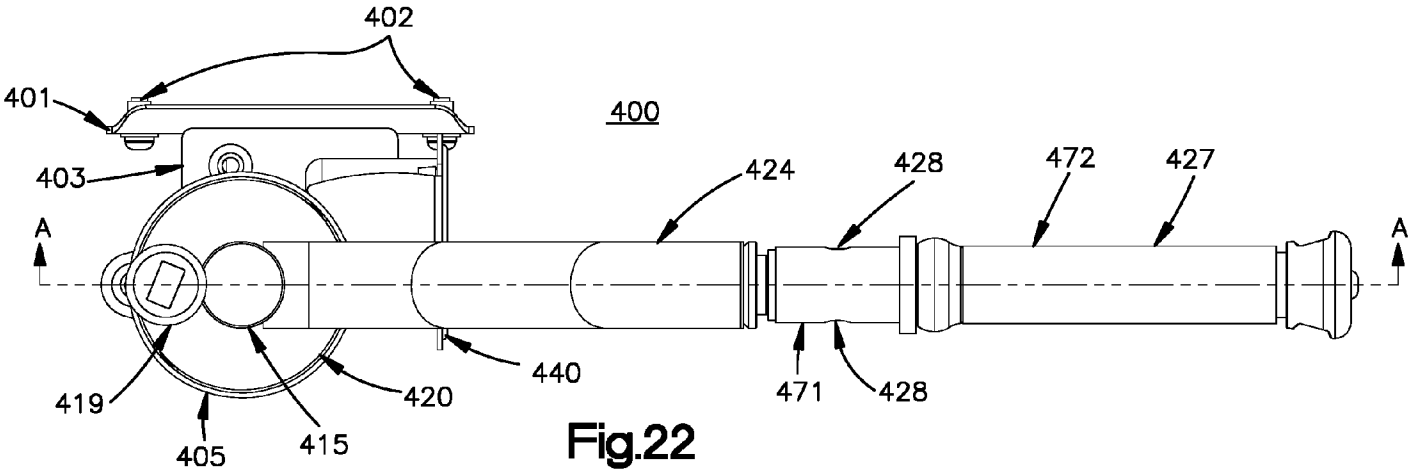
FIG. 22 is a left side view of the right dip handle assembly as depicted in FIG. 21.

In contrast with FIGS. 16-20, FIGS. 21-23 depict the right dip handle assembly 400 in a storage position. That is, the exercise arm 424 and adjustable dip handle 427 are rotated about pivot axis 430 so that they lie in a substantially vertical plane. (See also FIGS. 10-11 and 13.) When the exercise arm 424 and adjustable dip handle 427 are rotated toward the storage position, the bearing housing 422 rotates about pivot axis 430 on the pivot shaft 410. Along with the bearing housing 422, the stop plate 420 rotates about pivot axis 430 with respect to the arm mount hub 405. Accordingly, the stop feature 421 rotates about pivot axis 430 until it contacts the storage position stop lug 407. FIG. 23 depicts the right dip handle assembly 400 in the storage position with components omitted to illustrate the contact point 481 between the stop feature 421 and the storage position stop lug 407.

Figure 24:
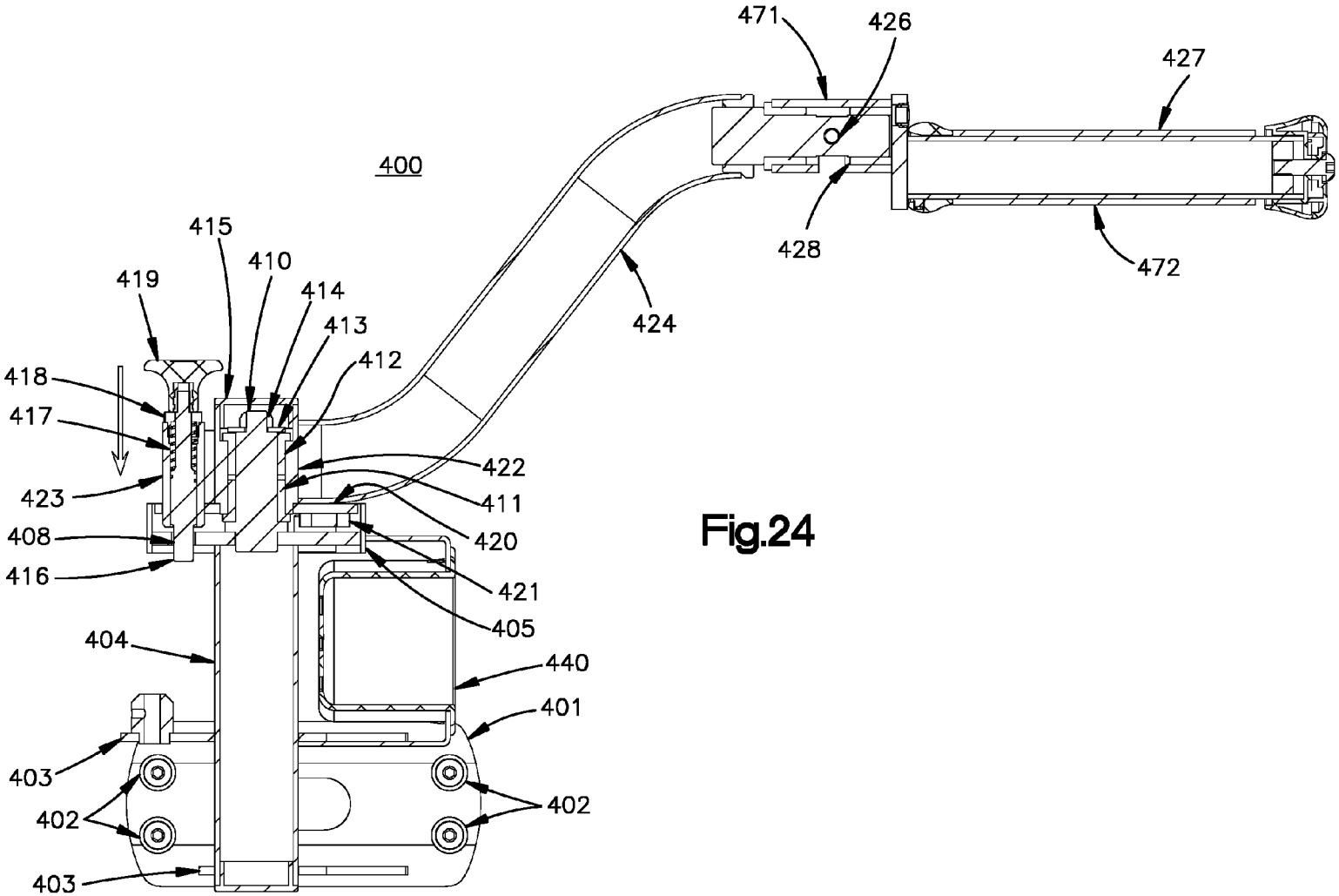
FIG. 24 is a cross-sectional view of the right dip handle assembly according to cross-section A-A depicted in FIG. 22, with the pull pin engaged to lock the dip handle assembly in the storage position.

Similarly, as the bearing housing 422 rotates about pivot axis 430 toward the storage position, the pull-pin barrel 423 and spring-loaded pull pin 460 rotate about pivot axis 430 with respect to the arm mount hub 405. Thus, the spring-loaded pull pin 460 rotates about pivot axis 430 until the first end 454 of the pull-pin plunger 416 aligns with the storage position lock hole 408. As discussed above, the spring 417 biases the pull-pin plunger 416 toward the arm mount hub 405, which means that the pull-pin plunger 416 is biased into the storage position lock hole 408 when the right dip handle assembly 400 is in the storage position. FIG. 24 depicts the right dip handle assembly 400 in the storage position with pull-pin plunger 416 inserted into the storage position lock hole 408. As discussed above with respect to the exercise position, the user may pull on the threaded knob 419 to overcome the biasing force of the spring 417 and withdraw the pull-pin plunger 416 from the storage position lock hole 408, in order to rotate the right dip handle assembly 400 away from the storage position.

The right dip handle assembly 400 thus utilizes two methods of locating and positioning the right dip handle assembly 400 in the storage position. The stop feature 421 contacts the storage position stop lug 407 to locate and position the right dip handle assembly 400 in the storage position. And the pull-pin plunger 416 is biased into the storage position lock hole 408 to further locate and position the right dip handle assembly 400 in the storage position, and to more affirmatively lock the right dip handle assembly 400 in the storage position.

Figure 25:
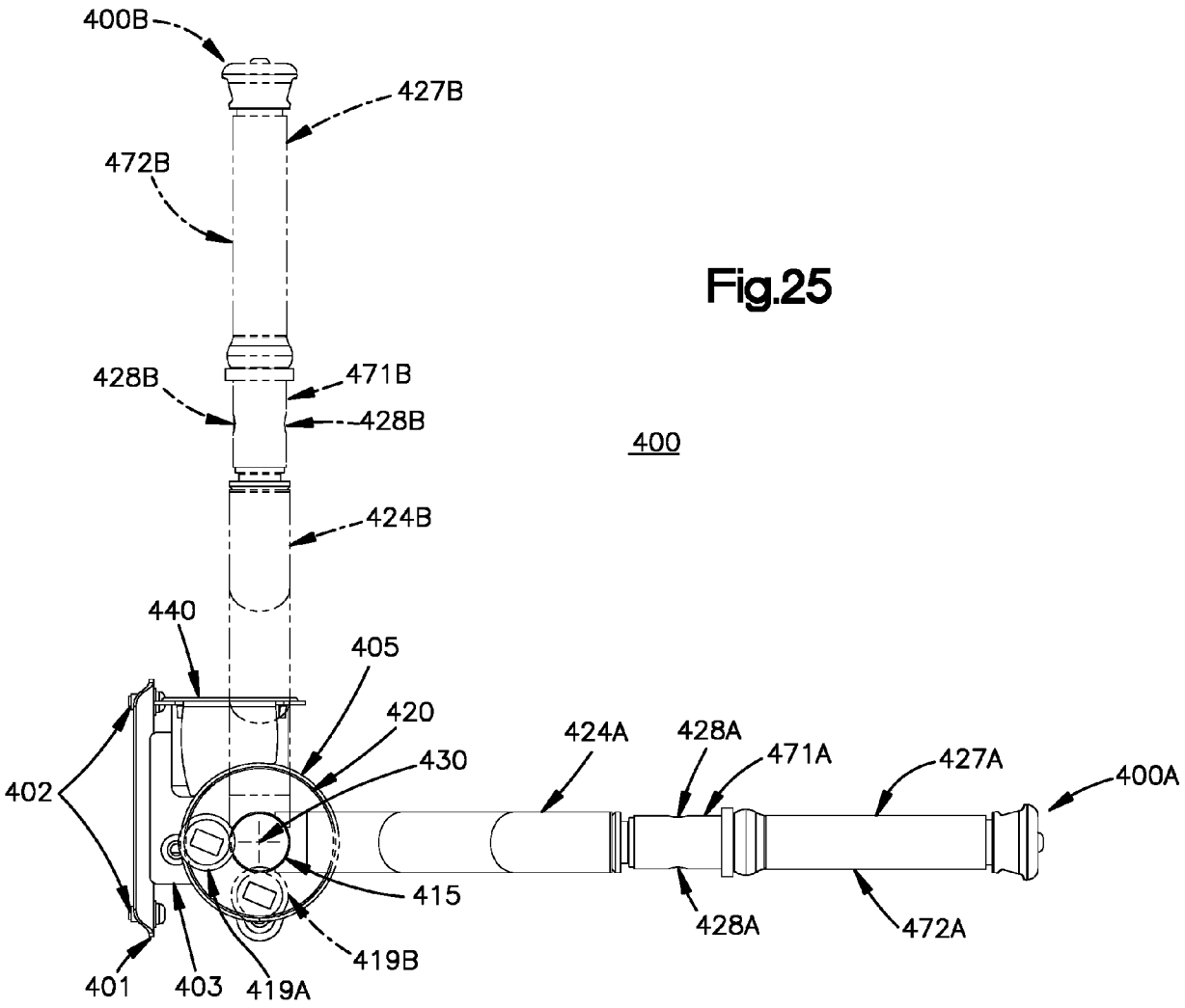
FIG. 25 is a left side, superimposed view of the right dip handle assembly as depicted in FIG. 15, with the dip handle assembly in the exercise position (shown in solid lines) and the dip handle assembly in the storage position (shown in dashed lines).

FIG. 25 illustrates the right dip handle assembly 400 in the exercise position (400A) superimposed upon the right dip handle assembly 400 in the storage position (400B). As shown, in the exercise position 400A, the exercise arm 424 and adjustable dip handle 427 are substantially horizontal. And in the storage position 400B, the exercise arm 424 and adjustable dip handle 427 have been rotated approximately 90° to lie in a substantially vertical plane. Furthermore, the spring-loaded pull pin 460 has rotated approximately 90° about pivot axis 430, as represented in FIG. 25 by the relative positions of the threaded knob 419A, 419B. Thus, the spring-loaded pull pin 460 has rotated between positions where it is engaged with the respective exercise position lock hole 409 and storage position lock hole 408 (see FIGS. 18 and 23).

Figure 26:
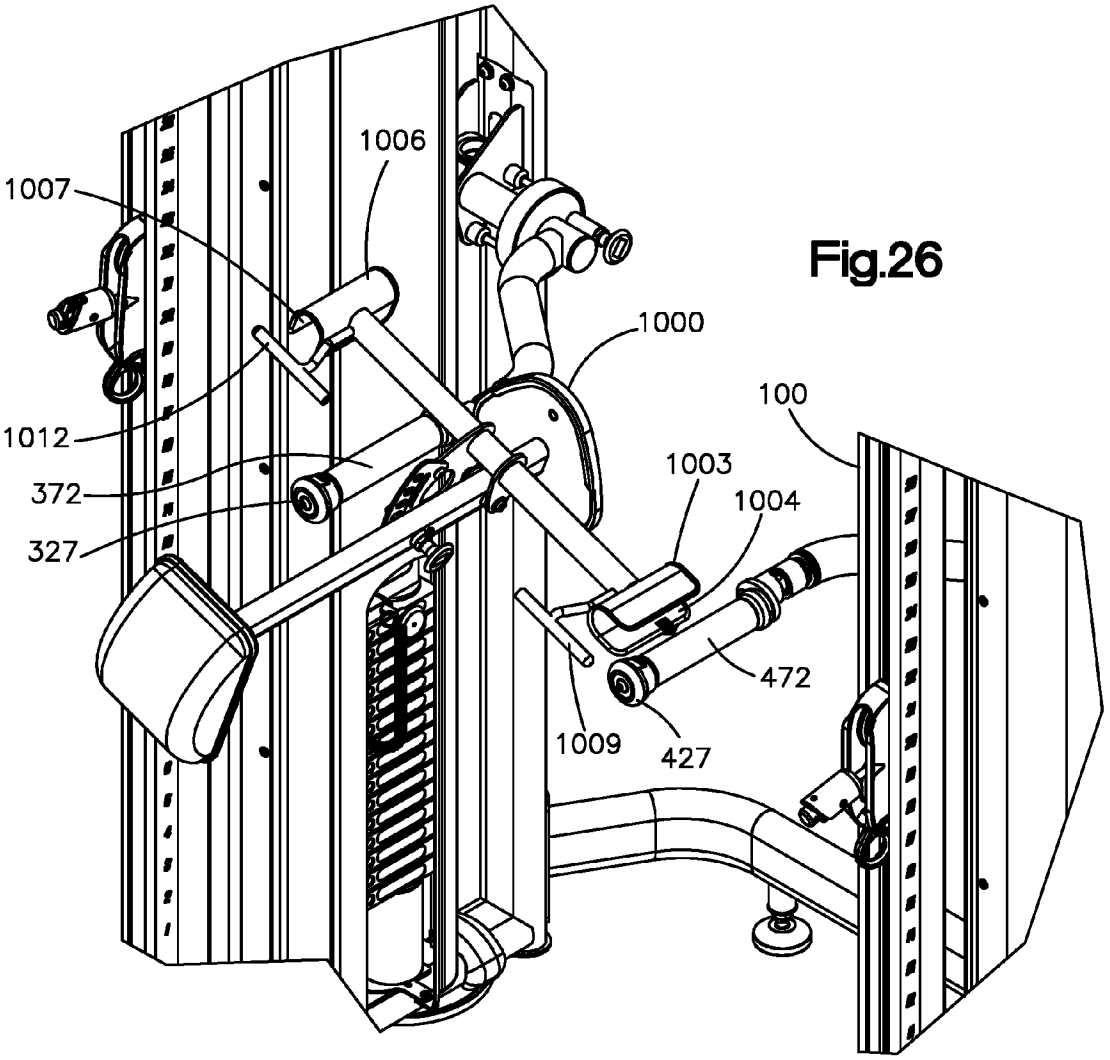
FIG. 26 is a front-right side isometric view of the exercise machine as depicted in FIGS. 6-25, with the detachable stabilizing support system of FIGS. 1-5 partially in place.
Figure 27:
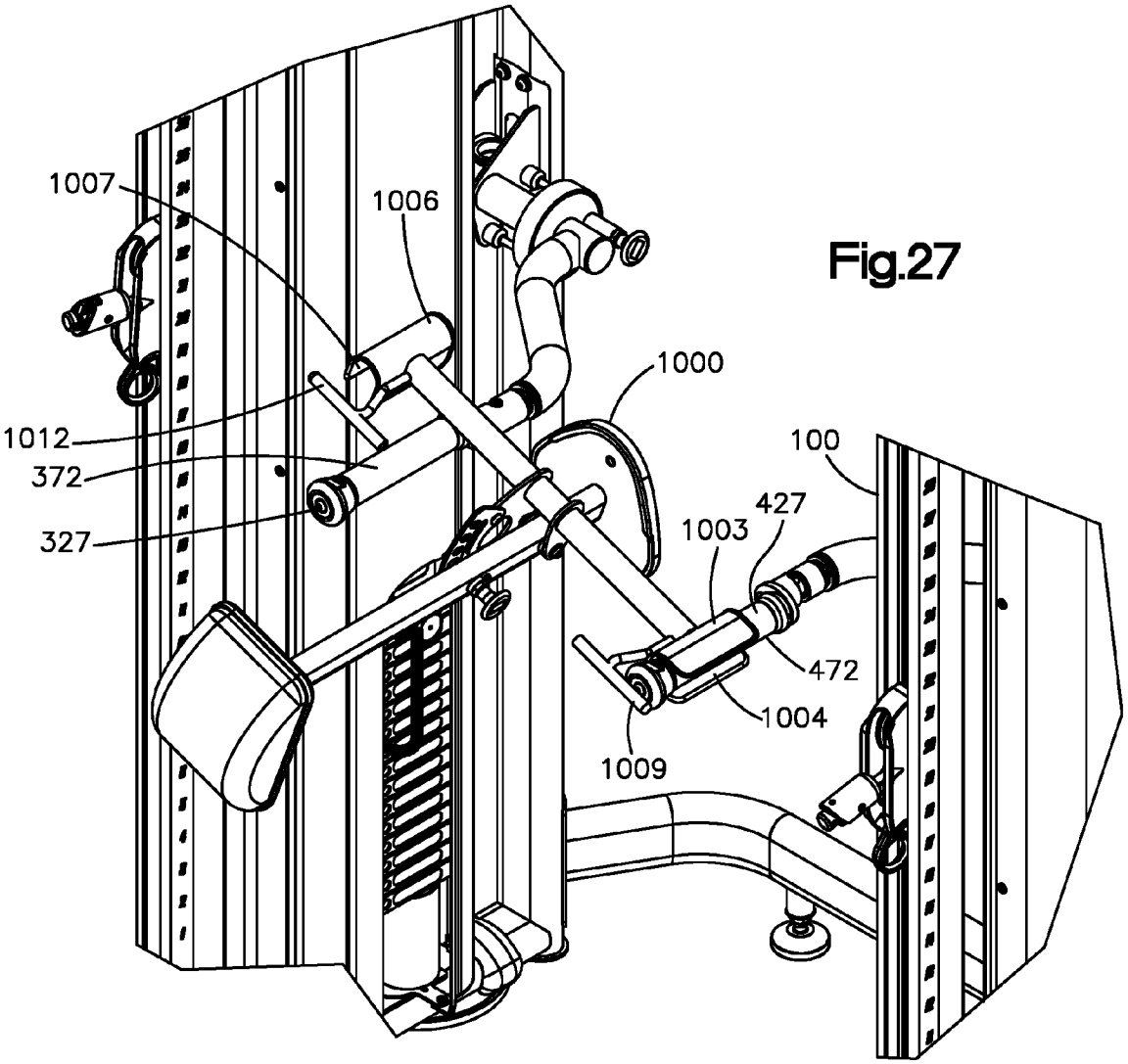
FIG. 27 is a front-right side isometric view of the exercise machine as depicted in FIGS. 6-25, with the detachable stabilizing support system of FIGS. 1-5 partially in place.
Figure 28:
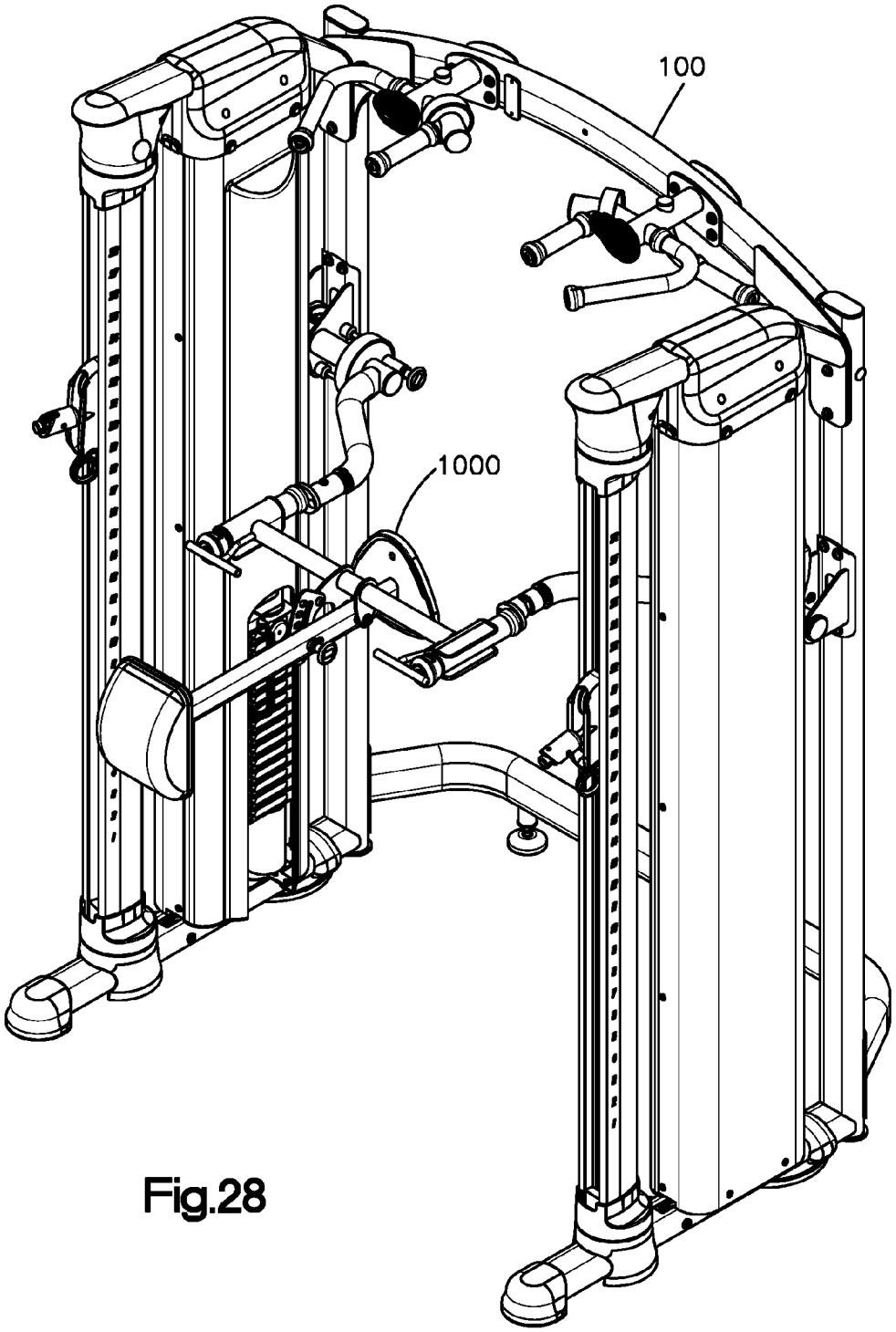
FIG. 28 is a front-right side isometric view of the exercise machine as depicted in FIGS. 6-25, with the detachable stabilizing support system of FIGS. 1-5 in place.

FIGS. 26-28 depict the installation of the stabilizing support system 1000 onto the exercise machine 100. First, as best shown by FIG. 26, the right-hand engagement channel 1003 is slid onto the grip portion 472 of the right-hand adjustable dip handle 427 of the exercise machine 100. The arrow in FIG. 26 shows the direction of movement for the stabilizing support system 1000, as the right-facing (i.e., outward-facing) slot 1004 of the right-hand engagement channel 1003 slides over the grip portion 472. After this step, the grip portion 472 lies within the right-facing (i.e., outward-facing) slot 1004. (See FIG. 27.) The right grip end stop 1009 engages the end of the right dip handle 427, in order to transmit horizontal forces from the stabilizing support system 1000 to the exercise machine 100.

Next, as best shown by FIG. 27, the stabilizing support system 1000 is rotated downward about the right-hand grip portion 472 within the right-facing (i.e., outward-facing) slot 1004 (and thus about axis 1005, see FIG. 1). The left-hand engagement channel 1006 is slid onto the grip portion 372 of the left-hand adjustable dip handle 327 of the exercise machine 100. The arrow in FIG. 27 shows the direction of movement for the stabilizing support system 1000, as the downward-facing slot 1007 of the left-hand engagement channel 1006 slides of the grip portion 372. After this step, the grip portion 372 lies within the downward-facing slot 1007. (See FIG. 28.) The left grip end stop 1012 engages the end of the left dip handle 327, in order to transmit horizontal forces from the stabilizing support system 1000 to the exercise machine 100. FIG. 28 depicts the stabilizing support system 1000 fully installed on the exercise machine 100.

FIGS. 29-38 illustrate the stabilizing support system 1000 fully installed on the exercise machine 100, and adjusted to provide stabilizing support to a user at various heights. As previously described, the pull pin 1034 can be selectively engaged into one of the locking pin holes 1023 in the adjustment plate 1021. Doing so adjusts the rotational orientation of the stabilizing strut 1024 about pivot axis 1019. When the stabilizing support system 1000 is installed on an exercise machine 100, this adjustment changes the height of the support pad 1033. Accordingly, to adjust the height of the support pad 1033, a user may: (1) withdraw the pull pin 1034 from the locking pin holes 1023, (2) rotate the stabilizing strut 1024 about pivot axis 1019 until the support pad 1033 is at the desired height, and (3) release the pull pin 1034 into the locking pin hole 1023 associated with the desired height of the support pad 1033.

Figure 29:
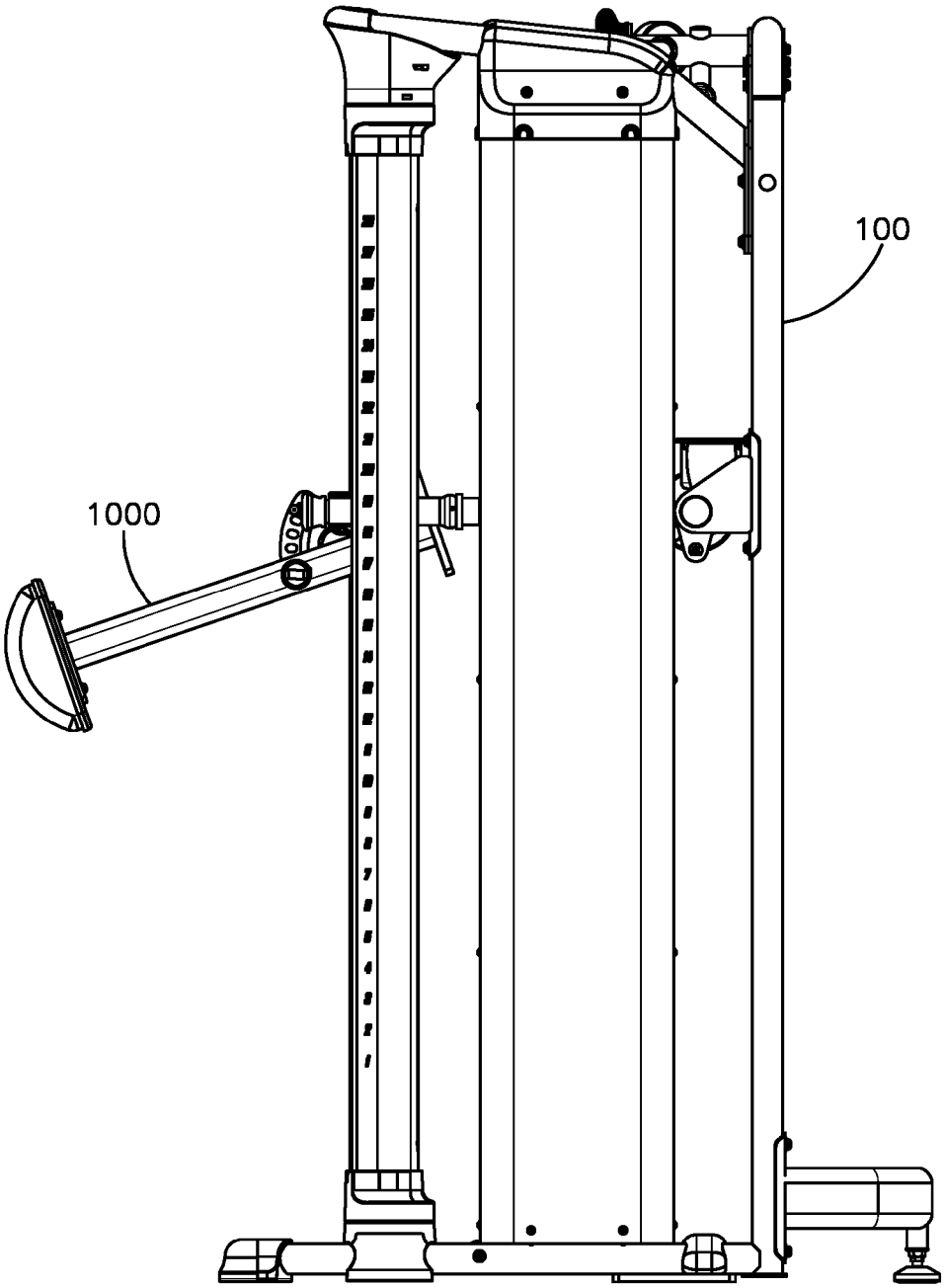
FIG. 29 is a right side view of the exercise machine as depicted in FIGS. 6-25, with the detachable stabilizing support system of FIGS. 1-5 in place and adjusted to provide support at approximately hip level.
Figure 30:
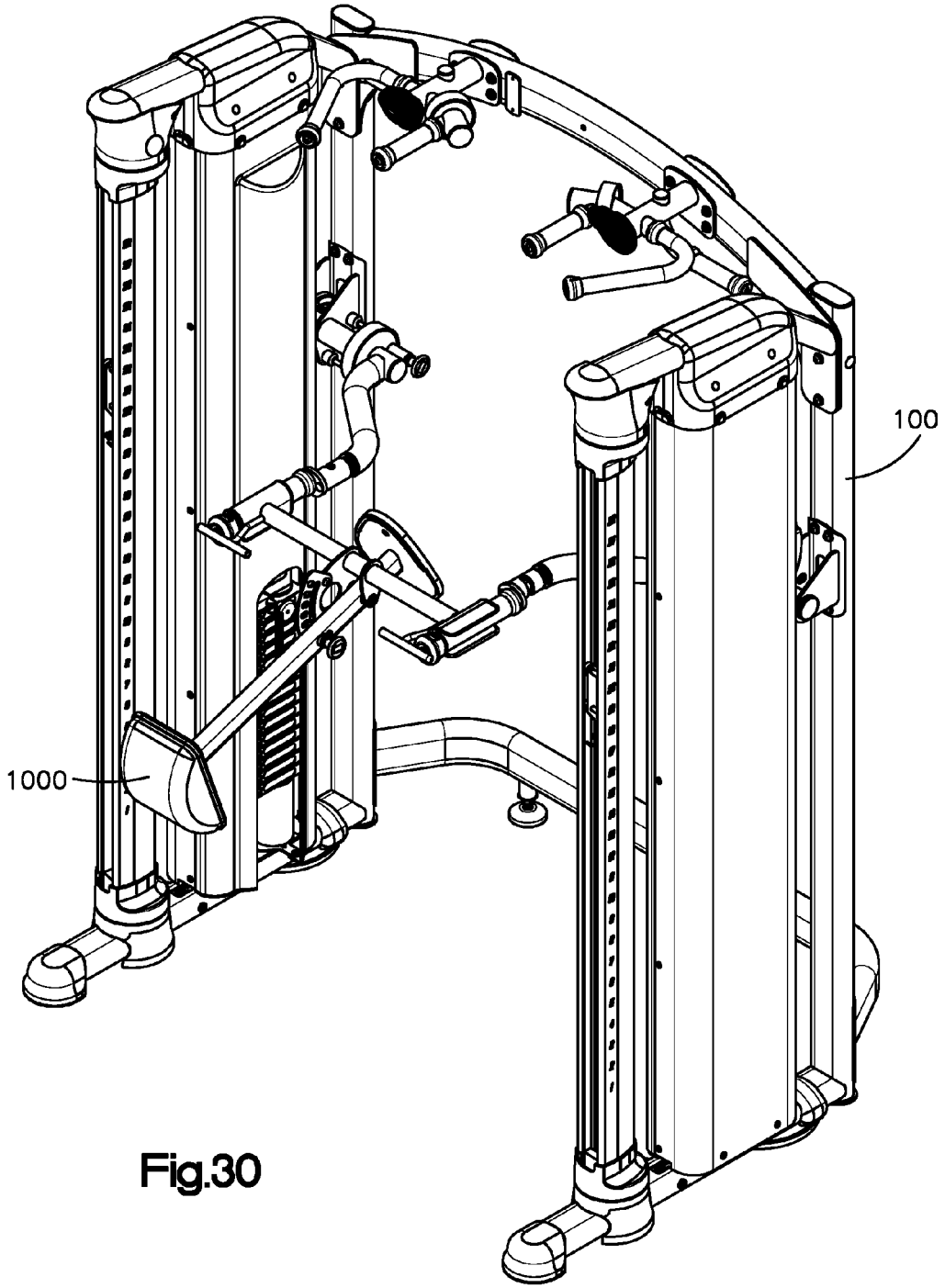
FIG. 30 is a front-right side isometric view of the exercise machine as depicted in FIGS. 6-25, with the detachable stabilizing support system of FIGS. 1-5 in place and adjusted to provide support at approximately hip level.
Figure 31:
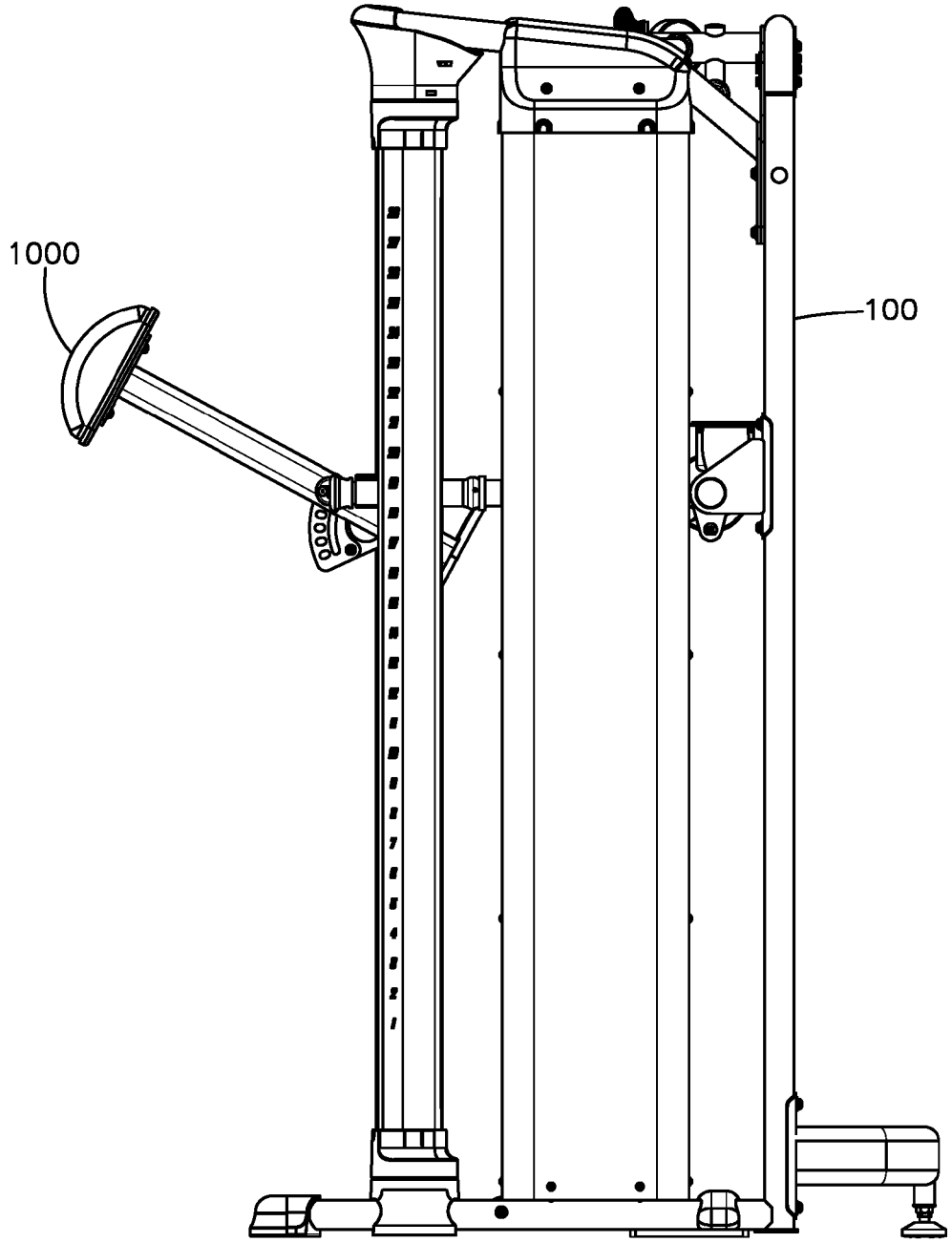
FIG. 31 is a right side view of the exercise machine as depicted in FIGS. 6-25, with the detachable stabilizing support system of FIGS. 1-5 in place and adjusted to provide support at approximately mid-chest level.
Figure 32:
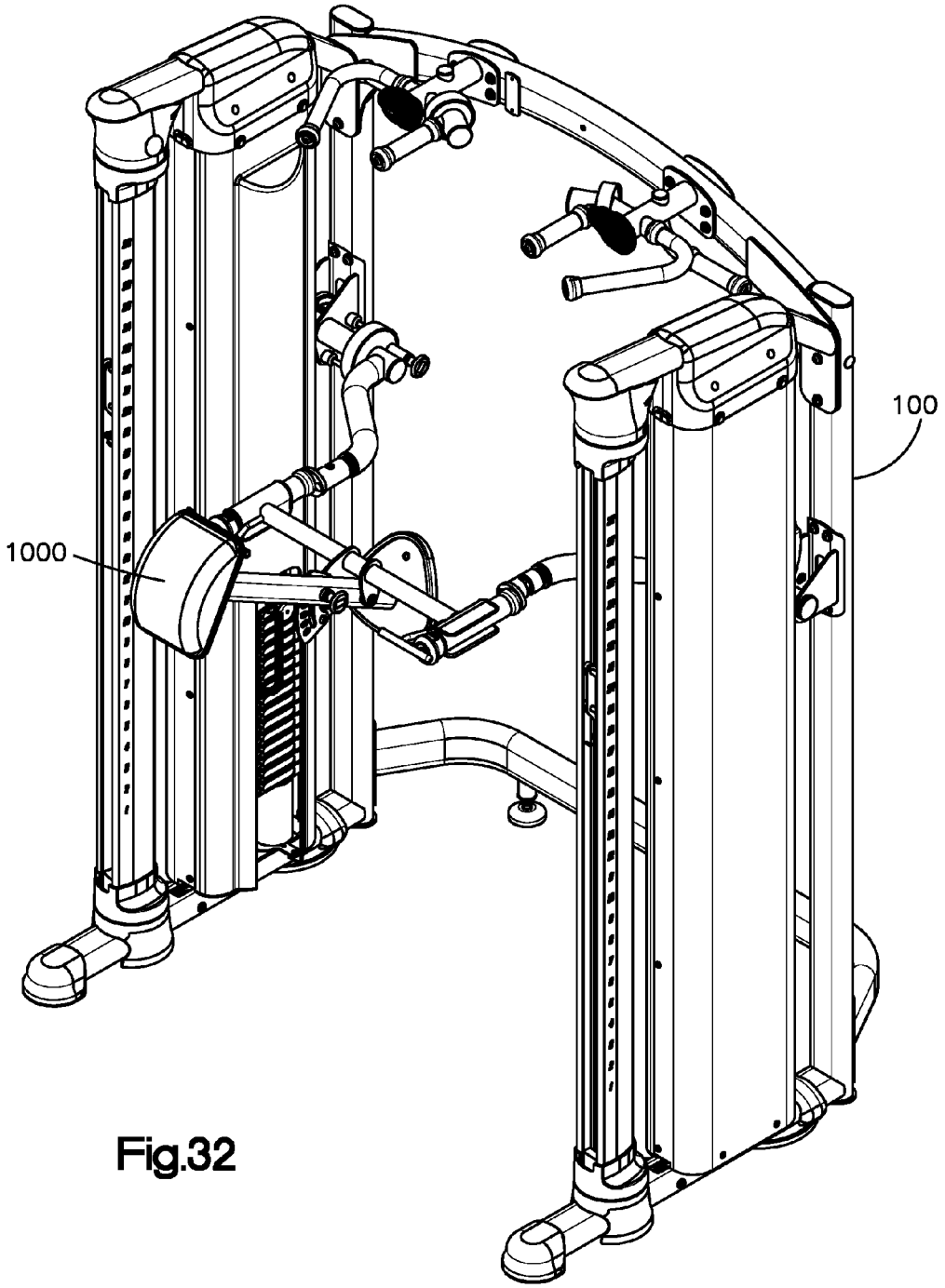
FIG. 32 is a front-right side isometric view of the exercise machine as depicted in FIGS. 6-25, with the detachable stabilizing support system of FIGS. 1-5 in place and adjusted to provide support at approximately mid-chest level.

FIGS. 29 and 30 show the stabilizing support system 1000 installed on exercise machine 100 and adjusted such that the support pad 1033 is at approximately hip level for a user. FIGS. 31 and 32 show the stabilizing support system 1000 installed on exercise machine 100 and adjusted such that the support pad 1033 is at approximately mid-chest level for a user.

Figure 33:
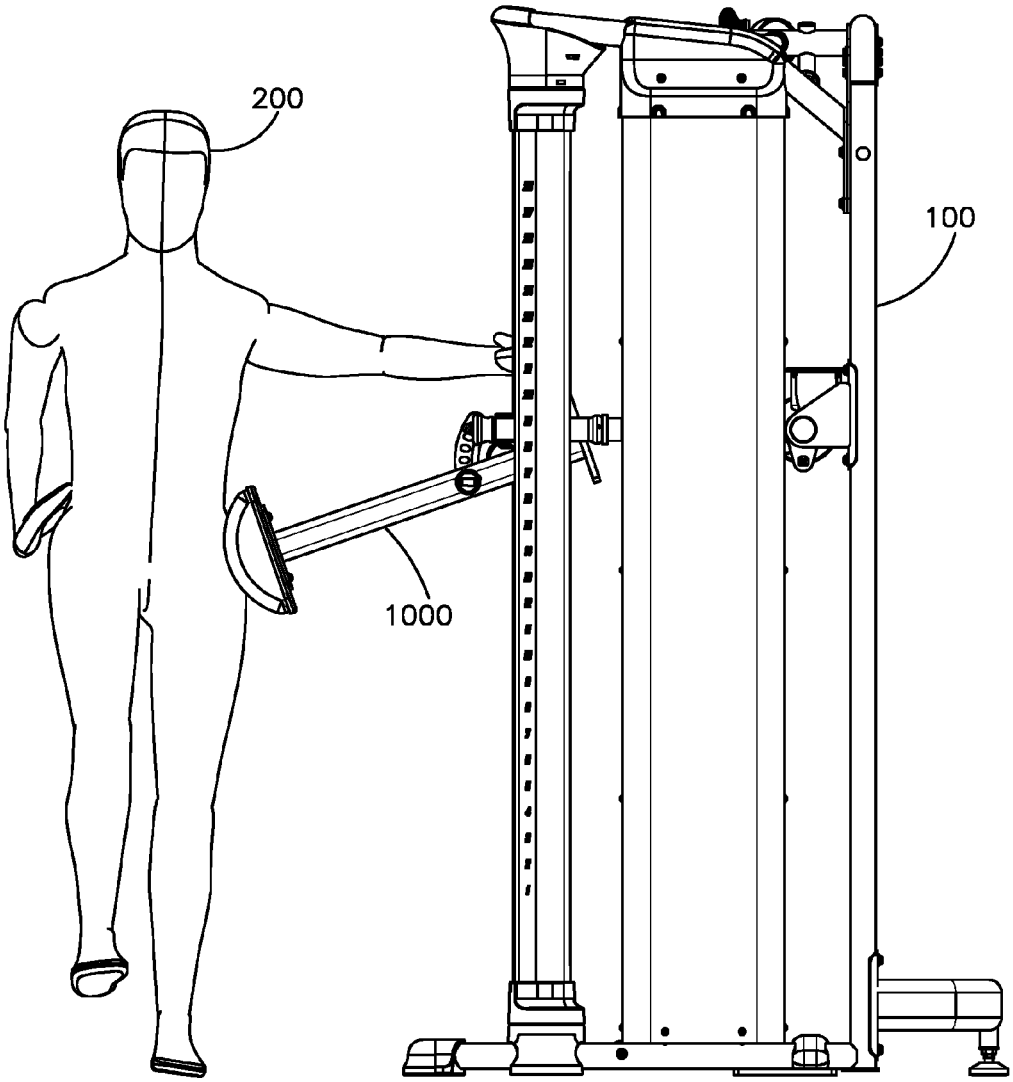
FIG. 33 is a right side view of the exercise machine as depicted in FIGS. 6-25, with the detachable stabilizing support system of FIGS. 1-5 in place and providing stabilizing support to a user at hip level.
Figure 34:
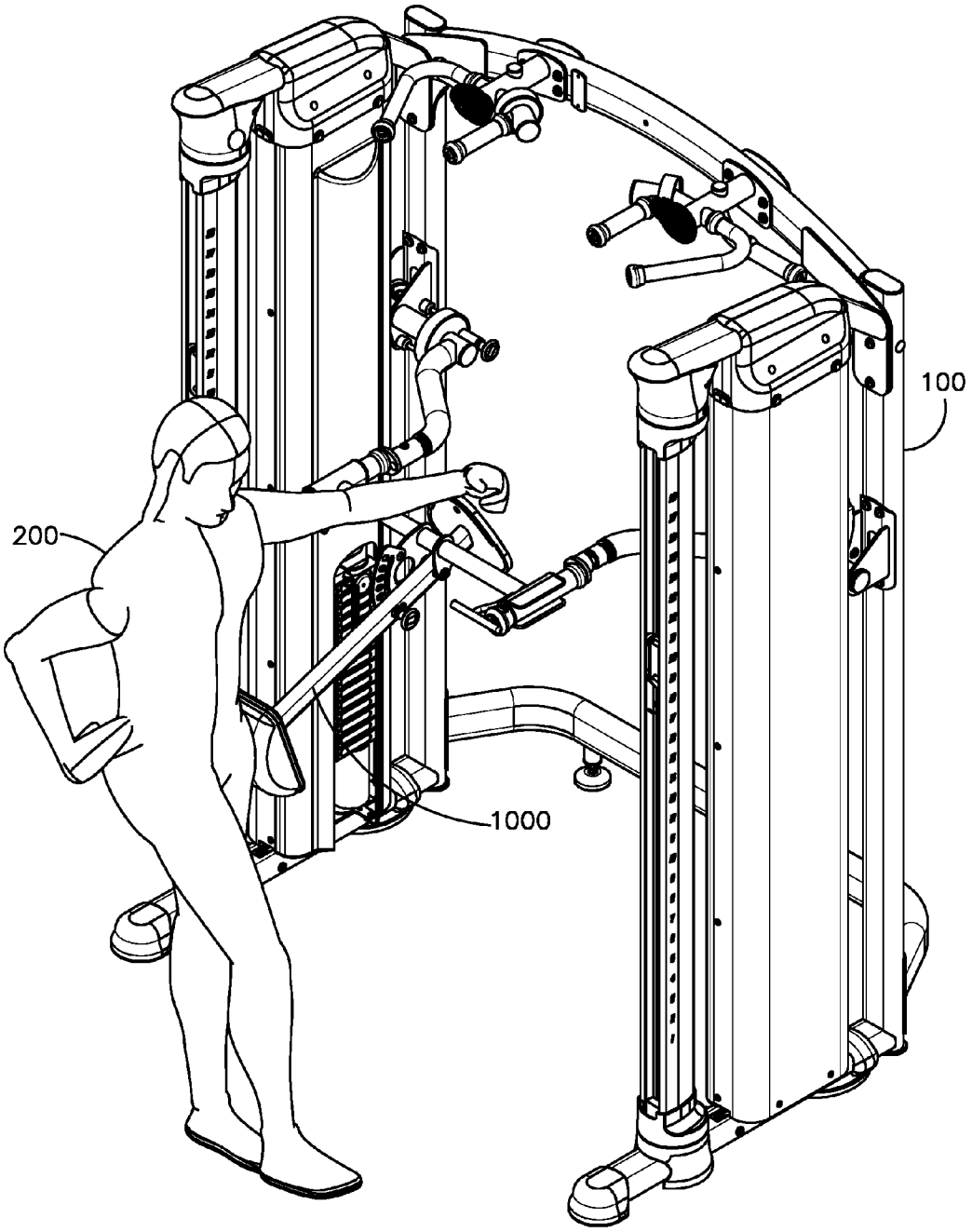
FIG. 34 is a front-right side isometric view of the exercise machine as depicted in FIGS. 6-25, with the detachable stabilizing support system of FIGS. 1-5 in place and providing stabilizing support to a user at hip level.
Figure 35:
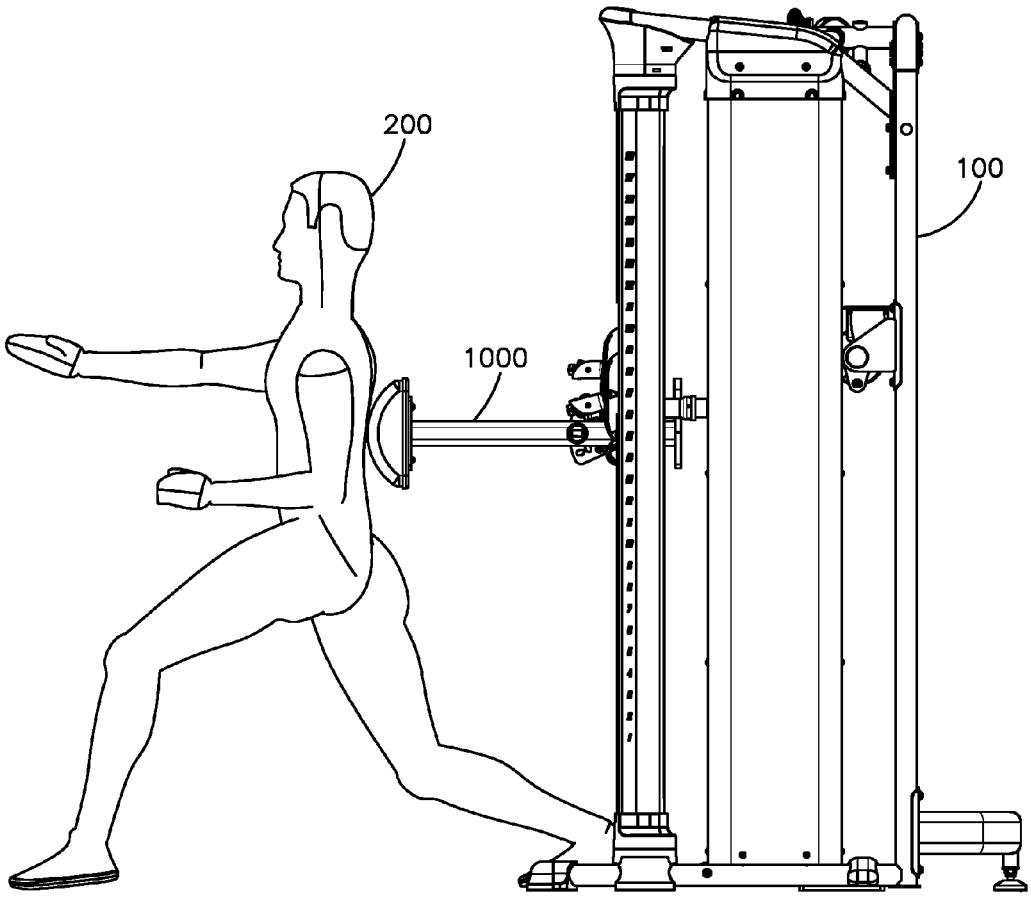
FIG. 35 is a right side view of the exercise machine as depicted in FIGS. 6-25, with the detachable stabilizing support system of FIGS. 1-5 in place and providing stabilizing support to a user at upper lumbar level.
Figure 36:
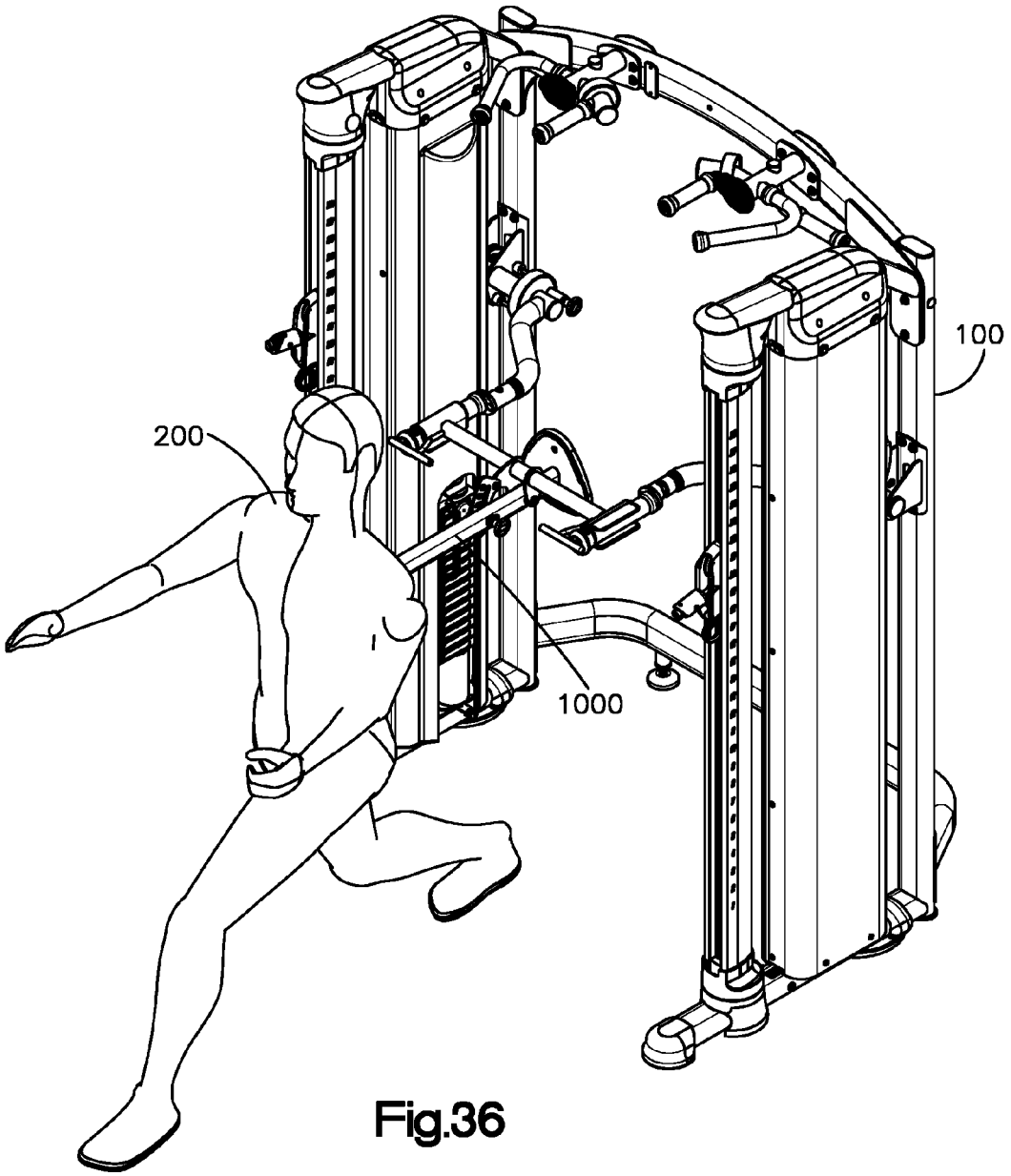
FIG. 36 is a front-right side isometric view of the exercise machine as depicted in FIGS. 6-25, with the detachable stabilizing support system of FIGS. 1-5 in place and providing stabilizing support to a user at upper lumbar level.
Figure 37:
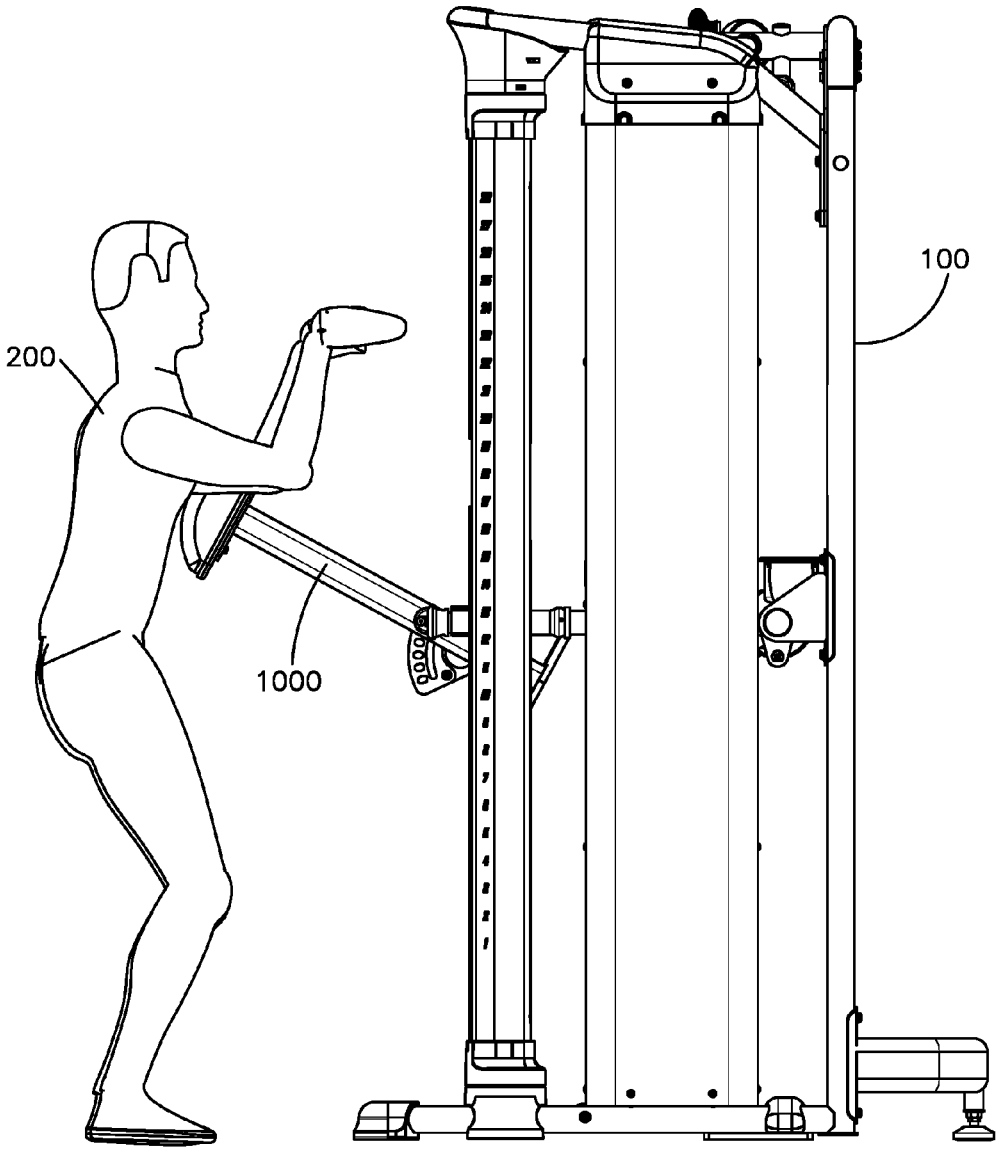
FIG. 37 is a right side view of the exercise machine as depicted in FIGS. 6-25, with the detachable stabilizing support system of FIGS. 1-5 in place and providing stabilizing support to a user at mid-chest level.
Figure 38:
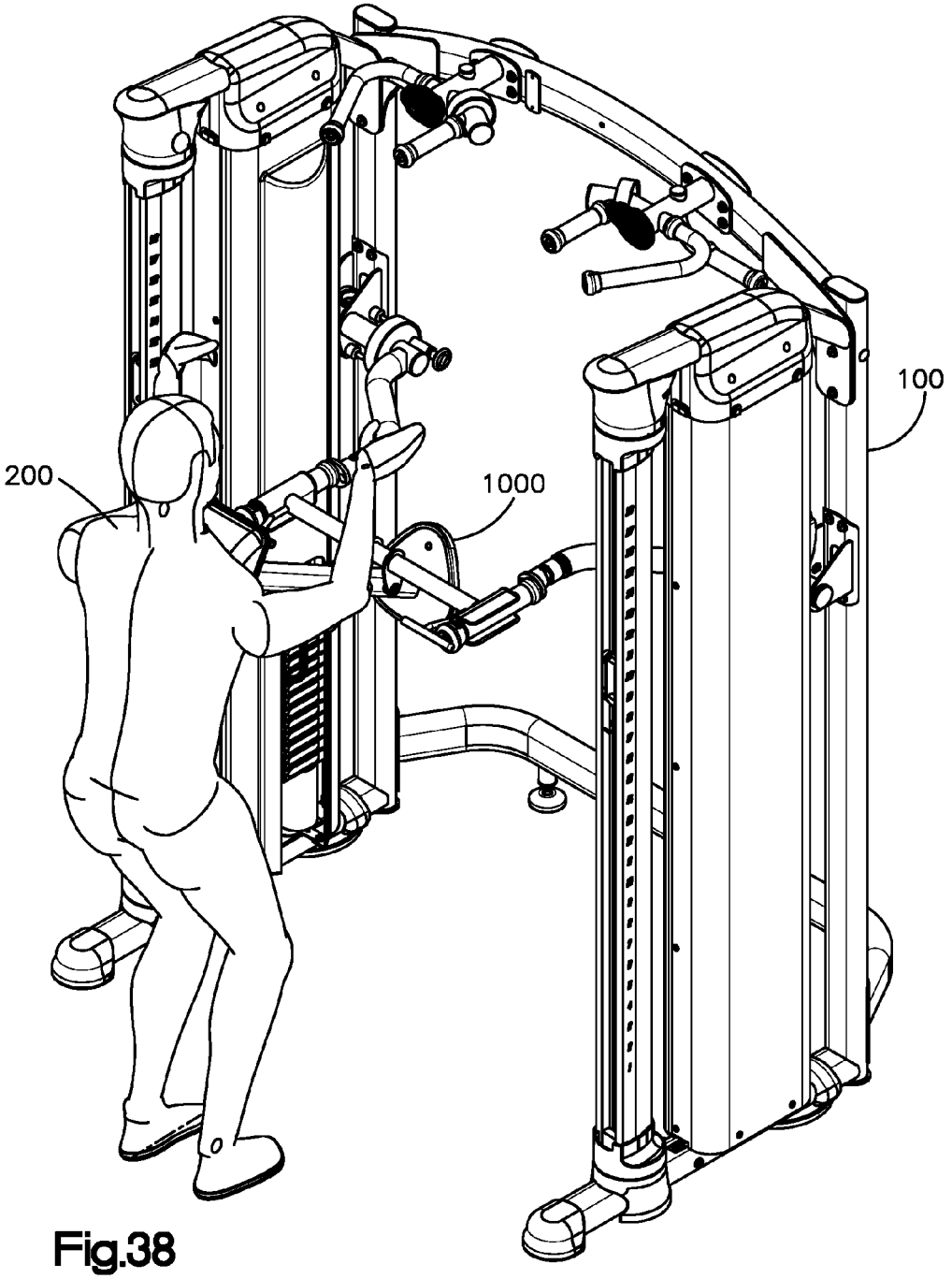
FIG. 38 is a front-right side isometric view of the exercise machine as depicted in FIGS. 6-25, with the detachable stabilizing support system of FIGS. 1-5 in place and providing stabilizing support to a user at mid-chest level.

FIGS. 33 and 34 show the stabilizing support system 1000 installed on exercise machine 100 and adjusted similar to FIGS. 29 and 30, except that FIGS. 33 and 34 depict an exerciser 200 receiving stabilizing support from the support pad 1033 at approximately hip level. FIGS. 35 and 36 show the stabilizing support system 1000 installed on exercise machine 100 and adjusted such that an exerciser 200 receives stabilizing support from the support pad 1033 at approximately upper-lumbar level. FIGS. 37 and 38 show the stabilizing support system 1000 installed on exercise machine 100 and adjusted similar to FIGS. 31 and 32, except that FIGS. 37 and 38 depict an exerciser 200 receiving stabilizing support from the support pad 1033 at approximately mid-chest level.

Figure 39:
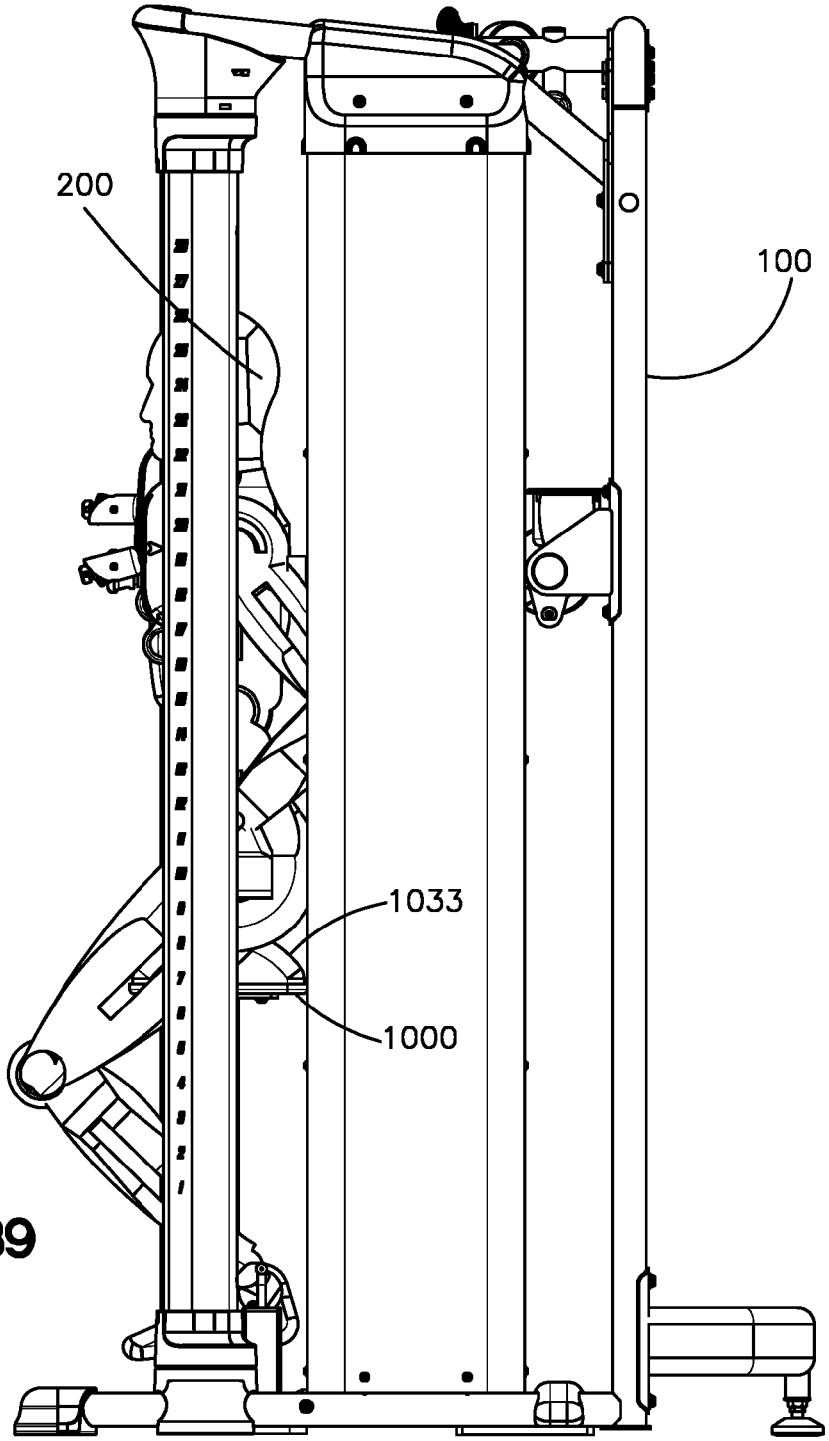
FIG. 39 is a right side view of the exercise machine as depicted in FIGS. 6-25, with the detachable stabilizing support system of FIGS. 1-5 in place and providing vertical support to a seated user.
Figure 40:
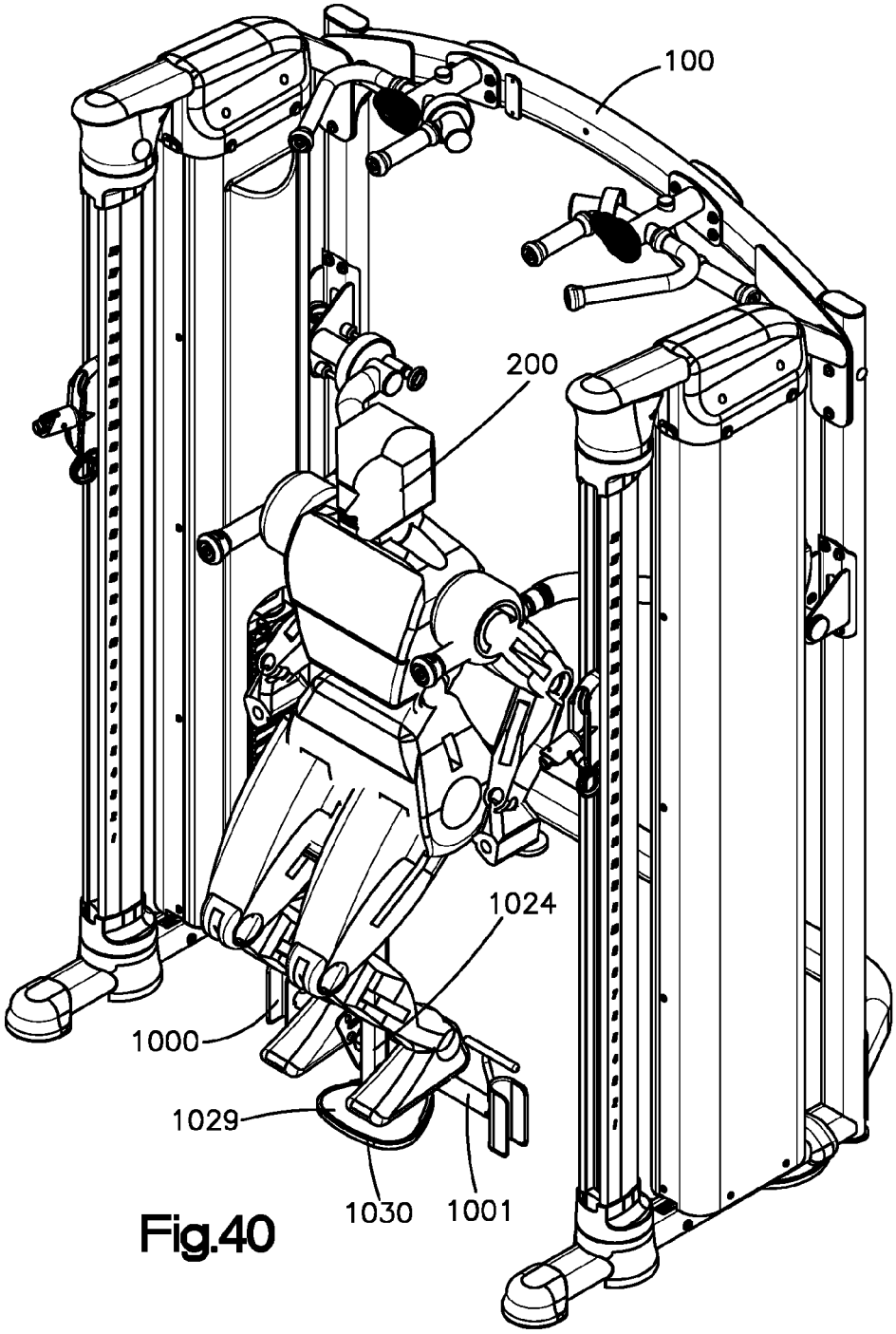
FIG. 40 is a front-right side isometric view of the exercise machine as depicted in FIGS. 6-25, with the detachable stabilizing support system of FIGS. 1-5 in place and providing vertical support to a seated user.

FIGS. 39 and 40 depict an alternative method of employing the stabilizing support system 1000 (see FIGS. 1-5), in order to provide vertical support to an exerciser 200 in a seated position. Specifically, the vertical support plate 1029 may serve as a pedestal, with the stabilizing strut 1024 in a substantially vertical orientation. The rubber foot 1030 helps protect the vertical support plate 1029, the floor, and provides additional stability by preventing slippage between the vertical support plate 1029 and the floor. In this configuration, the support pad 1033 provides a vertical support on which the exerciser 200 may seat himself. Further, the crossmember 1001 may provide support for the feet of the exerciser 200 seated on the stabilizing support system 1000. As one skilled in the art will readily appreciate, the configuration of an exerciser 200 seated on the stabilizing support system 1000 might be most useful for performing exercises with a vertical resistance path, especially if the vertical resistance path is substantially aligned with the stabilizing strut 1024.

Figure 41:
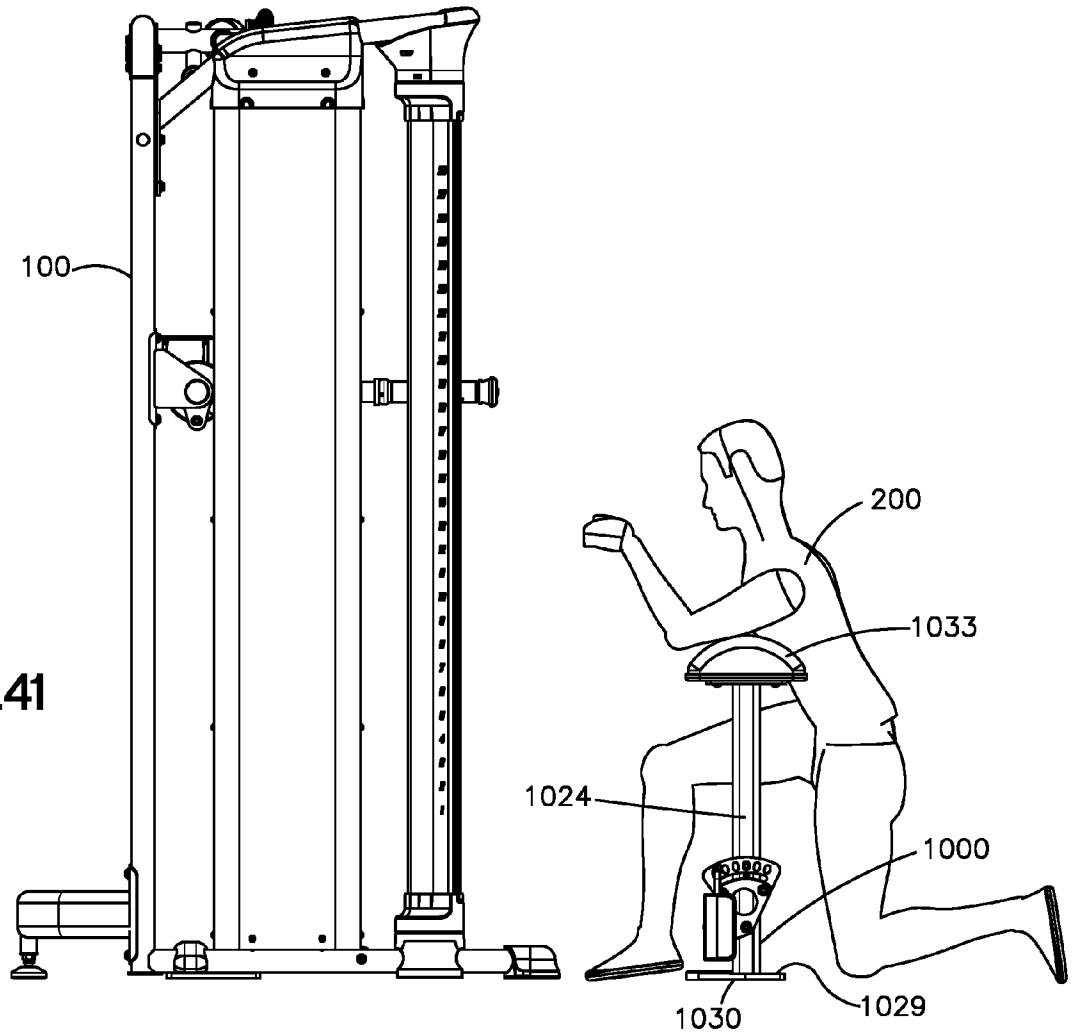
FIG. 41 is a right side view of the exercise machine as depicted in FIGS. 6-25, with the detachable stabilizing support system of FIGS. 1-5 in place and providing vertical support to a kneeling user.
Figure 42:
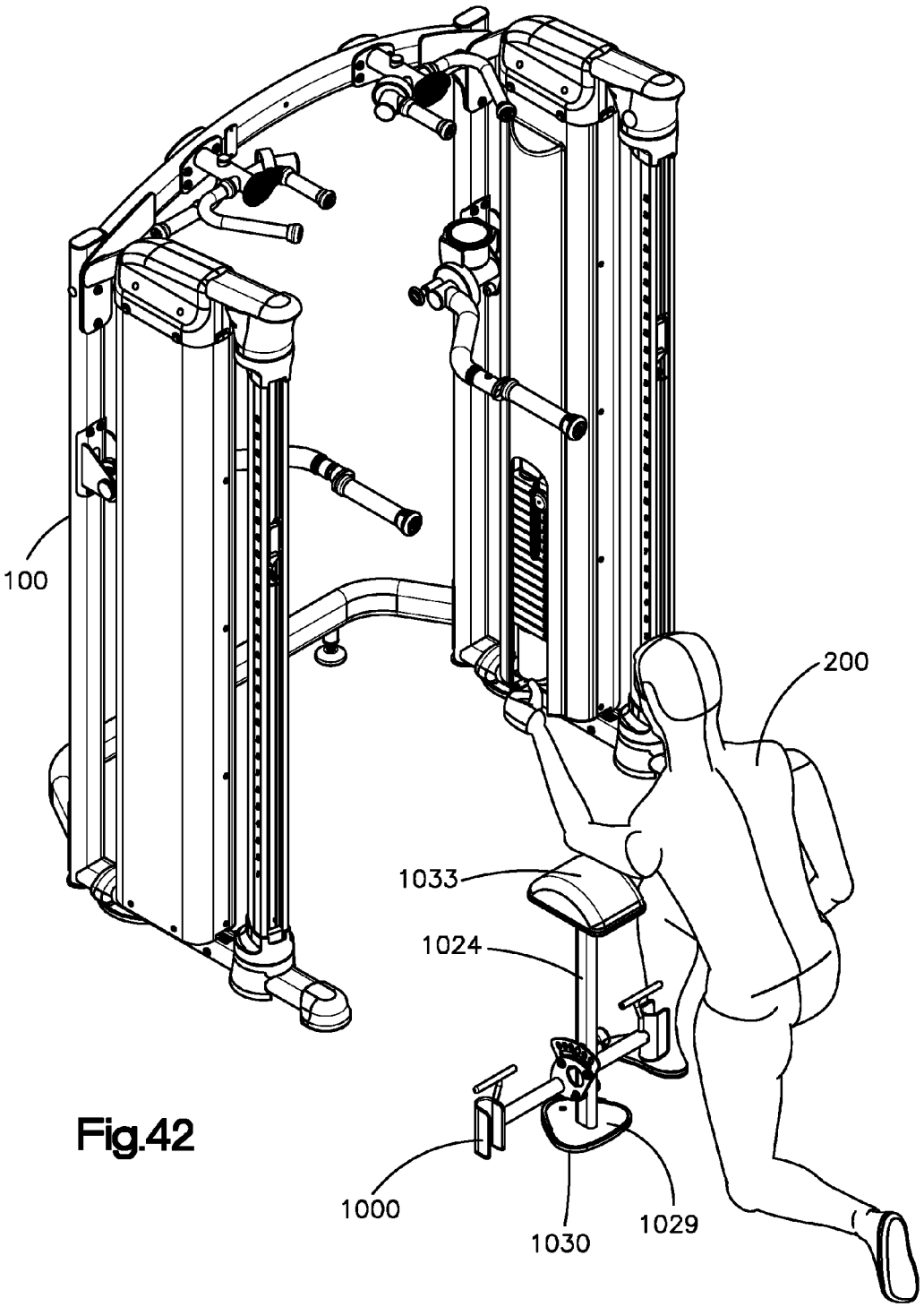
FIG. 42 is a front-right side isometric view of the exercise machine as depicted in FIGS. 6-25, with the detachable stabilizing support system of FIGS. 1-5 in place and providing vertical support to a kneeling user.

FIGS. 41 and 42 depict another method of employing the stabilizing support system 1000 (see FIGS. 1-5), in order to provide vertical support to an exerciser 200 in a kneeling position. Similar to FIGS. 39 and 40, the vertical support plate 1029 may serve as a pedestal, with the stabilizing strut 1024 in a substantially vertical orientation. The rubber foot 1030 helps protect the vertical support plate 1029, the floor, and provides additional stability by preventing slippage between the vertical support plate 1029 and the floor. In this configuration, the support pad 1033 provides a vertical support for a kneeling exerciser 200. In the embodiment shown in FIGS. 41 and 42, the support pad 1033 can provide vertical support to the arms of an exerciser 200 performing bicep curls.

Figure 43:
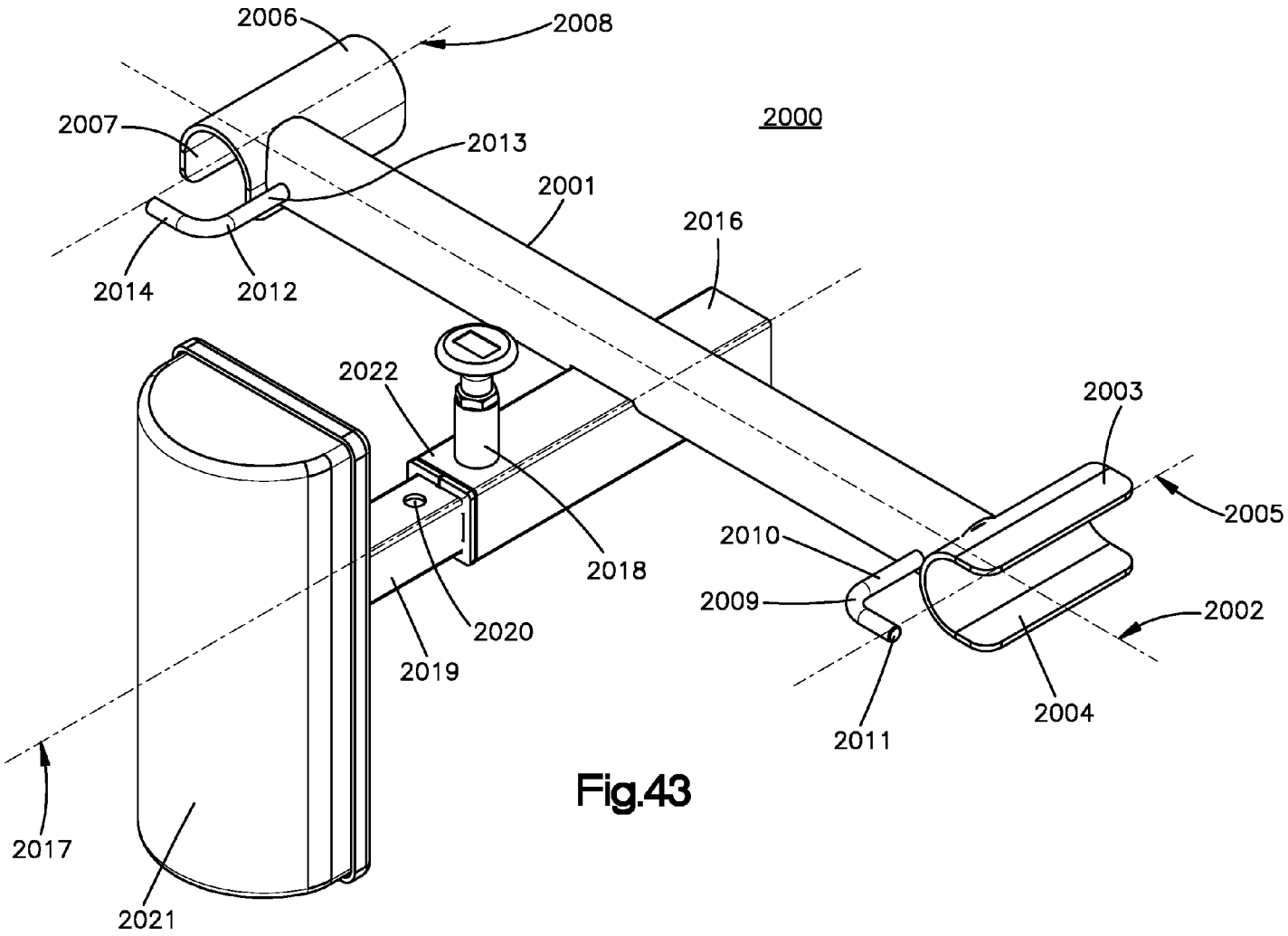
FIG. 43 is a top-right side isometric view of an alternative embodiment of a detachable stabilizing support system.
Figure 44:
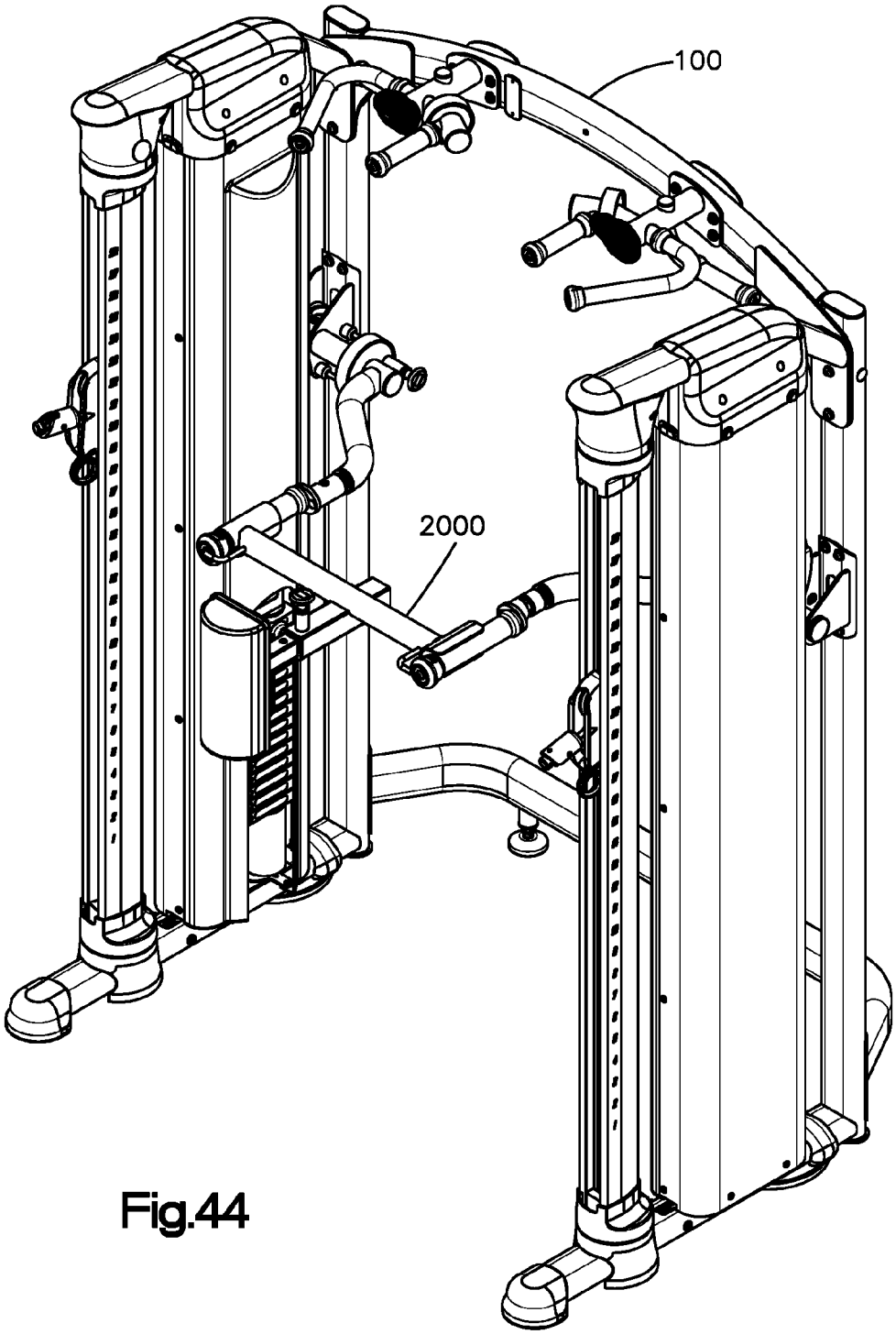
FIG. 44 is a front-right side isometric view of the exercise machine as depicted in FIGS. 6-25, with the detachable stabilizing support system of FIG. 43 in place.

An alternative embodiment of the present invention includes a detachable stabilizing support system 2000 as depicted in FIGS. 43 and 44. As best shown by FIG. 43, the stabilizing support system 2000 includes a crossmember 2001, having a central longitudinal axis 2002. At or near the right end of the crossmember 2001, a U-shaped right-hand engagement channel 2003 is attached. The right-hand engagement channel 2003 forms a right-facing (i.e., outward-facing) slot 2004, having a longitudinal axis 2005. At or near the left end of the crossmember 2001, a U-shaped left-hand engagement channel 2006 is attached. The left hand engagement channel 2006 forms a downward-facing slot 2007, having a longitudinal axis 2008. The longitudinal axes 2005, 2008 of the left and right engagement channels 2003, 2006 are substantially horizontal and substantially perpendicular to the central longitudinal axis 2002 of the crossmember 2001.

The stabilizing support system 2000 of the depicted embodiment includes a pair of grip end stops 2009, 2012. The grip end stops 2009, 2012 engage the ends of the right and left dip handles 427, 327 of exercise machine 100, in order to transmit horizontal forces from the stabilizing support system 2000 to the exercise machine 100. That is, when a user employs the stabilizing support system 2000 to provide horizontal stabilizing support, the grip end stops 2009, 2012 prevent the stabilizing support system 2000 from sliding rearwardly along the right and left dip handles 427, 327 of the exercise machine 100. The grip end stops 2009, 2012 as depicted in FIG. 43 will now be described in greater detail.

Near the right end of the crossmember 2001, adjacent to the right-hand engagement channel 2003, a right-hand grip end stop 2009 is attached to the crossmember 2001. The right-hand grip end stop 2009 includes a first member 2010 extending forwardly from the crossmember 2001 and a second member 2011 extending in a direction toward the right-hand engagement channel 2003, or longitudinal axis 2005. The second member 2011 of the right-hand grip end stop 2009 may extend substantially in parallel with the crossmember 2001 and its central longitudinal axis 2002. Furthermore, the second member 2011 of the right-hand grip end stop 2009 preferably intersects and/or passes through the longitudinal axis 2005 of the right-hand engagement channel 2003.

Similarly, near the left end of the crossmember 2001, adjacent to the left-hand engagement channel 2006, a left-hand grip end stop 2012 is attached to the crossmember 2001. The left-hand grip end stop 2012 includes a first member 2013 extending forwardly from the crossmember 2001 and a second member 2014 extending in a direction toward the left-hand engagement channel 2006, or longitudinal axis 2008. The second member 2014 of the left-hand grip end stop 2012 may extend substantially in parallel with the crossmember 2001 and its central longitudinal axis 2002. Furthermore, the second member 2014 of the left-hand grip end stop 2012 preferably intersects and/or passes through the longitudinal axis 2008 of the left-hand engagement channel 2006.

One of ordinary skill in the art will readily appreciate that a variety of configurations for right and left grip end stops 2009, 2012 are available to accomplish the same means without departing from the scope or spirit of the invention. As just one example, the right and left grip end stops 2009, 2012 could each be made from just a single member that is configured to engage the ends of the right and left dip handles 427, 327 of exercise machine 100. As another example, the right and left grip end stops 2009, 2012 might optionally be attached to the respective right and left engagement channels 2003, 2006, rather than coupled to the crossmember 2001. In such a configuration, the right and left grip end stops 2009, 2012 could be end caps or surfaces that simply close the forward, open ends of the right and left engagement channels 2003, 2006.

The stabilizing support system 2000 of FIGS. 43 and 44 further includes a stabilizing strut tube 2016 having a longitudinal axis 2017. The stabilizing strut tube 2016 is attached near the center of the crossmember 2001, at a location between the right and left engagement channels 2003, 2006. The stabilizing strut tube 2016 (and its longitudinal axis 2017) is oriented generally perpendicular to the crossmember 2001 (and its central longitudinal axis 2002).

The stabilizing strut tube 2016 includes an open, forward end 2022 that slidingly receives a support post 2019, which is attached to a support pad 2021. The stabilizing strut tube 2016 further includes a pull pin 2018 that can selectively engage into one of several locking pin holes 2020 in the support post 2020. Thus, the location of the support pad 2021 along axis 2017 can be adjusted by sliding the support post 2019 within the stabilizing strut tube 2016 into the desired position, and then locking the pull pin 2018 into a corresponding locking pin hole 2020. The pull pin 2018 may optionally be spring-loaded, so that it is biased toward the locking pin holes 2020.

The stabilizing support system 2000 can be used in connection with an exercise machine 100, an embodiment of which is shown and described above with reference to FIGS. 6-25. FIG. 44 depicts the stabilizing support system 2000 installed on exercise machine 100.

Another embodiment of the present invention includes a detachable stabilizing support system 3000 as depicted in FIGS. 45-49. The stabilizing support system 3000 is capable of an exercise position (FIG. 45) and a storage position (FIGS. 46-49).

Figure 45:
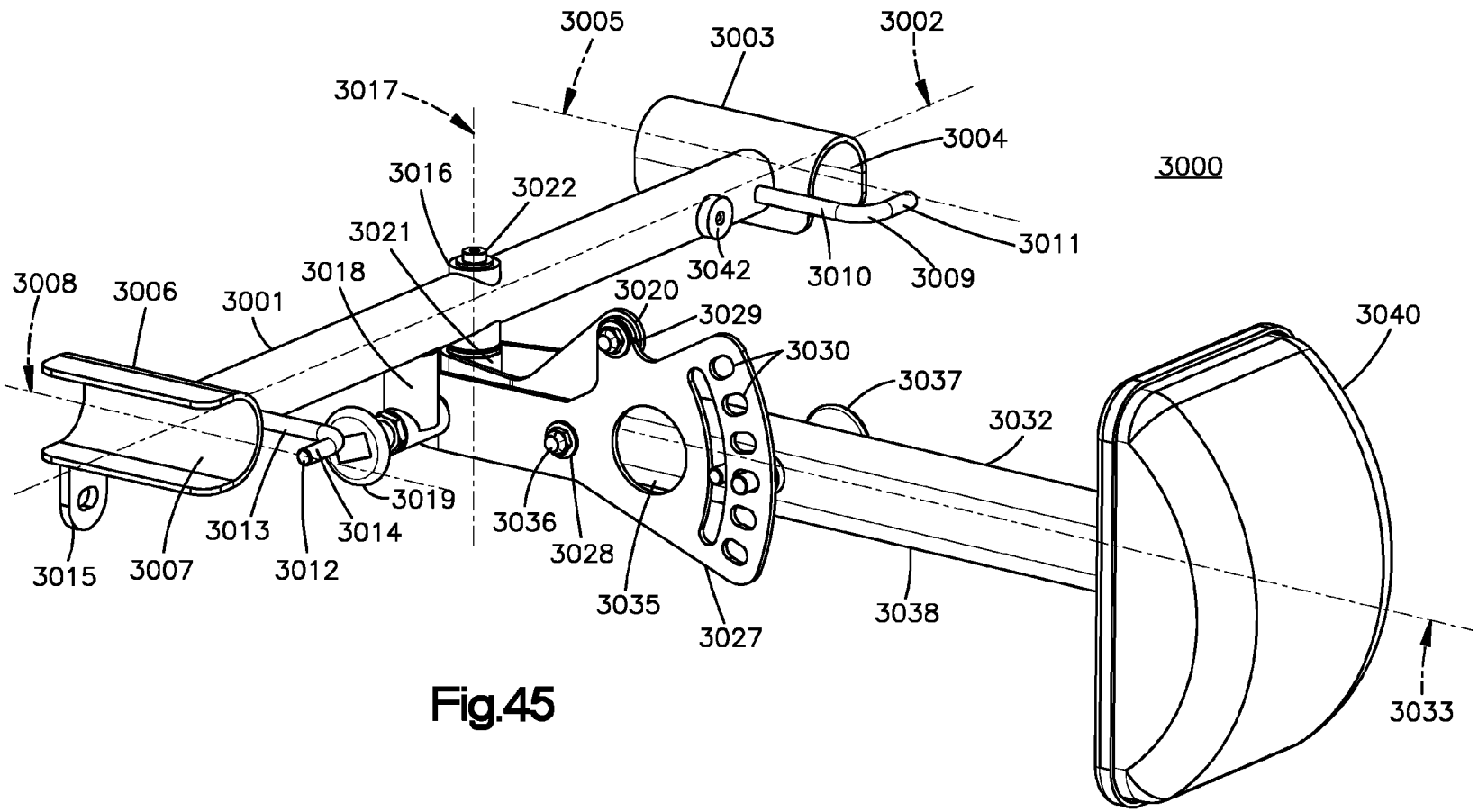
FIG. 45 is a top-left side isometric view of an alternative embodiment of a detachable stabilizing support system, with the support pad in the exercise position.

As best shown by FIG. 45, the stabilizing support system 3000 includes a crossmember 3001, having a central longitudinal axis 3002. At or near the right end of the crossmember 3001, a U-shaped right-hand engagement channel 3003 is attached. The right-hand engagement channel 3003 forms a downward-facing slot 3004, having a longitudinal axis 3005. At or near the left end of the crossmember 3001, a U-shaped left-hand engagement channel 3006 is attached. The left hand engagement channel 3006 forms a left-facing (i.e., outward-facing) slot 3007, having a longitudinal axis 3008. The left hand engagement channel 3006 may also include a storage hook 3015, hole, slot, loop, tether, or other feature suitable for hanging the stabilizing support system 3000 in a stored position. The longitudinal axes 3005, 3008 of the left and right engagement channels 3003, 3006 are substantially horizontal and substantially perpendicular to the central longitudinal axis 3002 of the crossmember 3001.

The stabilizing support system 3000 of the depicted embodiment includes a pair of grip end stops 3009, 3012. The grip end stops 3009, 3012 engage the ends of the right and left dip handles 427, 327 of exercise machine 100, in order to transmit horizontal forces from the stabilizing support system 3000 to the exercise machine 100. That is, when a user employs the stabilizing support system 3000 to provide horizontal stabilizing support, the grip end stops 3009, 3012 prevent the stabilizing support system 3000 from sliding rearwardly along the right and left dip handles 427, 327 of the exercise machine 100. The grip end stops 3009, 3012 as depicted in FIGS. 45-49 will now be described in greater detail.

Near the right end of the crossmember 3001, adjacent to the right-hand engagement channel 3003, a right-hand grip end stop 3009 is attached to the crossmember 3001. The right-hand grip end stop 3009 includes a first member 3010 extending forwardly from the crossmember 3001 and a second member 3011 extending in a direction toward the right-hand engagement channel 3003, or longitudinal axis 3005. The second member 3011 of the right-hand grip end stop 3009 may extend substantially in parallel with the crossmember 3001 and its central longitudinal axis 3002. Furthermore, the second member 3011 of the right-hand grip end stop 3009 preferably intersects and/or passes through the longitudinal axis 3005 of the right-hand engagement channel 3003.

Similarly, near the left end of the crossmember 3001, adjacent to the left-hand engagement channel 3006, a left-hand grip end stop 3012 is attached to the crossmember 3001. The left-hand grip end stop 3012 includes a first member 3013 extending forwardly from the crossmember 3001 and a second member 3014 extending in a direction toward the left-hand engagement channel 3006, or longitudinal axis 3008. The second member 3014 of the left-hand grip end stop 3012 may extend substantially in parallel with the crossmember 3001 and its central longitudinal axis 3002. Furthermore, the second member 3014 of the left-hand grip end stop 3012 preferably intersects and/or passes through the longitudinal axis 3008 of the left-hand engagement channel 3006.

One of ordinary skill in the art will readily appreciate that a variety of configurations for right and left grip end stops 3009, 3012 are available to accomplish the same means without departing from the scope or spirit of the invention. As just one example, the right and left grip end stops 3009, 3012 could each be made from just a single member that is configured to engage the ends of the right and left dip handles 427, 327 of exercise machine 100. As another example, the right and left grip end stops 3009, 3012 might optionally be attached to the respective right and left engagement channels 3003, 3006, rather than coupled to the crossmember 3001. In such a configuration, the right and left grip end stops 3009, 3012 could be end caps or surfaces that simply close the forward, open ends of the right and left engagement channels 3003, 3006.

Toward the center of the crossmember 3001, located between the right and left engagement channels 3003, 3006, a pivot sleeve 3016 is coupled to the crossmember 3001. The pivot sleeve 3016 provides a pivot axis 3017, which may be substantially vertical and substantially perpendicular to central longitudinal axis 3002. Adjacent to the pivot sleeve 3016, and also located between the right and left engagement channels 3003, 3006, a locking pin standoff feature 3018 is coupled to the crossmember 3001. According to the depicted embodiment, the locking pin standoff feature 3018 is a tubular member extending downward from the crossmember 3001. However, one of ordinary skill in the art will appreciate that a variety of members or brackets might comprise the locking pin standoff feature 3018. A storage locking pin 3019 is provided on the locking pin standoff feature 3018.

A pivot bracket 3020 is pivotally connected to the crossmember 3001 for rotation about pivot axis 3017. The pivot bracket 3020 includes a pivot sleeve 3021. A pivot pin 3022 passes through the pivot sleeve 3016 of the crossmember 3001 and the pivot sleeve 3021 of the pivot bracket 3020, to provide a rotatable connection between the pivot bracket 3020 and the crossmember 3001 about pivot axis 3017.

Figure 47:
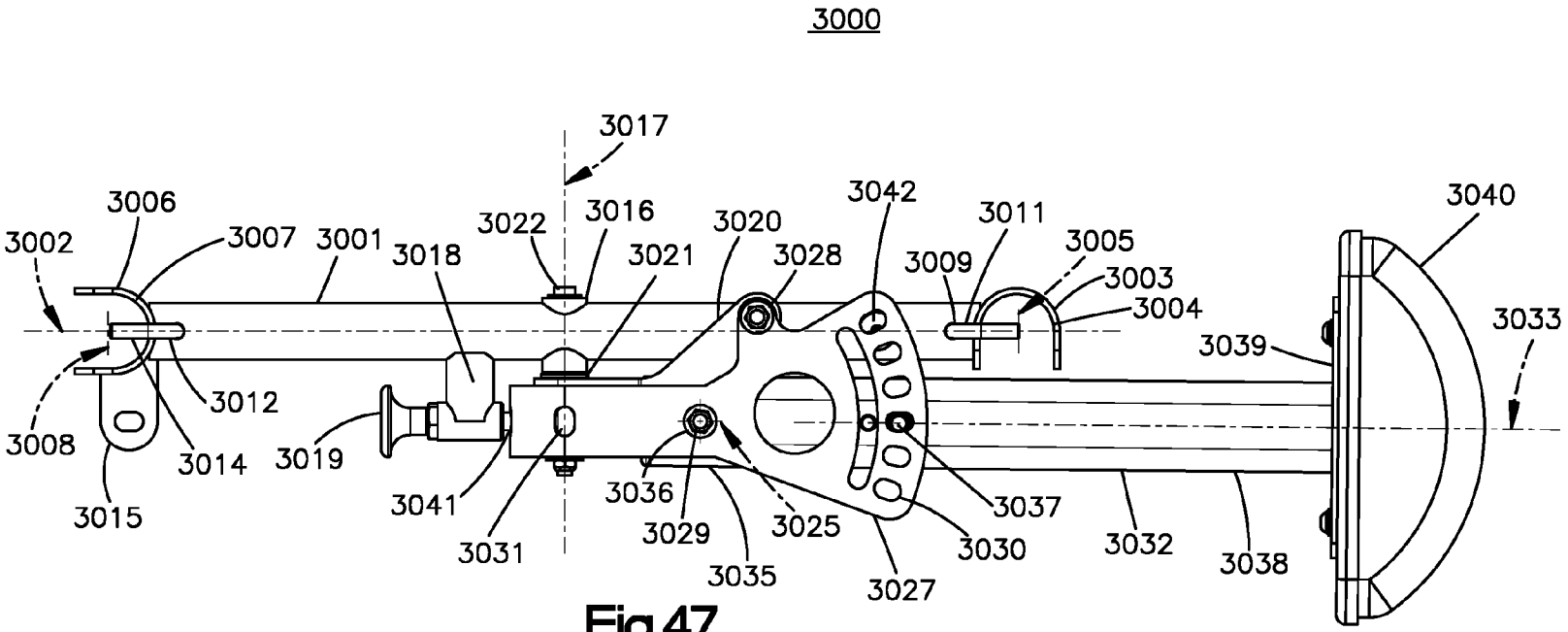
FIG. 47 is a front side view of the detachable stabilizing support system of FIG. 45, with the support pad in the storage position.
Figure 48:
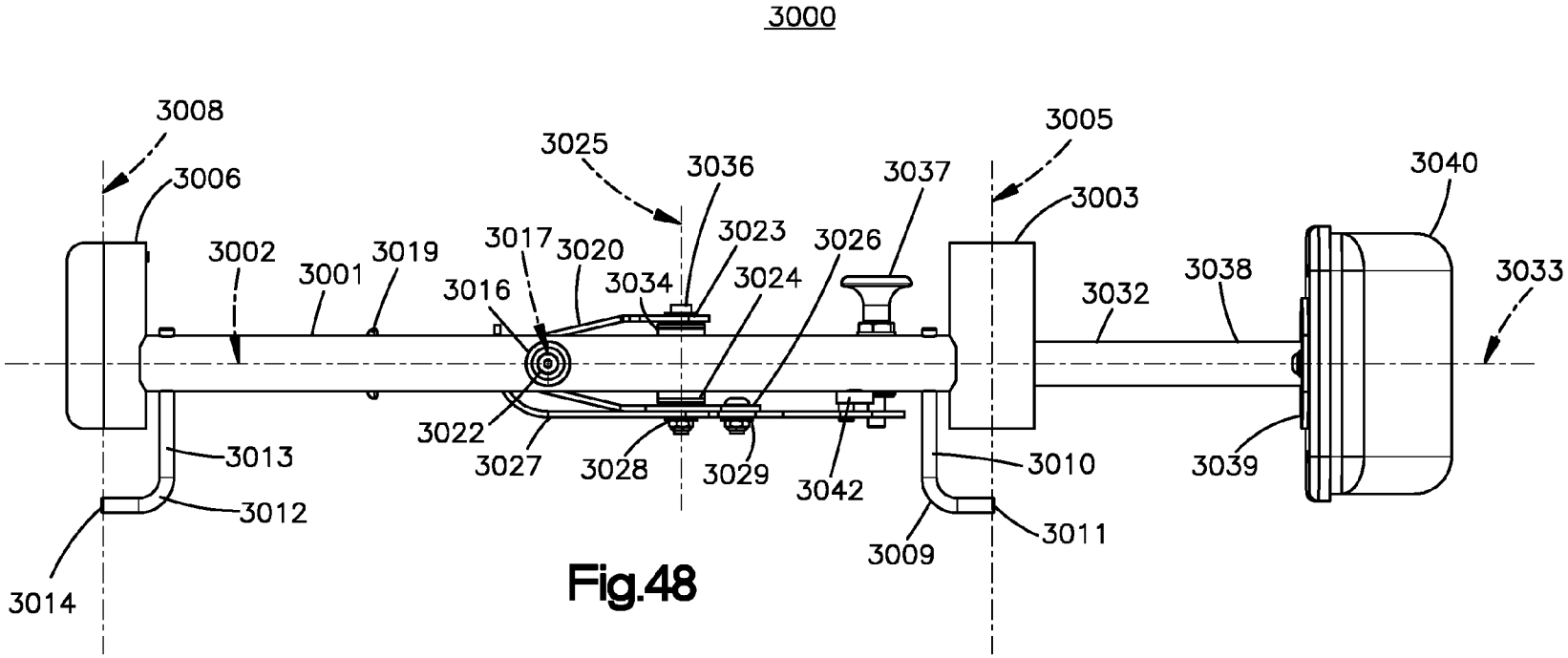
FIG. 48 is a top side view of the detachable stabilizing support system of FIG. 45, with the support pad in the storage position.

As best shown by FIG. 48, the pivot bracket 3020 includes a pair of aligned pivot holes 3023, 3024, which create a pivot axis 3025. The pivot bracket 3020 further includes a mounting hole 3026 for attaching an adjustment plate 3027. The adjustment plate 3027 includes a mounting hole 3029 and a pivot-and-mounting hole 3028 for mounting the adjustment plate 3027 to the pivot bracket 3020. Specifically, one or more fasteners pass through the mounting hole 3029 in the adjustment plate 3027 and the mounting hole 3026 in the pivot bracket 3020, in order to couple the adjustment plate 3027 to the pivot bracket 3020. The adjustment plate 3027 includes a plurality of locking pin holes 3030 for receiving a pull pin 3037 (see FIG. 45) and a pair of exercise/storage locking pin holes 3031, 3041 for receiving the storage locking pin 3019 (see FIGS. 46, 47).

One of ordinary skill in the art will understand and appreciate that, the adjustment plate 3027 and pivot bracket 3020 could be coupled together using other means, including by welding or adhering using glue. As yet another alternative, the adjustment plate 3027 and the pivot bracket 3020 could be formed as a single bracket. That is, an alternative pivot bracket 3020 could readily incorporate all of the functional features of the adjustment plate 3027.

Figure 46:
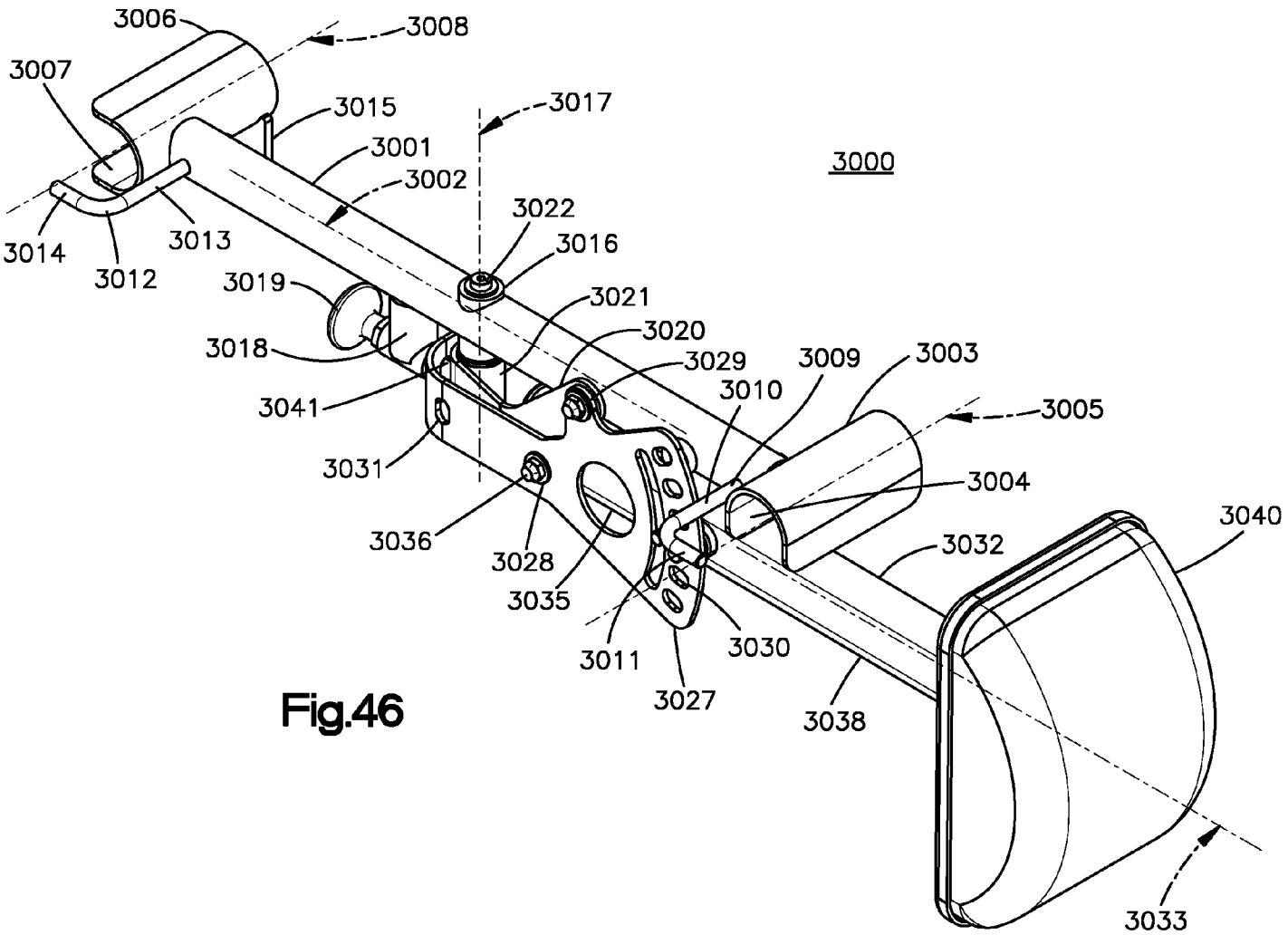
FIG. 46 is a top-right side isometric view of the detachable stabilizing support system of FIG. 45, with the support pad in the storage position.

The stabilizing support system 3000 of FIGS. 45-49 further includes a stabilizing strut 3032 having a longitudinal axis 3033. As illustrated by FIG. 45, the stabilizing strut 3032 (and its longitudinal axis 3033) is oriented generally perpendicular to the crossmember 3001 (and its central longitudinal axis 3002) when the stabilizing support system 3000 is in the exercise position. However, as best shown by FIGS. 46 and 47, the stabilizing strut 3032 (and its longitudinal axis 3033) is oriented generally parallel to the crossmember 3001 (and its central longitudinal axis 3002) when the stabilizing support system 3000 is in the storage position.

Referring to FIG. 48, the stabilizing strut 3032 includes a pivot sleeve 3034 near its rearward end 3035 (see FIG. 47). A pivot pin 3036 passes through: (1) the pivot hole 3023 in the pivot bracket 3020, (2) the pivot sleeve 3034 of the stabilizing strut 3032, (3) the pivot hole 3024 in the pivot bracket 3020, and (4) the pivot-and-mounting hole 3028 in the adjustment plate 3027. This provides a pivotal connection that allows the stabilizing strut 3032 to adjustably rotate about pivot axis 3025.

The stabilizing strut 3032 further includes a pull pin 3037 that can selectively engage into one of the locking pin holes 3030 in the adjustment plate 3027. Thus, similar to the stabilizing support system 1000 of FIGS. 1-5, the rotational orientation of the stabilizing strut 3032 about pivot axis 3025 can be selected by rotating the stabilizing strut 3032 into the desired position, and then locking the pull pin 3037 into a corresponding locking pin hole 3030. The pull pin 3037 may optionally be spring-loaded, so that it is biased toward the locking pin holes 3030. A forward end 3038 of the of the stabilizing strut 3032 includes a pad-mounting plate 3039. A support pad 3040 is mounted to the pad-mounting plate 3039.

The stabilizing support system 3000 depicted in FIGS. 45-49 can be used in connection with an exercise machine 100, an embodiment of which is shown and described above with reference to FIGS. 6-25. Similar to the stabilizing support system 1000 of FIGS. 1-5, the pull pin 3037 can be selectively engaged into one of the locking pin holes 3030 in the adjustment plate 3027. Doing so adjusts the rotational orientation of the stabilizing strut 3032 about pivot axis 3025. When the stabilizing support system 3000 is installed on an exercise machine 100 (see, e.g., FIGS. 28-38), this adjustment changes the height of the support pad 3040. Accordingly, to adjust the height of the support pad 3040, a user may: (1) withdraw the pull pin 3037 from the locking pin holes 3030, (2) rotate the stabilizing strut 3032 about pivot axis 3025 until the support pad 3040 is at the desired height, and (3) release the pull pin 3037 into the locking pin hole 3030 associated with the desired height of the support pad 3040.

Additionally, the stabilizing support system 3000 can be placed into an exercise position (FIG. 45) or adjusted into a more compact storage position (see FIGS. 46-49). As previously discussed, when the stabilizing support system 3000 is in the exercise position (FIG. 45), the stabilizing strut 3032 (and its longitudinal axis 3033) is oriented generally perpendicular to the crossmember 3001 (and its central longitudinal axis 3002). In this configuration, the storage locking pin 3019 aligns with exercise locking pin hole 3031 in the adjustment plate 3027. The storage locking pin 3019 may be engaged into the exercise locking pin hole 3031 to lock the stabilizing support system 3000 in the exercise position (FIG. 45).

A user may adjust the stabilizing support system 3000 into the storage position (FIGS. 46-49) by: (1) withdrawing the storage locking pin 3019 from the exercise locking pin hole 3031, (2) rotating the stabilizing strut 3032 about pivot axis 3017, toward the right-hand engagement channel 3003, until the stabilizing strut 3032 (and its longitudinal axis 3033) is oriented generally parallel to the crossmember 3001 (and its central longitudinal axis 3002), and (3) engaging the storage locking pin 3019 into storage locking pin hole 3041. A rubber bumper pad 3042 is configured to contact the adjustment plate 3027 as the stabilizing support system 3000 is moved into the storage position, in order to protect the components from impacting each other. The storage locking pin 3019 may optionally be spring-loaded, so that it is biased toward the exercise locking pin hole 3031 and the storage locking pin hole 3041.

Figure 49:
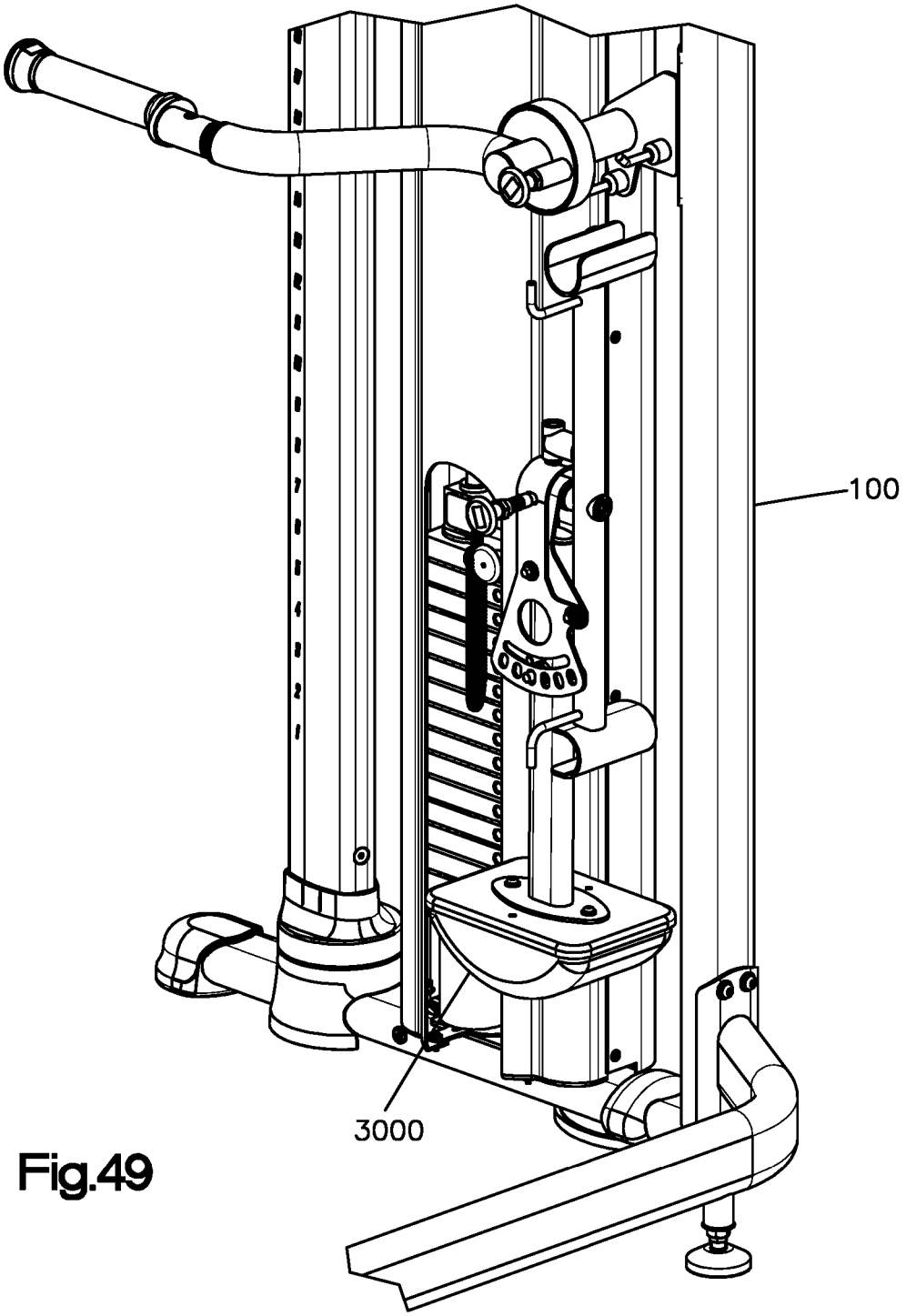
FIG. 49 is a rear-right side isometric view of the exercise machine as depicted in FIGS. 6-25, with the detachable stabilizing support system of FIGS. 45-48 hanging in a stored position from its storage hook.

The stabilizing support system 3000 is much more compact when placed into the storage position because it is folded to where it only requires a mostly longitudinal space. As illustrated by FIG. 49, the stabilizing support system 3000 in the storage position may be easily stored on an exercise machine 100—without interfering with the use of the machine 100—by simply hanging the stabilizing support system 3000 from its storage hook 3015.

LIST OF REFERENCE NUMERALS 100-exercise machine
101-main frame
102-horizontal side strut
103-horizontal cross strut
104-support upright
105-horizontal connecting strut
106-pull-up grip
107-vertical column
108-lower pivot mount
109-upper pivot mount
110-pulley carriage
111-pull end
112-selectorized weight stack
116-adjustable pull-up grip
200-exerciser
300-left dip handle assembly
301-mounting bracket
302-fastener
303-reinforcing rib
304-support rod
305-arm mount hub
306-exercise position stop lug
307-storage position stop lug
308-storage position lock hole
309-exercise position lock hole
310-pivot shaft
311-inner bearing
312-outer bearing -continued

LIST OF REFERENCE NUMERALS 313-washer
314-locknut
315-end cap
316-pull-pin plunger
317-spring
318-barrel cap
319-threaded knob
320-stop plate
321-stop feature
322-bearing housing
323-pull-pin barrel
324-exercise arm
326-stop feature
327-adjustable dip handle
328-slot
330-pivot axis
331-longitudinal axis
332-second longitudinal axis
333-axis
350-threaded end
351-bearing bore
352-pull-pin bore
353-female-threaded opening
354-first end
355-first intermediate section
356-second intermediate section
357-threaded end
358-male threads
359-hole
360-spring-loaded pull pin
371-mounting portion
372-grip portion
400-right dip handle assembly
401-mounting bracket
402-fastener
403-reinforcing rib
404-support rod
405-arm mount hub
406-exercise position stop lug
407-storage position stop lug
408-storage position lock hole
409-exercise position lock hole
410-pivot shaft
411-inner bearing
412-outer bearing
413-washer
414-locknut
415-end cap
416-pull-pin plunger
417-spring
418-barrel cap
419-threaded knob
420-stop plate
421-stop feature
422-bearing housing
423-pull-pin barrel
424-exercise arm
426-stop feature
427-adjustable dip handle
428-slot
430-pivot axis
431-longitudinal axis
432-second longitudinal axis
433-axis
440-drink holder
450-threaded end
451-bearing bore
452-pull-pin bore
453-female-threaded opening
454-first end
455-first intermediate section
456-second intermediate section
457-threaded end
458-male threads
459-hole
460-spring-loaded pull pin
471-mounting portion -continued

| LIST OF REFERENCE NUMERALS |
|---|
| 472-grip portion |
| 480-contact point |
| 481-contact point |
| 1000-stabilizing support system |
| 1001-crossmember |
| 1002-central longitudinal axis |
| 1003-right-hand engagement channel |
| 1004-right/outward-facing slot |
| 1005-longitudinal axis |
| 1006-left-hand engagement channel |
| 1007-downward-facing slot |
| 1008-longitudinal axis |
| 1009-right-hand grip end stop |
| 1010-first member |
| 1011-second member |
| 1012-left-hand grip end stop |
| 1013-first member |
| 1014-second member |
| 1015-pivot bracket |
| 1016-pivot hole |
| 1017-pivot and adjustment bracket |
| 1018-pivot hole |
| 1019-pivot axis |
| 1020-mounting hole |
| 1021-adjustment plate |
| 1022-mounting hole |
| 1023-locking pin holes |
| 1024-stabilizing strut |
| 1025-longitudinal axis |
| 1026-pivot sleeve |
| 1027-pivot axis |
| 1028-rearward end |
| 1029-vertical support plate |
| 1030-rubber foot |
| 1031-forward end |
| 1032-pad-mounting plate |
| 1033-support pad |
| 1034-locking pin |
| 2000-stabilizing support system |
| 2001-crossmember |
| 2002-central longitudinal axis |
| 2003-right-hand engagement channel |
| 2004-right/outward-facing slot |
| 2005-longitudinal axis |
| 2006-left-hand engagement channel |
| 2007-downward-facing slot |
| 2008-longitudinal axis |
| 2009-right-hand grip end stop |
| 2010-first member |
| 2011-second member |
| 2012-left-hand grip end stop |
| 2013-first member |
| 2014-second member |
| 2016-stabilizing strut tube |
| 2017-longitudinal axis |
| 2018-pull pin |
| 2019-support post |
| 2020-locking pin holes |
| 2021-support pad |
| 2022-open, forward end |
| 3000-stabilizing support system |
| 3001-crossmember |
| 3002-central longitudinal axis |
| 3003-right-hand engagement channel |
| 3004-downward-facing slot |
| 3005-longitudinal axis |
| 3006-left-hand engagement channel |
| 3007-left/outward-facing slot |
| 3008-longitudinal axis |
| 3009-right-hand grip end stop |
| 3010-first member |
| 3011-second member |
| 3012-left-hand grip end stop |
| 3013-first member |
| 3014-second member |
| 3015-storage hook |
| 3016-pivot sleeve |

-continued

| LIST OF REFERENCE NUMERALS |
|---|
| 3017-pivot axis |
| 3018-locking pin standoff feature |
| 3019-storage locking pin |
| 3020-pivot bracket |
| 3021-pivot sleeve |
| 3022-pivot pin |
| 3023-pivot hole |
| 3024-pivot hole |
| 3025-pivot axis |
| 3026-mounting hole |
| 3027-adjustment plate |
| 3028-pivot-and-mounting hole |
| 3029-mounting hole |
| 3030-locking pin hole |
| 3031-exercise locking pin hole |
| 3032-stabilizing strut |
| 3033-longitudinal axis |
| 3034-pivot sleeve |
| 3035-rearward end |
| 3036-pivot pin |
| 3037-pull pin |
| 3038-forward end |
| 3039-pad-mounting plate |
| 3040-support pad |
| 3041-storage locking pin hole |
| 3042-rubber bumper pad |

The list of reference numerals is provided for convenience and is intended to aid understanding of the illustrated embodiments described above. The embodiments of the present invention may be described in many different forms and should not be construed as limited to the illustrated embodiments. Likewise, the list above setting forth the reference numerals and associated components comprising the illustrated embodiments do not limit the scope of the invention as recited in the claims that follow.

We claim:

1. A detachable stabilizing support assembly, comprising: a crossmember having a central longitudinal axis, the crossmember having a first end and a second end opposite the first end; a first engagement portion associated with the first end of the crossmember; a second engagement portion associated with the second end of the crossmember; a stabilizing support strut mounted to the crossmember; and a support pad mounted on the stabilizing support strut, wherein the first and second engagement portions are configured for mounting the detachable stabilizing support assembly onto an exercise machine, wherein the first engagement portion includes a first engagement channel having a first longitudinal axis, wherein the second engagement portion includes a second engagement channel having a second longitudinal axis, and wherein the first engagement channel forms a downward-facing slot.

2. The detachable stabilizing support assembly according to claim 1 further comprising a pivot bracket mounted to the crossmember, wherein the stabilizing support strut is pivotally mounted on the pivot bracket for rotation about a pivot axis.

3. The detachable stabilizing support assembly according to claim 2 further comprising:

a plurality of locking pin holes associated with the pivot bracket; and a locking pin associated with the stabilizing support strut, wherein the locking pin is selectably engagable into the plurality of locking pin holes in order to selectably adjust an orientation of the stabilizing support strut about the pivot axis.

4. The detachable stabilizing support assembly according to claim 3 further comprising an adjustment plate mounted on the pivot bracket, wherein the adjustment plate includes the plurality of locking pin holes.

5. The detachable stabilizing support assembly according to claim 3, wherein the orientation of the stabilizing support strut about the pivot axis determines a location of the support pad.

6. The detachable stabilizing support assembly according to claim 5, wherein the pivot axis is substantially horizontal when the detachable stabilizing support assembly is mounted on the exercise machine, and wherein the orientation of the stabilizing support strut about the pivot axis determines a height of the support pad.

7. A detachable stabilizing support assembly, comprising:

a crossmember including a first end and a second end opposite the first end;

a first engagement channel associated with the first end of the crossmember;

a second engagement channel associated with the second end of the crossmember;

a pivot bracket mounted to the crossmember;

a stabilizing support strut pivotally mounted on the pivot bracket for rotation about a pivot axis, the stabilizing support strut including a first end and a second end opposite the first end of the stabilizing support strut;

a support pad mounted at the first end of the stabilizing support strut; and a vertical support plate mounted at the second end of the stabilizing support strut, wherein the first and second engagement channels are configured for mounting the detachable stabilizing support assembly onto a set of dip handles associated with an exercise machine.

8. The detachable stabilizing support assembly according to claim 1, wherein the second engagement channel is substantially U-shaped and forms an outward-facing slot.

9. The detachable stabilizing support assembly according to claim 1, wherein the first longitudinal axis and the second longitudinal axis are substantially horizontal when the detachable stabilizing support assembly is mounted on the exercise machine.

10. The detachable stabilizing support assembly according to claim 1, wherein the first longitudinal axis and the second longitudinal axis are substantially perpendicular to the central longitudinal axis.

11. The detachable stabilizing support assembly according to claim 1, wherein the first engagement portion includes a first grip end stop, and the second engagement portion includes a second grip end stop.

12. The detachable stabilizing support assembly according to claim 11, wherein the first and second grip end stops are each associated with the crossmember.

13. The detachable stabilizing support assembly according to claim 12, wherein the first and second grip end stops each include a first member extending from the crossmember and a second member extending from the respective first member.

14. The detachable stabilizing support assembly according to claim 13, wherein each of the second members of the respective first and second grip end stops extend in a direction substantially parallel with the central longitudinal axis.

15. The detachable stabilizing support assembly according to claim 13, wherein the second member of the first grip end stop intersects the first longitudinal axis; and wherein the second member of the second grip end stop intersects the second longitudinal axis.

16. The detachable stabilizing support assembly according to claim 11, wherein the first grip end stop is mounted on the first engagement channel and the second grip end stop is mounted on the second engagement channel.

17. The detachable stabilizing support assembly according to claim 16, wherein the first and second grip end stops are surfaces that close the forward, open ends of the respective first and second engagement channels.

18. The detachable stabilizing support assembly according to claim 1 further comprising a vertical support plate, wherein the support pad is mounted at a first end of the stabilizing support strut and the vertical support plate is mounted at a second end of the stabilizing support strut, which is opposite the first end of the stabilizing support strut.

19. The detachable stabilizing support assembly according to claim 18 further comprising a rubber foot associated with the vertical support plate.

20. The detachable stabilizing support assembly according to claim 1, wherein the stabilizing support strut is substantially perpendicular to the crossmember.

21. The detachable stabilizing support assembly according to claim 1, wherein the first and second engagement portions are configured for mounting the detachable stabilizing support assembly onto a set of dip handles associated with the exercise machine.

22. The detachable stabilizing support assembly according to claim 1 or 7, wherein the first engagement channel is substantially U-shaped.

23. A detachable stabilizing support assembly, comprising:

a crossmember having a central longitudinal axis, a first end, and a second end opposite the first end;

a first engagement channel associated with the first end of the crossmember, the first engagement channel having a first longitudinal axis;

a second engagement channel associated with the second end of the crossmember, the second engagement channel having a second longitudinal axis;

a pivot bracket mounted to the crossmember;

an adjustment plate associated with the pivot bracket, the adjustment plate including a plurality of locking pin holes;

a stabilizing support strut pivotally mounted on the pivot bracket for rotation about a pivot axis, the stabilizing support strut having a third longitudinal axis, a first end, and a second end opposite the first end of the stabilizing support strut; and a locking pin associated with the stabilizing support strut, wherein the locking pin is selectably engagable into the plurality of locking pin holes in order to selectably adjust an orientation of the stabilizing support strut about the pivot axis;

a support pad mounted on the first end of the stabilizing support strut;

a vertical support plate mounted on the second end of the stabilizing support strut, a first grip end stop associated with the first engagement channel; and a second grip end stop associated with the second engagement channel, wherein the first and second longitudinal axes are substantially parallel to each other and substantially perpendicular to the central longitudinal axis, wherein the third longitudinal axis is substantially perpendicular to the central longitudinal axis, wherein the first and second engagement channels are configured for mounting the detachable stabilizing support assembly onto a set of dip handles associated with an exercise machine, wherein the pivot axis is substantially horizontal when the detachable stabilizing support assembly is mounted on the exercise machine, and wherein the orientation of the stabilizing support strut about the pivot axis determines a height of the support pad.

* * * * *